US009574554B2

(12) United States Patent
Reed et al.

(10) Patent No.: US 9,574,554 B2
(45) Date of Patent: Feb. 21, 2017

(54) CONTROL SYSTEM FOR AN AIR OPERATED DIAPHRAGM PUMP

(71) Applicant: Proportion-Air, Inc., McCordsville, IN (US)

(72) Inventors: David A. Reed, Greenfield, IN (US); Timothy D. Hogue, Indianapolis, IN (US)

(73) Assignee: Proportion-Air, Inc., McCordsville, IN (US)

( * ) Notice: Subject to any disclaimer, the term of this patent is extended or adjusted under 35 U.S.C. 154(b) by 761 days.

(21) Appl. No.: 13/657,298

(22) Filed: Oct. 22, 2012

(65) Prior Publication Data

US 2014/0109763 A1 Apr. 24, 2014

Related U.S. Application Data

(63) Continuation of application No. 11/719,593, filed as application No. PCT/US2005/041512 on Nov. 17, 2005, now Pat. No. 8,292,600, which is a continuation-in-part of application No. 10/991,296, filed on Nov. 17, 2004, now Pat. No. 7,517,199, and a continuation-in-part of application No. 11/257,333, filed on Oct. 24, 2005, now Pat. No. 7,658,598.

(51) Int. Cl.
*F04B 49/00* (2006.01)
*F04B 15/02* (2006.01)
*F04B 43/073* (2006.01)

(52) U.S. Cl.
CPC ..... *F04B 15/02* (2013.01); *F04B 43/0736* (2013.01); *F04B 49/00* (2013.01)

(58) Field of Classification Search
CPC ..... F04B 45/0536; F04B 49/03; F04B 49/065
USPC ..... 91/37, 38
See application file for complete search history.

(56) References Cited

U.S. PATENT DOCUMENTS 3,838,946 A * 10/1974 Schall ..... 417/395
4,856,969 A * 8/1989 Forsythe ..... F04B 43/06 417/395
2009/0202361 A1* 8/2009 Reed ..... F04B 43/0736 417/46

* cited by examiner

*Primary Examiner* — Thomas E Lazo
*Assistant Examiner* — Daniel Collins
(74) *Attorney, Agent, or Firm* — Faegre Baker Daniels LLP

(57) ABSTRACT

The present invention includes methods and apparatuses for operating and controlling AOD pumps (10, 10', 10", 100, 460, 580, 740) and other pumps.

35 Claims, 47 Drawing Sheets

251

| 174 | 170 | 166 | 162 | 210 |
|---|---|---|---|---|
| ON | OFF | ON | OFF | OFF |
| | | | | |
| OFF | OFF | OFF | OFF | ON |
| | | | | |
| OFF | ON | OFF | ON | OFF |
| | | | | |
| OFF | OFF | OFF | OFF | ON |
| | | | | |

302

| 174 | 170 | 166 | 162 | 210 |
|---|---|---|---|---|
| ON | OFF | ON | OFF | OFF |
| | | | | |
| OFF | OFF | OFF | OFF | ON |
| | | | | |
| OFF | ON | OFF | OFF | OFF |
| | | | | |
| OFF | ON | OFF | ON | OFF |
| | | | | |
| OFF | OFF | OFF | OFF | ON |
| | | | | |
| OFF | OFF | ON | OFF | OFF |

342

| 174 | 170 | 166 | 162 | 210 |
|---|---|---|---|---|
| ON | OFF | ON | OFF | OFF |
| | | | | |
| OFF | OFF | ON | OFF | OFF |
| | | | | |
| OFF | ON | OFF | ON | OFF |
| | | | | |
| OFF | ON | OFF | OFF | OFF |
| | | | | |

382

| 174 | 170 | 166 | 162 | 210 |
|---|---|---|---|---|
| ON | OFF | ON | OFF | OFF |
| | | | | |
| OFF | OFF | ON | OFF | OFF |
| | | | | |
| OFF | OFF | OFF | OFF | ON |
| | | | | |
| OFF | ON | OFF | ON | OFF |
| | | | | |
| OFF | ON | OFF | OFF | OFF |
| | | | | |
| OFF | OFF | OFF | OFF | ON |

722

| 872 | 862 | 766 | 778 |
|---|---|---|---|
| ON | OFF | OFF | OFF |
| | | | |
| OFF | ON | OFF | ON |
| | | | |
| OFF | OFF | ON | OFF |
| | | | |
| OFF | ON | OFF | ON |
| | | | |

CONTROL SYSTEM FOR AN AIR OPERATED DIAPHRAGM PUMP

RELATED APPLICATIONS

The present application is a continuation of Ser. No. 11/719,593, titled "Control System For An Air Operated Diaphragm Pump," filed Feb. 9, 2009, to Reed et al., which is a U.S. National Stage of International Patent Application Serial No. PCT/US2005/041512, titled "Control System for an Air Operated Diaphragm Pump," filed Nov. 17, 2005, to Reed et al., which is a continuation-in-part of U.S. patent application Ser. No. 10/991,296, titled "Control System For An Air Operated Diaphragm Pump," filed Nov. 17, 2004, to Reed et al., and U.S. patent application Ser. No. 11/257,333, titled "Method and Control System For A Pump," filed Oct. 24, 2005, to Reed et al., the disclosures of which are expressly incorporated by reference herein.

BACKGROUND OF THE INVENTION

The present invention relates generally to a pump. More particularly, the present invention relates to a control system for a pump.

BACKGROUND AND SUMMARY

Pumps are used in the sanitation, industrial, and medical fields to pump liquids or slurries. In air operated diaphragm pumps (AOD pumps), flexible diaphragms generally exhibit excellent wear characteristics even when used to pump relatively harsh components such as concrete. Diaphragms pumps use the energy stored in compressed gases to move liquids. AOD pumps are particularly useful for pumping higher viscosity liquids or heterogeneous mixtures or slurries such as concrete. Compressed air is generally used to power AOD pumps in industrial settings.

According to one aspect of the present invention, a method of controlling a pump is provided. The pump a housing defining a pumping chamber and a pump member, such as a diaphragm, piston, flexible tube, or any other pump member known to those of ordinary skill in the art. The pump member separates the pumping chamber between a pumping side that receives pressurized fluid to power movement of pump member and a pumped side contain a fluid to be pump. Because of the pressurized fluid provided to the pumping chamber, the pump member moves from a first position to a second position, such as an end-of-stroke position for a diaphragm or piston or a fully contracted position for a flexible tube. The method includes the step of providing pressurized fluid to the pumping side of the chamber to move the pump member from the first position toward the second position and blocking the pressurized fluid from flowing into the pumping chamber before the pump member reaches the second position. The blocking may be partial or complete.

According to another aspect of the present invention, the position of the pump member is detected either directly or indirectly and used time the step of providing pressurized fluid to the pumping side of the chamber.

According to one aspect of the present inventions, a pump is provided that includes first and second diaphragm chambers, a pressure sensor, and a controller. Each diaphragm chamber includes a diaphragm. The diaphragms are coupled together. The pressure sensor is positioned to detect a pressure in at least one of the first and second diaphragm chambers and to output a signal indicative thereof. The controller is configured to receive the signal from the pressure sensor and monitor a pressure to detect the position of at least one of the diaphragms.

According to another aspect of the present invention, another pump is provided including first and second diaphragm chambers, a pressure sensor, and a controller. Each diaphragm chamber includes a diaphragm. The diaphragms are coupled together and operate in a cycle having a plurality of stages including a designated stage. The pressure sensor is positioned to detect a pressure in at least one of the first and second diaphragm chambers and to output a signal indicative thereof. The controller is configured to receive the signal from the pressure sensor to detect when the cycle reaches the designated stage.

According to another aspect of the present invention, a pump is provided including a housing defining an interior region, a pump member positioned to move in the interior region to pump material, a pressure sensor, and a controller. The interior region of the housing has a substantially cyclical pressure profile. The pressure sensor is positioned to detect the pressure in the interior region and to output a signal indicative thereof. The controller receives the output signal and monitors the substantially cyclical pressure profile.

According to another aspect of the present invention, a pump is provided that includes a housing defining an interior region, a pump member positioned to move in the interior region in a cycle to pump material, a pressure sensor positioned to detect a pressure in the interior region and to output a signal indicative thereof, a controller that receives the output signal and detects at least one parameter of the cycle, and an air supply valve providing air to the interior region that is controlled by the controller based on detection of the at least one parameter.

Additional features of the present invention will become apparent to those skilled in the art upon consideration of the following detailed description of the presently perceived best mode of carrying out the invention.

BRIEF DESCRIPTION OF THE DRAWINGS

The detailed description of the drawings particularly refers to the accompanying figures in which.

DETAILED DESCRIPTION OF THE DRAWINGS

Figure 1:
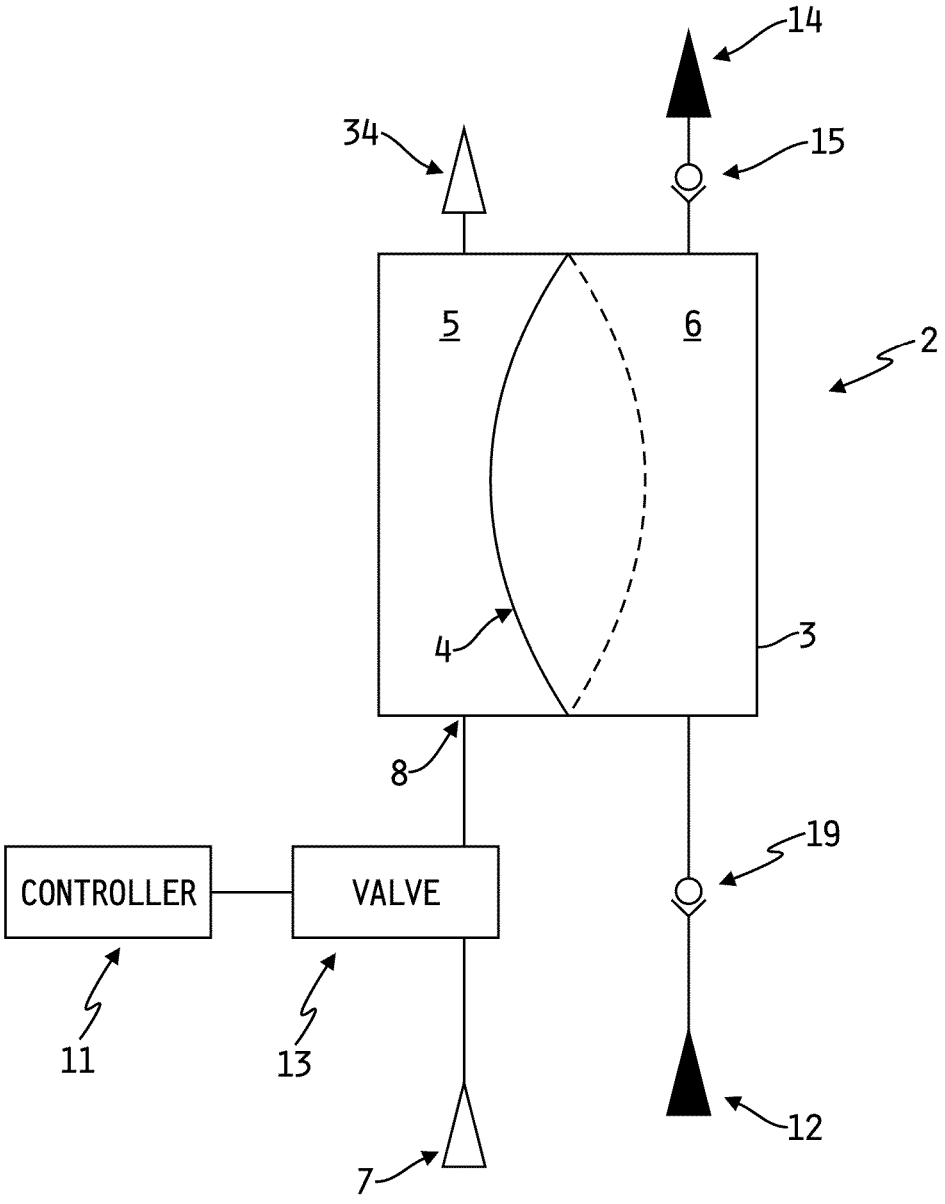
FIG. 1 is a schematic illustrating one embodiment of a pump showing the pump, an air supply, a control valve downstream of the air supply, and a controller coupled to the control valve.

A pump 2 is shown in FIG. 1 for moving fluid, such as water or cement, from a first location 12 to a second location 14. Pump 2 includes a housing 3 and a pump member 4 dividing housing into a pumping side 5 and a pumped side 6. Pump 2 is powered by a pressure source 7, such as an air or fluid compressor or pump. Pressured fluid, such as air, is provided to pump 2 through an inlet 8 into housing 3. The supply of pressurized fluid provided to pump chambers pumping side 5 is controlled by a controller 11 and a supply valve 13. As illustrated herein, controller 11 may be electrical, mechanical, or any other configuration known to those of ordinary skill in the art.

As described below, supply valve 13 may be a solenoid valve, an air piloted valve or any other type of valve known to those of ordinary skill in the art that is controlled by controller 11. During operation, pressure source 7 provides air to supply valve 13. Controller 11 sends a signal to supply valve 13 to move between an open position supplying pressurized fluid to pumping side 5 and a closed position blocking pressurized fluid from pumping side 5.

When supply valve 13 provides pressurized fluid to pumping side 5, the pressurized fluid provided by pressure source 7 urges pump member 4 to the right (as shown in phantom) and forces fluid out of pumped side 6. This fluid travels toward second location 14 up through a check valve 15 and is blocked from moving down toward first location 12 by another check valve 19. The pressure on pumping side 5 is then relieved allowing pump member 4 to return to the left-most position shown in FIG. 1 in solid. This pressure may be relieved by a valve or other mechanisms known to those of ordinary skill in the art such as a valve positioned between pumping side 5 and an exhaust 34. Pump member 4 may then be moved to the left by fluid pressure on pumped side 6, a spring (not shown), another pumping member (as described below) or by other methods known to those of ordinary skill in the art.

As pumping member 4 moves to the left, fluid is drawn into pumped side 6 from first location 12 through check valve 19. Controller 11 then sends another signal to supply valve 13 to move to the opened position supplying pressurized fluid to pumping side 5 to force the fluid in pumped side 6 to second location 14.

Exemplary controller 11 only provides full fluid power to pumping side 5 of pump 1 for a portion of the time that pump member 4 travels to the right. During the remainder of the travel time of pump member 4, controller 11 moves supply valve 13 to a fully or partially closed position so less than full fluid power is provided to pumping side 5. This reduction in fluid power may be a complete blockage of flow, a reduction in flow, a reduction in pressure, or any other reduction in the fluid power to pumping side 5.

As shown in FIG. 1, pump 2 is an open loop system such that controller 11 opens and closes supply valve 13 without feedback from pump 2. To compensate for this lack of feedback, controller 11 includes a timer that opens and closes supply valve 13 on a periodic basis.

Figure 2:
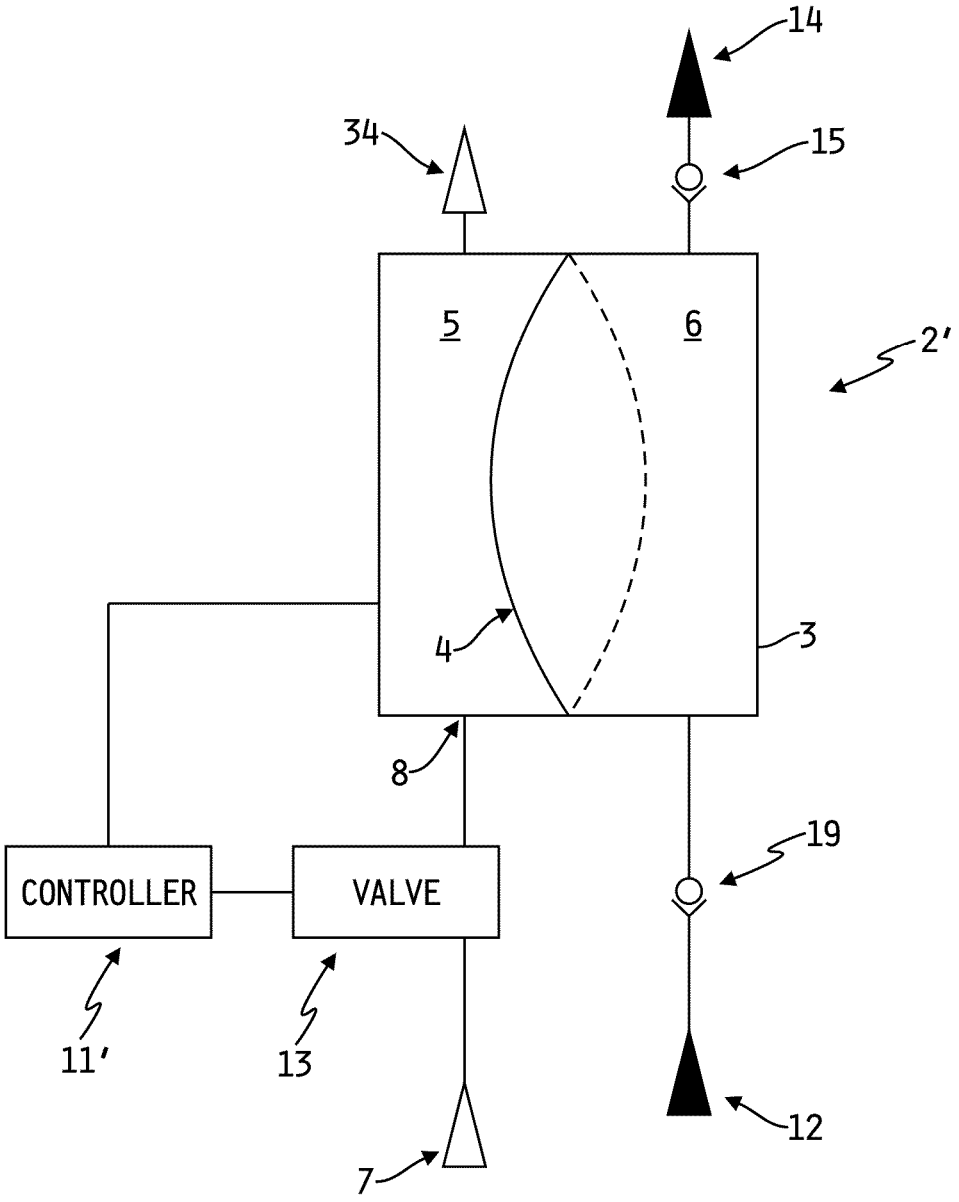
FIG. 2 is a schematic illustrating another embodiment of a pump showing the pump, an air supply, a control valve downstream of the air supply, a controller coupled to the control valve and the pump receiving a signal from the pump.

Another pump 2' is shown in FIG. 2 that is similar to pump 2 shown in FIG. 1 except that pump 2' is a closed loop system with a controller 11' that receives feedback from pump 2' providing an indication as to the position of pump member 4. Based on the feedback signal, controller 11' times the opening of supply valve 13. Thus, when controller 11' receives feedback from pump 2' as to when pump member 4 has or will reach the left-most position, controller 11' opens supply valve 13. The feedback provided to controller 11' may be an electrical signal provided by a sensor, a mechanical signal provided by a linkage, a fluid pressure signal, or any other mechanical signal, or any other means of communication.

Figure 3:
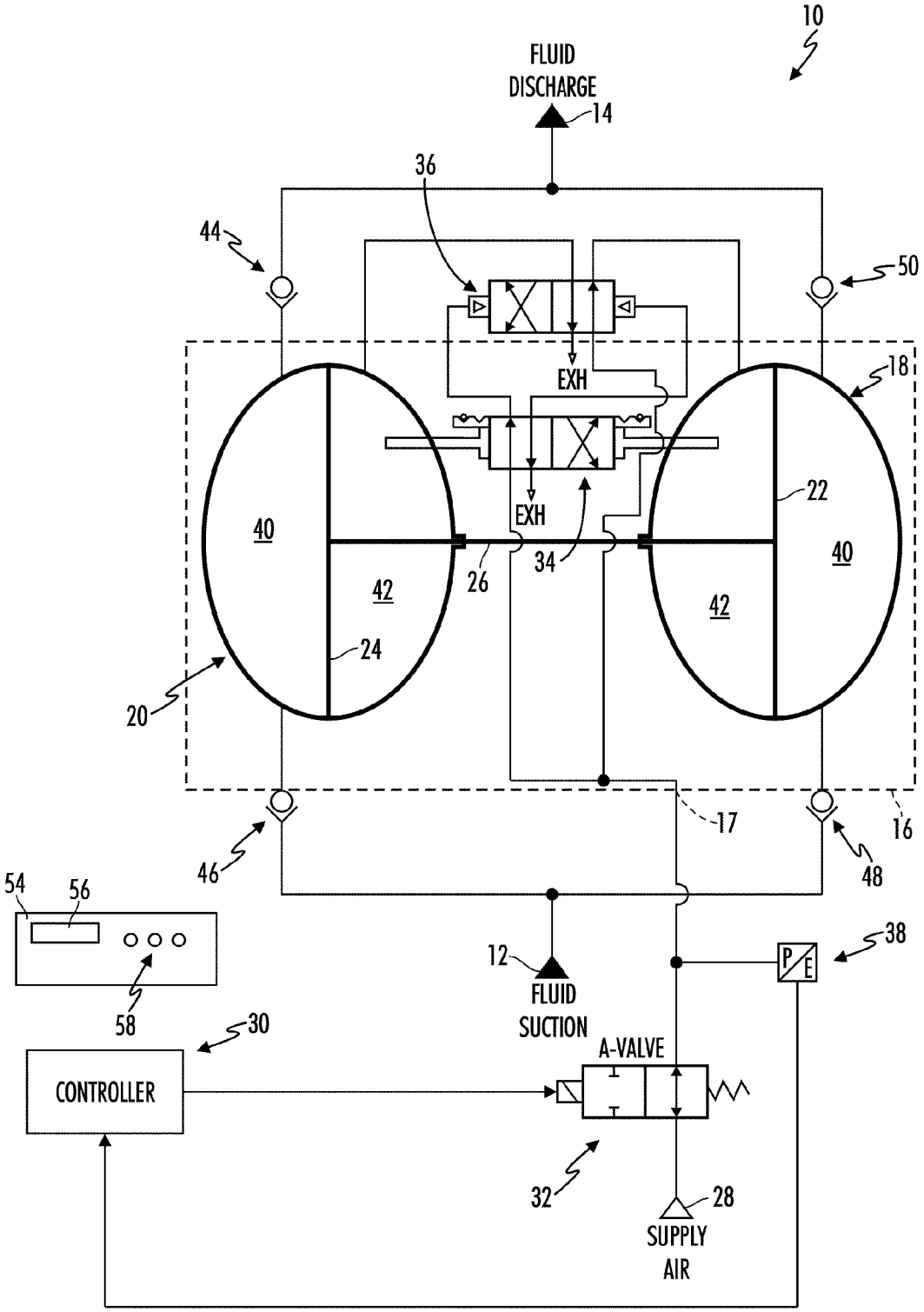
FIG. 3 is a schematic illustrating one embodiment of an AOD pump showing the pump, an air supply, a control valve immediately downstream of the air supply (or upstream from of the AOD pump), a pressure sensor immediately downstream of the control valve, and a controller coupled to the control valve and pressure sensor.

A preferred pump 10 in accordance with pump 2' is shown in FIG. 3 for moving fluid, such as water or cement, from first location 12 to second location 14. Pump 10 includes a housing 16 defining first and second pump chambers 18, 20 and first and second diaphragms 22, 24 positioned in first and second pump chambers 18, 20 that are connected together by a connection rod 26. Pump 10 is powered by a compressed air supply 28. Air is provided to pump 10 through an inlet 17 into housing 16. The supply of pressurized air provided to pump chambers 18, 20 is controlled by an electric controller 30, supply valve 32, pilot valve 34, main valve 36, and pressure sensor 38.

Supply valve 32 is preferably a solenoid valve that is controlled by controller 30. Pilot valve 34 is controlled by the position of first and second diaphragms 22, 24. Main valve 36 is controlled by pilot air provided by pilot valve 34. According to alternative embodiments of the present disclosure, other valve configurations are provided including fewer or more solenoid valves, pilot valves, and air-piloted valves, and other valves and control arrangements known to those of ordinary skill in the art.

During operation, air supply 28 provides air to supply valve 32. Controller 30 sends an electronic signal to supply valve 32 to move between an open position (shown in FIG. 3) providing air to main valve 36 from supply valve 32 and a closed position (not shown) blocking air from supply valve 32.

Main valve 36 moves between a first position (shown in FIG. 3) providing pressurized air to first pump chamber 18 and a second position (not shown) providing pressurized air to second pump chamber 20. First and second diaphragms 22, 24 divide respective pump chambers 18, 20 into fluid and air sides 40, 42. When main valve 36 provides air to first pump chamber 18, the pressurized air provided by air supply 28 urges first diaphragm 22 to the right and forces fluid out of fluid side 40. This fluid travels toward second location 14 up through a check valve 50 and is blocked from moving down toward first location 12 by another check valve 48.

During this movement of first diaphragm 22, rod 26 pulls second diaphragm 24 to the right. As second diaphragm 24 moves to the right, fluid side 40 of second pump chamber 20 expands and fluid is pulled up through a check valve 46 from first location 12. Another check valve 44 blocks fluid from second location 14 from being drawn into fluid side 40 of second pump chamber 20.

Near the end of the movement of second diaphragm 24 to the right, it strikes pilot valve 34 and urges it to the right as shown in FIG. 3. Pilot valve 34 then provides pressurized air to the port on the left side of main valve 36 to move it to the right from the position shown in FIG. 3. When main valve 36 moves to the right, it supplies pressurized air from air supply 28 to air side 42 of second pump chamber 20.

As air is provided to air side 42 of second pump chamber 20, the pressurized air pushes second diaphragm 24 to the left and rod 26 pulls first diaphragm 22 to the left. Fluid in fluid side 40 of second chamber 20 is pushed up past check valve 44 toward second location 14 and blocked from moving down toward first location 12 by check valve 46. As the same time, fluid is drawn into fluid side 40 of first chamber 18 from first location 12 through check valve 48. Check valve 50 blocks fluid from being drawn from second location 14.

Near the end of the movement of first diaphragm 22 to the left, it strikes pilot valve 34 and urges it to the left (not shown). Pilot valve 34 then provides pressurized air to the port on the right side of main valve 36 to move it to the left as shown in FIG. 3. When main valve 36 moves to the left, it supplies pressurized air from air supply 28 to air side 42 of first pump chamber 18 to complete one cycle of pump 10. Additional details of the operation of pump 10 is provided below and in U.S. patent application Ser. No. 10/991,296, filed Nov. 17, 2004, titled Control System for An Air Operated Diaphragm Pump, to Reed et al., the disclosure of which is expressly incorporated by reference herein.

Figure 4:
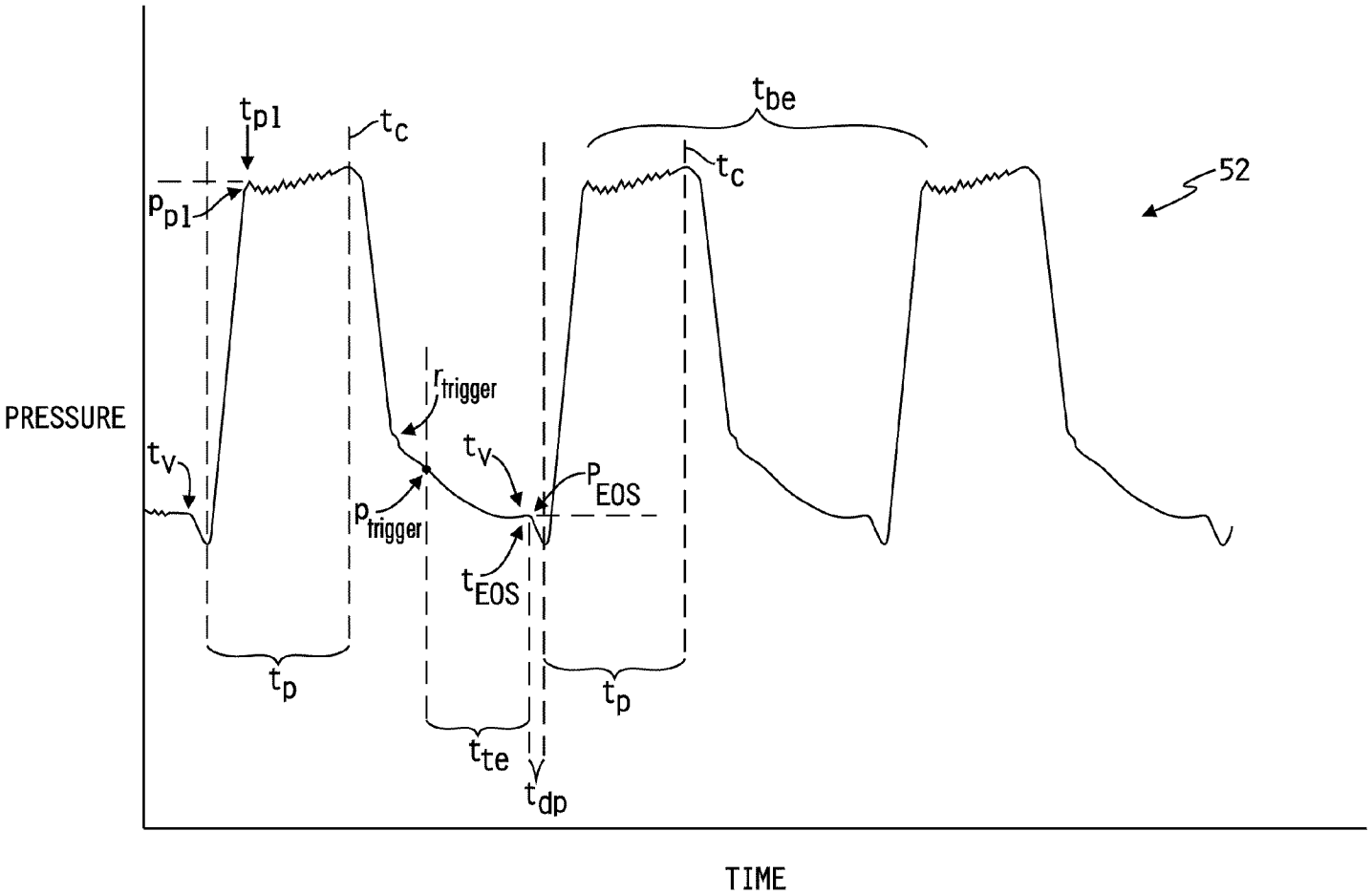
FIG. 4 is a graph of the pressure sensed by the pressure sensor during operation of the AOD pump according to one embodiment of the present disclosure.

According to one embodiment of the present disclosure, supply valve 32 controls how long pressurized air is provided to first and second chambers 18, 20 so that chambers 18, 20 are not always in fluid communication with air supply 28. When main valve 36 changes to the position shown in FIG. 3, it supplies air to air side 42 of first chamber 18 and vents air from air side 42 of second chamber 20. Supply valve 32 only provides air to main valve 36 for a predetermined amount of time ($t_p$) as shown in FIG. 4 until supply valve 32 closes at $t_c$. According to the current configuration of pump 10, $t_p$ is preferably between 100-500 ms depending on the operating conditions. According to alternative embodiments, other lesser or greater values of $t_p$ may be used, such 50 ms, 1000 ms, or other suitable times. After $t_c$, supply valve 32 closes and air supply 28 does not provide any more pressurized air. This operation also applies to second chamber 20 in the second half of the cycle.

FIG. 4 shows a pressure profile or curve 52 detected by pressure sensor 38. Pressure sensor 38 detects the increase in pressure in air side 42 of first chamber 18 in the first half of a cycle and air side 42 of second chamber 20 in the second half of the cycle. During $t_p$, the pressure on air side 42 of first chamber 18 increases from near atmosphere as shown in FIG. 4 to approximately the supply pressure. After $t_c$, the pressure on air side 42 of first chamber 18 begins to gradually decrease as first diaphragm 22 moves to the right and air side 42 of first chamber 18 expands.

The pressure on air side 42 of first chamber 18 continues to gradually decrease until second diaphragm 24 strikes pilot valve 34 and causes main valve 36 to move to the right as shown in FIG. 3. After main valve 36 moves to the right, pressure sensor 38 is then exposed to the pressure in air side 42 of second chamber 20. During the expansion of air side 42 of first chamber 18, air side 42 of second chamber 20 vents to nearly atmosphere. Thus, when main valve 36 moved at $t_v$, pressure sensor 38 is exposed to nearly atmosphere, which is significantly less than the pressure in air side 42 of first chamber 18 to which it was just exposed. This rapid decrease in pressure is shown in FIG. 4 at $t_v$, when main valve 36 moves to the right.

Controller 30 is configured to detect the rapid decrease in pressure sensed by pressure sensor 38. By detecting this decrease in pressure, controller 30 can determine that one of first and second diaphragms 22, 24 is at its end of stroke (EOS). When controller 30 detects the rapid pressure drop, it knows that main valve 36 has changed positions. Because main valve 36 only changes positions when one of first and second diaphragms 22, 24 is at its EOS, controller 30 knows that one of the first and second diaphragms 22, 24 is at its EOS. When the EOS is detected, controller 30 causes supply valve 32 to reopen for $t_p$. Pressure sensor 38 continues to measure the pressure on air side 42 of second chamber 20 until main valve 36 switches positions. Controller 30 again detects the rapid pressure change to detect EOS causing supply valve 32 to open for the next cycle. Illustratively, only one sensor 38 is provided for monitoring the pressure in first and second diaphragms 22, 24. According to an alternative embodiment, separate sensors are provided for each diaphragm.

Figure 5:
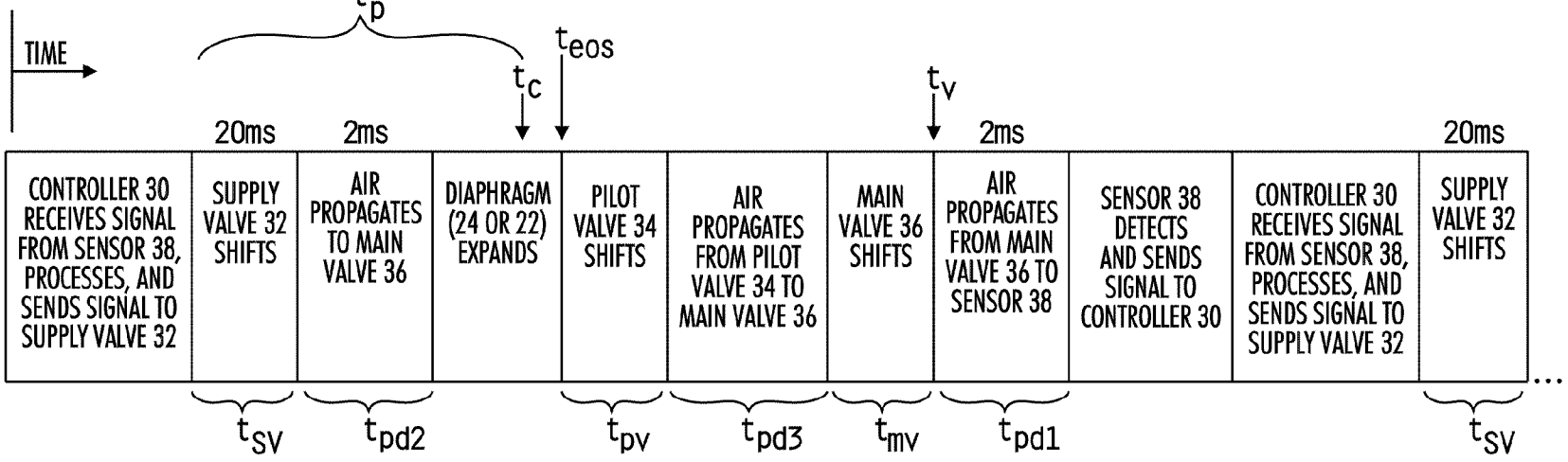
FIG. 5 is a diagram showing reaction or delay times between a diaphragm reaching a fully expanded position and pressurized air being supplied to the other diaphragm.

As shown in FIG. 4, a small delay occurs between $t_v$ and when supply valve 32 is reopened to pressurize air side 42 of second pump chamber 20. The components of pump 10 such as pilot valve 34, main valve 36, supply valve 32, and the other components of pump 10 have inherent reaction or delay times that slow down operation of pump 10. Some of the reaction or delay times between when diaphragm 22 (or 24) moves to the fully expanded position and the time pressurized air is provided to second diaphragm 24 (or 22) is shown in FIG. 5 (not to scale). Pilot valve 34 has a reaction time $t_{pv}$ between shifting between right to left positions. Similarly, main valve 36 has a reaction time $t_{mv}$ between receiving pilot pressure from pilot valve 34 and when it completely shifts to its new position. Solenoid supply valve 32 has a reaction time $t_{sv}$ between receiving a command from controller 30 and moving completely to the open position. Illustratively, supply valve 32 has an inherent response time of 20 ms. Other valves may have longer or shorter response times, such as 10, 40, or 90 ms.

Additional reaction time is required for air pressure to propagate or move through the conduits. For example, there is a delay time $t_{pd1}$ between when main valve 36 switches positions and air at near atmospheric pressure is provided to pressure sensor 38. Approximately the same delay time ($t_{pd1}$) occurs between main supply valve 32 and main valve 36 because sensor 38 is positioned so close to supply valve 32. Similarly, there is a delay time $t_{pd2}$ between when pressurized air is provided by supply valve 32 and the pressurized air reaches main valve 36. Similarly, there is an air propagation delay time $t_{pd3}$ between pilot valve 34 shifting and the air pressure reaching a respective port of main valve 36. According to one embodiment, the conduit propagation time is about 1 ms per foot of conduit. Assuming 2 feet of conduit exists between supply valve 32 (or sensor 38) and main valve 36, pump 10 has a propagation delay time $t_{pd1}$ of approximately 2 ms between supply valve 32 and main valve 36. Thus, the total delay between when controller 30 signals supply valve 32 to open and pressurized air is actually provided to main valve 36 is 22 ms. Depending on the selection of supply valve 32, the length of conduit, and other factors, such as the pilot pressure required to actuate main valve 36, the total delay may be longer or shorter. For example, according to other embodiments, the delay may about 10, 20, 30, 50, 60, 70, 80, 90, 100 ms or more.

According to one embodiment of the present disclosure, controller 30 compensates for the inherent reaction or delay times present in pump 10 to increase the operating speed of pump 10. Controller 30 commands the opening of supply valve 32 before the EOS occurs so that pressurized air is provided to the next-to-expand chamber 22 or 24 immediately, with little, if any delay. By compensating for the delay, controller 30 opens supply valve 32 sooner in the cycle to increase the pump speed.

To compensate for the delay, controller 30 triggers the opening of supply valve 32 based on the detection of a characteristic or parameter of pressure curve 52. This characteristic of pressure curve 52 becomes a timing trigger event on pressure curve 52 that indicates the operating position of pump 10 and its components. Once controller 30 observes the timing trigger event, it waits for an amount of wait time ($t_{wait}$), if any, to open supply valve 32. The length of $t_{wait}$ is calculated or selected by controller 30 or preprogrammed to reduce or eliminate the delay.

After controller 30 observes the timing trigger event, it waits for $t_{wait}$ to signal supply valve 32 to open. According to one embodiment, the timing trigger event is when the rate of decay of pressure slows to a predetermined amount such as at $r_{trigger}$ as shown in FIGS. 2 and 4. According to another embodiment, the trigger event is a predetermined threshold pressure such as the pressure at $p_{trigger}$. According to other embodiments, other characteristics of pressure curve 52 are used as trigger events. After controller 30 detects the trigger event (such as $r_{trigger}$ or $p_{trigger}$), it waits for $t_{wait}$ and then instructs supply valve 32 to open. According to alternative embodiments of the present disclosure, other sensors can be used to provide trigger events. According to one embodiment, a proximity sensor is provided that detects the actual physical position of pilot valve 34, rod 26, or either of both of diaphragms 20, 18 to sense a trigger event. According to other embodiments, the pressure is detected at other locations to detect a pressure derived trigger event. For example, according to one embodiment, pressure sensors are provided that detect the pressure in the pilot lines that provide pressure signals to main valve 36 indicating whether pilot valve 34 has changed positions.

To determine $t_{wait}$, controller 30 observes the amount of time ($t_{te}$) between the trigger event ($p_{trigger}$ in FIG. 4) and when the EOS is observed as described above. According to one embodiment, this observation is made over one cycle of pump 10. According to another embodiment, this time is observed over several cycles and averaged. Controller 30 then subtracts an amount of total delay time ($t_{td}$) from $t_e$ to determine $t_{wait}$. This removes or reduces the inherent delay between when main valve 36 switches positions and when pressurized air is supplied to main valve 36.

Controller 30 determines the amount of time to subtract ($t_{dt}$) by detecting the amount of delay in pump 10. Because pressure sensor 38 is positioned relatively close to supply valve 32, the amount of delay due to operation of controller 30 and supply valve 32 is approximately equal to the time from EOS ($t_{EOS}$) until the pressure begins to rise again at $t_{dp}$. This time may be calculated by controller 30 or preprogrammed Additional delay ($t_{pd1}$) is caused by air pressure propagation from main valve 36 to pressure sensor 38 just after main valve 36 switches position before $t_{EOS}$. Further delay ($t_{pd2}$) is caused by air pressure propagation from supply valve 32 to main valve 36 just after supply valve 32 opens. Illustratively, the air propagation delays ($t_{pd1}$ and $t_{pd2}$) are pre-programmed into controller 30. According to one embodiment of the present disclosure, the air propagation delays are determined based on the maximum pressure sensed in the pressure curve. If the pressure is high, the propagation delay is less than for lower pressure. When the length of conduit is known, the propagation delay can be determined based on the maximum pressure detected on the pressure curve. The propagation delays ($t_{pd1}$ and $t_{pd2}$) and supply valve delay ($t_{dp}$) are combined for $t_{td}$ and subtracted from $t_{te}$. Thus, $t_{wait}=t_{te}-t_{td}$. According to another embodiment, controller 30 gradually reduces $t_{te}$ (and thus $t_{wait}$) until the pump speed no longer increases and sets the reduced time as $t_{wait}$ and continues to use $t_{wait}$ for future cycles of pump 10. Preferably, controller 30 re-calculates $t_{wait}$ on a periodic basis to accommodate for changes in pump 10 that may effect its top speed.

Figure 6:
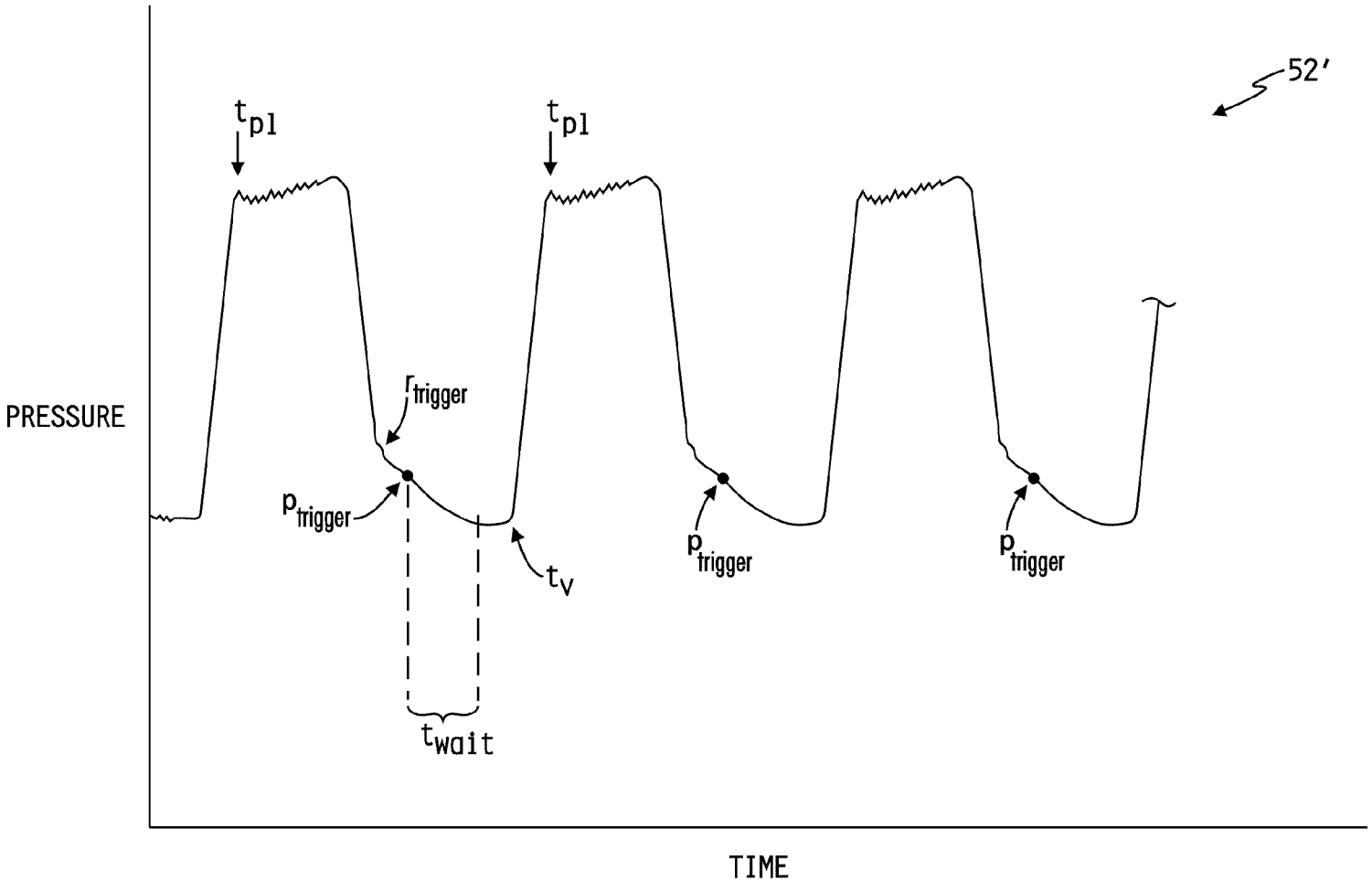
FIG. 6 is a graph of pressure sensed by the pressure sensor during operation of the AOD pump when inherent system delays are reduced or eliminated according to another embodiment of the present disclosure.

After determining $t_{wait}$, controller 30 detects the trigger event ($p_{trigger}$ in FIG. 6) and waits $t_{wait}$ to signal opening of supply valve 32. As shown in FIG. 6, this signaling occurs before main valve 36 switches positions at $t_v$ to accommodate for the inherent delay. Thus, controller 30 anticipates the movement of main valve 36 before it actually occurs so that pressurized air is provided to main valve 36 at about the time it switches positions.

Because the delay is substantially reduced or eliminated, pressurized air is provided to main valve 36 at $t_v$ with little or no delay so that pressurized air is provided to diaphragm 22 or 24 with little or no delay. By reducing or eliminating the delay, speed of pump 10 increases to increase the output of pump 10. Additionally, the characteristic pressure drop indicating EOS may no longer be present. For example, as shown in FIG. 6, a pressure spike occurs at sensor 38 just before main valve 36 opens at tv rather than a pressure drop as shown in FIG. 4. To detect EOS based on the rapid pressure drop shown in FIG. 4, $t_{wait}$ may be increased so that the rapid pressure drop reappears. This may be necessary for periodically recalibrating the ideal $t_{wait}$ over the life of pump 10.

Controller 30 is also configured to determine the pump speed by observing pressure curve 52 of FIG. 6 (showing inherent delay compensation) or pressure curve 52 of FIG. 4 (showing no delay compensation). By monitoring cyclical events in pressure curves 52 such as EOS or other timing events, the pump speed of pump 10 can be determined Controller 30 measures the time between each cyclical event ($t_{be}$) to determine the cycle time between each event. Because controller 30 will detect two events for each full cycle of pump 10 (one for first chamber 18 and one for second chamber 20), the cycle time will be twice $t_{be}$. The inverse of the cycle time ($2*t_{be}$) is the pump speed (cycles/unit of time).

By monitoring the pump speed, the fluid discharge rate ($Q_f$) of pump 10 can be determined During each change of position of first and second diaphragms 22, 24, pump 10 discharges a volume of fluid equal to the expanded volume ($V_e$) of fluid side 40 of either first and second chambers 18, 20. $V_e$ is a known, relatively fixed value. Because controller 30 knows the pump speed based on the signal from pressure sensor 38, the rate of discharge $Q_f$ can be determined by $2*V_e*$the pump speed.

Controller 30 can be used to control $Q_f$ by adjusting the time between the when cyclical characteristic (such as the EOS or other timing trigger) is detected and when supply valve 32 is opened. To maximize the pump speed, controller 30 provides no delay between when main valve 36 opens and pressurized air is provided to main valve 36 by supply valve 32. To reduce the output of pump 10, controller 30 provides a delay between when main valve 36 opens and pressurized air is provided to main valve 36 by supply valve 32. To decrease $Q_f$ and the pump speed, a longer delay is provided. To increase $Q_f$ and the pump speed, a shorter or no delay is provided. By adjusting $t_p$, controller 30 can also adjust $Q_f$.

Controller 30 is also configured to determine the air consumption of pump 10. By monitoring the pump speed and the pressure at EOS of diaphragms 22, 24, controller 30 can determine the mass flow rate of air used to operate pump 10. At the EOS, either air side 42 of first or second chamber 18, 20 is fully expanded with air. The fully expanded volume ($V_{ae}$) of the air side 42 and additional lines extending to supply valve 32 is a known, relatively fixed quantity. At the EOS, controller 30 knows the pressure ($P_{EOS}$) in the expanded air side 42. In FIG. 4, $P_{EOS}$ is equal to the pressure detected just before the rapid pressure drop. In FIG. 6, $P_{EOS}$ is substantially equal or slightly higher than the pressure detected just before the rapid increase caused by supply valve 32 providing pressurized air to main valve 36. Using the ideal gas law (PV=nRT), the mass of air ($m_a$) can be determined by $m_a=C*(P_{EOS}*V_{ae})/(R_a*T_a)$, where c is a constant for the compressed gas in use. $T_a$ is preprogrammed into controller 30 based on an average temperature of air normally provided to pump 10. According to an alternative embodiment, a temperature sensor (not shown) is provided to determine $T_a$ provided to pump 10. $R_a$ is the gas constant for air. Because controller 30 knows the pump speed based on the signal from pressure sensor 38, the mass flow rate of air ($Q_a$) can be determined by $2*m_a*$the pump speed.

As shown in FIG. 3 a user interface 54 may be provided that provides visual feedback to a user of the operational parameters of pump 10. Interface 54 may include an LCD screen 56 or other display that provides any combination of the pump operating parameters including, but not limited to, pump speed, instantaneous or accumulated mass air flow rates, pump fluid flow rates, the supply pressure, and the head pressure, Interface 54 also includes user inputs 58 that allow a user to control pump 10 by turning pump 10 on or off, adjusting $t_p$, or adjusting any of the other inputs to pump 10.

Depending on the specific design of housing 16, diaphragms 22, 24, the type of material being pumped, the preferred operating parameters of pump 10 may change. These parameters may include the pressure of the air supplied to pump 10, $t_p$, or $P_{EOS}$. Typically, if $P_{EOS}$ is greater than a preferred value, controller 30 is keeping supply valve 32 open too long providing an excess amount of air to air side 42. This excess air is then vented to atmosphere and the energy used to compress the excess air is wasted. If $P_{EOS}$ is lower than a preferred value, controller 30 is not keeping supply valve 32 open long enough so that there is not enough air to expand air side 42 of first pump chamber 18 completely or pump 10 may operate too slowly. Because controller 30 monitors $P_{EOS}$, it can decrease or increase $t_p$, as necessary to decrease or increase $P_{EOS}$. If the $P_{EOS}$ is above a determined maximum, controller 30 can lower $t_p$ to decrease $P_{EOS}$ If $P_{EOS}$ is below a determined minimum, controller 30 can increase $t_p$ to increase $P_{EOS}$. Similarly, if the supply pressure is too high, controller 30 can lower $t_p$ to decrease $P_{EOS}$. If the supply pressure is too low, controller 30 can increase $t_p$ to increase $P_{EOS}$.

In addition to monitoring $P_{EOS}$, controller 30 also monitors the pressure of air supply 28. As shown in FIGS. 2 and 4, the pressure in pump chambers 18, 20 generally plateaus at pressure $p_{pl}$ and time $t_{pl}$ while chambers 18, 20 are still exposed to air from air supply 28. The average air pressure during this plateau is generally equal to the air pressure provided by air supply 28. By monitoring the air pressure in chambers 18, 20 during the plateau, controller 30 determines the pressure of the air provided by air supply 28.

Controller 30 is also configured to operate pump 10 at its peak efficiency. By determining the fluid discharge rate from pump 10 and the air flow rate to the pump, controller 30 can determine the maximum efficiency of pump 10. During an efficiency test, controller 30 is configured to operate pump 10 over a range $t_p$. For each $t_p$, controller 30 determines the pump efficiency, which is the average $Q_f$ over the tested time period divided by $Q_a$. Controller 30 records the efficiency for each $t_p$ and determines the $t_p$ associated with the peak efficiency. If pump 10 is set to operate at maximum efficiency, controller 30 opens and closes supply valve 32 for the $t_p$ associated with the peak efficiency.

Over time, the amount of pressure necessary to pump the fluid may increase. For example, if a filter (not shown) is provided upstream or downstream of pump 10, the filter will gradually clog. As the filter clogs, it becomes more difficult to pump the fluid. Thus, a longer $t_p$ is necessary to ensure there is enough pressure to expand air sides 42 of first and second diaphragms 18, 20 to the fully expanded positions.

Controller 30 is provided with an anti-stall algorithm to detect and compensate when air supply 28 provides too little air to fully expand air side 42 of either first and second chambers 18, 20. Controller 30 is programmed to include a stall time $t_s$. If $t_s$ passes from the time supply valve 32 opens without the EOS or the trigger event occurring, controller 30 provides another burst of air. If after repeated bursts of air, controller detects that the pressure in air side 42 of first chamber 16 never decays, the controller knows that pump 10 has stalled because first diaphragm 18 is no longer moving and expanding the volume of air side 42 of first chamber 16. Controller 30 then sends a notification that pump 10 has stalled and needs servicing. Such a notification could be provided to a central control center, on LCD display 54 of pump 10, or by any other known notification device or procedure known to those of ordinary skill in the art. Additional details of a suitable anti-stall algorithm are provided below and in U.S. patent application Ser. No. 10/991,296, filed Nov. 17, 2004, which was previously expressly incorporated by reference herein. According to one embodiment, if $t_s$ passes, controller 30 sends an alarm or notification that pump 10 has stalled without providing additional air from air supply 28. According to one embodiment of the present disclosure, controller 30 periodically tests pump 10 to determine the appropriate length of $t_p$ by using the anti-stall algorithm. Periodically, pump 10 gradually lowers $t_p$ until a stall event is detected by the anti-stall algorithm. Controller 30 then resets $t_p$ to a value slightly above the $t_p$ just before the stall event so that $t_p$ is just longer than required to avoid stalling. According to one embodiment, $t_p$ is set 10 ms above the $t_p$ that resulted in stalling. For example, $t_p$ could be set to 110 ms if 100 ms caused stalling.

The control system operating pump 10 can be provided on a wide variety of pumps, regardless of the pump manufacture. Many AOD pumps have common features. For example, many AOD pumps have valves or other devices that control switching of the air supply between the diaphragm chambers, such as valves 34, 36 of pump 10. Another common feature on AOD pumps is an air inlet, such as inlet 17, that receives pressurized air from an air supply.

As shown in FIG. 3, pressure sensor 38 and supply valve are positioned upstream of inlet 17 of housing 16. Controller 30 is coupled to these upstream components. Thus, pump 10 is controlled through inlet 17, a feature common to AOD pump. Because pump 10 is controlled through a common AOD pump feature, it can be used on almost any AOD pump by controlling the supply of air provided to the pump's inlet.

Figure 7:
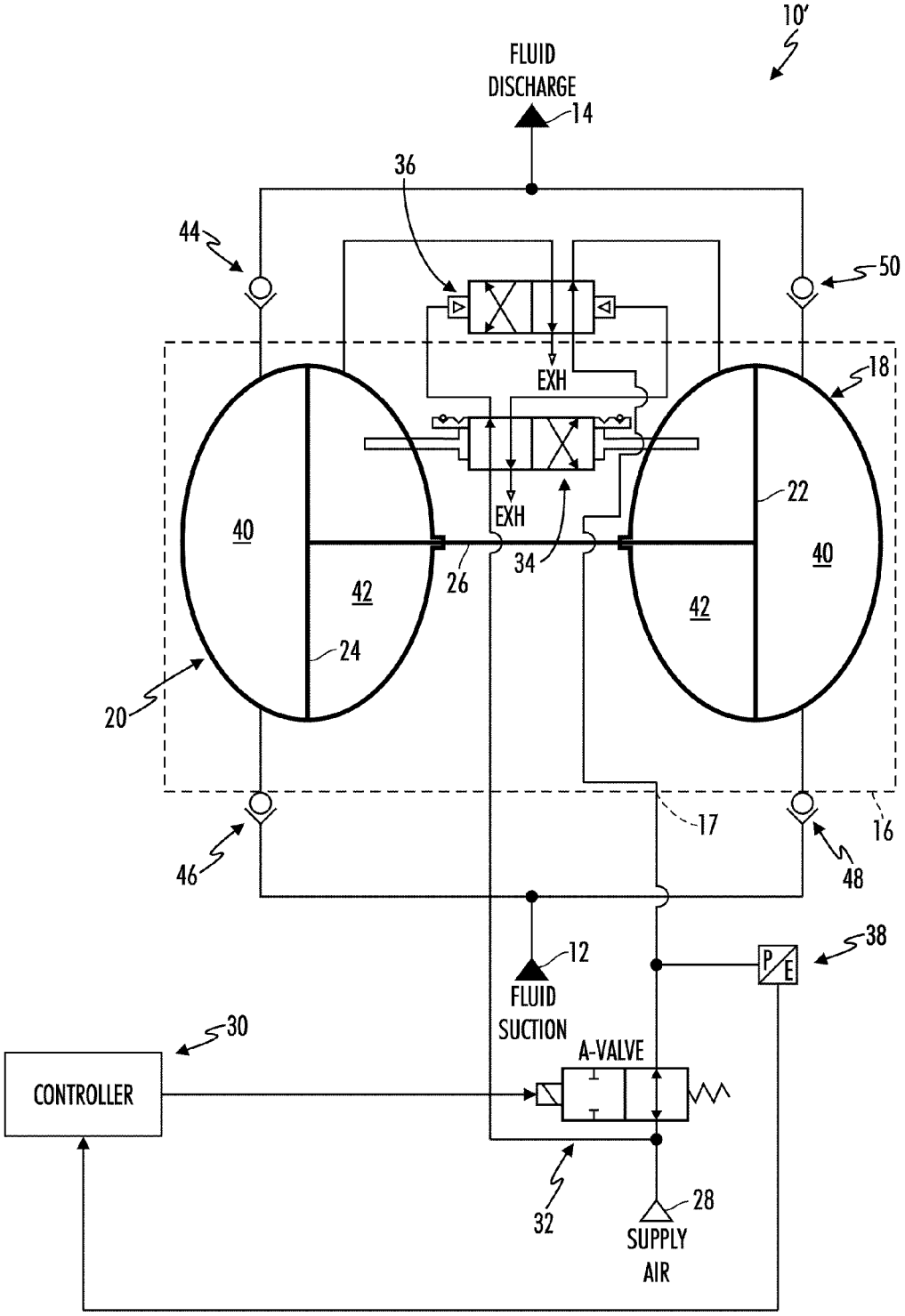
FIG. 7 is a view similar to FIG. 3 showing an alternative embodiment AOD pump.

Another alternative embodiment AOD pump 10' is shown in FIG. 7. AOD pump 10' is substantially similar to AOD pump 10. Pilot valve 34 is connected to air supply 28 upstream of control valve 32. When pilot valve 34 switches positions, it provides air to main valve 36 at the supply pressure provided by air supply 28. This increases the switching speed and reliability of main valve 36. Thus, $t_{mv}$ for pump 10' will be less than $t_{mv}$ for pump 10.

Figure 8:
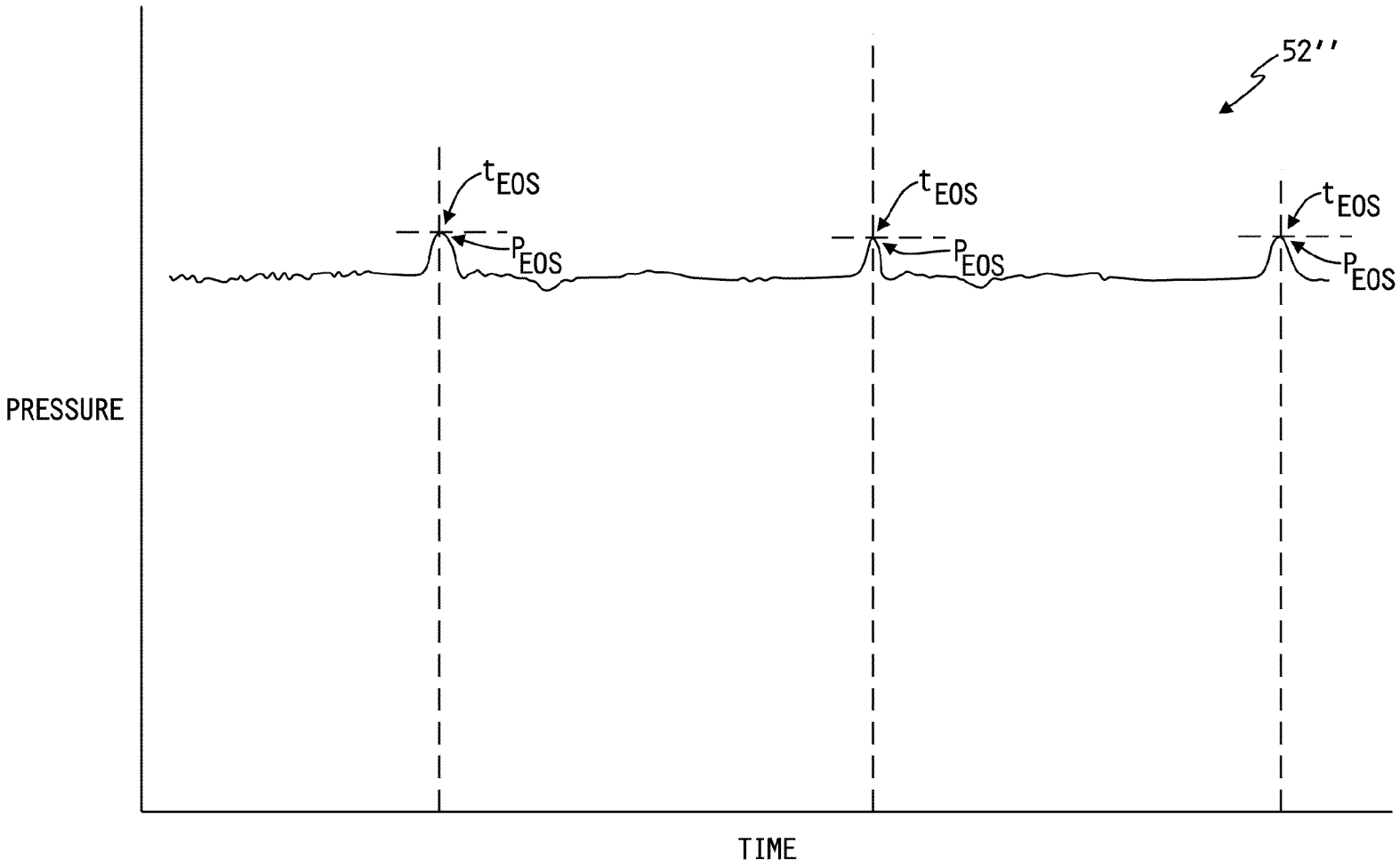
FIG. 8 is a graph of a pressure sensed by the pressure sensor during operation of the AOD pump when the control valve remains open or is not provided according to another embodiment of the present disclosure.

According to an alternative embodiment of the present disclosure, supply valve 32 remains open during cycling of pump 10 rather than opening just for short bursts or no supply valve 32 is provided. As shown in FIG. 8, a pressure curve 52" for this embodiment is substantially flat with a peak occurring at regular intervals at $t_{EOS}$ for first and second diaphragms 18, 20. As described above, the interval between peaks is used to determine the cycle time and pump operating speed. The peak pressure ($P_{EOS}$) may be used to determine the supply pressure. Using the cycle time and supply pressure (based on the peak pressure or provided otherwise), controller 30 can calculate the operational parameters of AOD pump 10 as described above. To enhance the pressure signal sensed by pressure sensor 38, a restriction, such as an orifice, may be provided between supply valve 32 and pressure sensor 38 or between air supply 28 and pressure sensor 38 if no supply valve 32 is provided. Because of the restriction provided by the orifice, air supply 28 provides less damping of the pressure signal sensed at by pressure sensor 38. If no orifice or other restriction is provided, inherent flow restrictions also dampen the influence of air supply 28 enough to also allow detection of the peaks that indicate EOS.

Figure 9:
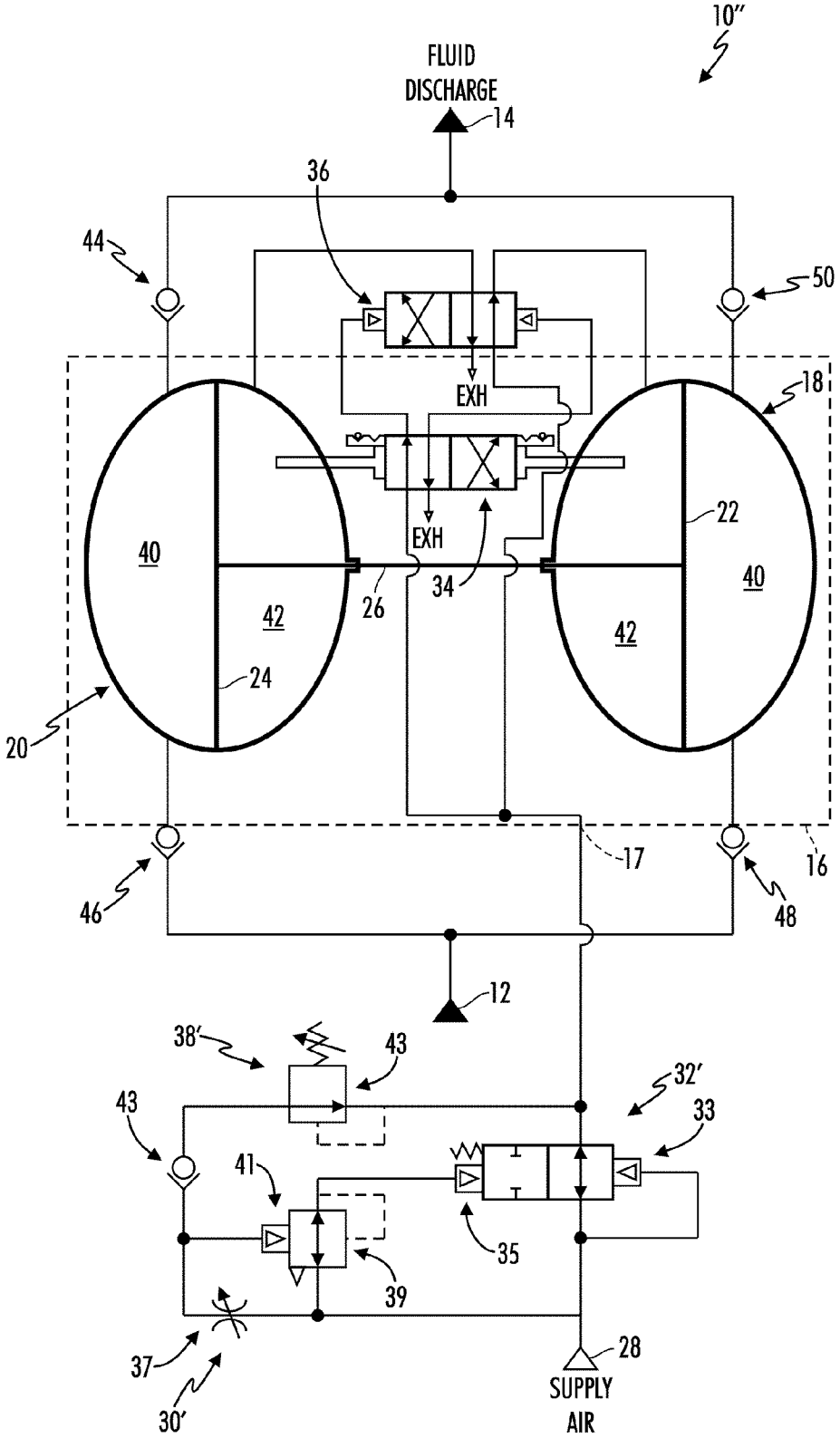
FIG. 9 is a view similar to FIG. 3 showing an alternative embodiment AOD pump showing a mechanical controller coupled to a pilot operated control valve positioned downstream of the air supply and upstream of the pump.

Another exemplary embodiment pump 10" is shown in FIG. 9 that using a mechanical controller 30' and mechanical sensor 38' to open and close an air piloted supply valve 32'. Air supply 28 provides pressurized air to supply valve 32' and mechanical controller 30'. When supply valve 32' is open, air supply 28 provides pressurized air to pump 10" to shift first or second diaphragms 22, 24 left or right, respectively. Initially, the air pressure provided to a first port 33 of supply valve 32' is significantly larger than the air pressure provided to a second port 35 of supply valve 32' so that supply valve 32' remains open for a period of time. Controller 30' includes a restriction, such as an adjustable needle valve 37, and a pilot operated pressure regulator 39. Because of the restriction provided by needle valve 37, the initial pressure to a port 41 of pressure regulator 39 is less than the pressure provided by air supply 28 because of the initial pressure drop across needle valve 37. An optional check valve 43 helps block pressurized air that has already passed through supply valve 32' from flowing to port 41.

The lesser pressure provided to port 41 results in lesser pressure passing through pressure regulator 39 to second port 35 so that supply valve 32' remains open. Eventually, the air pressure at port 41 builds by air bleeding past needle valve 37. The pressure at port 41 reaches a high enough level that pressure regulator 39 allows pressurized air from air supply 28 to reach second port 35 and shifts supply valve 32' to the closed position. When in the closed position, supply valve 32' completely or partially blocks the flow of air from air supply 28 to pump 10" and the respective chambers 18, 20.

Figure 10:
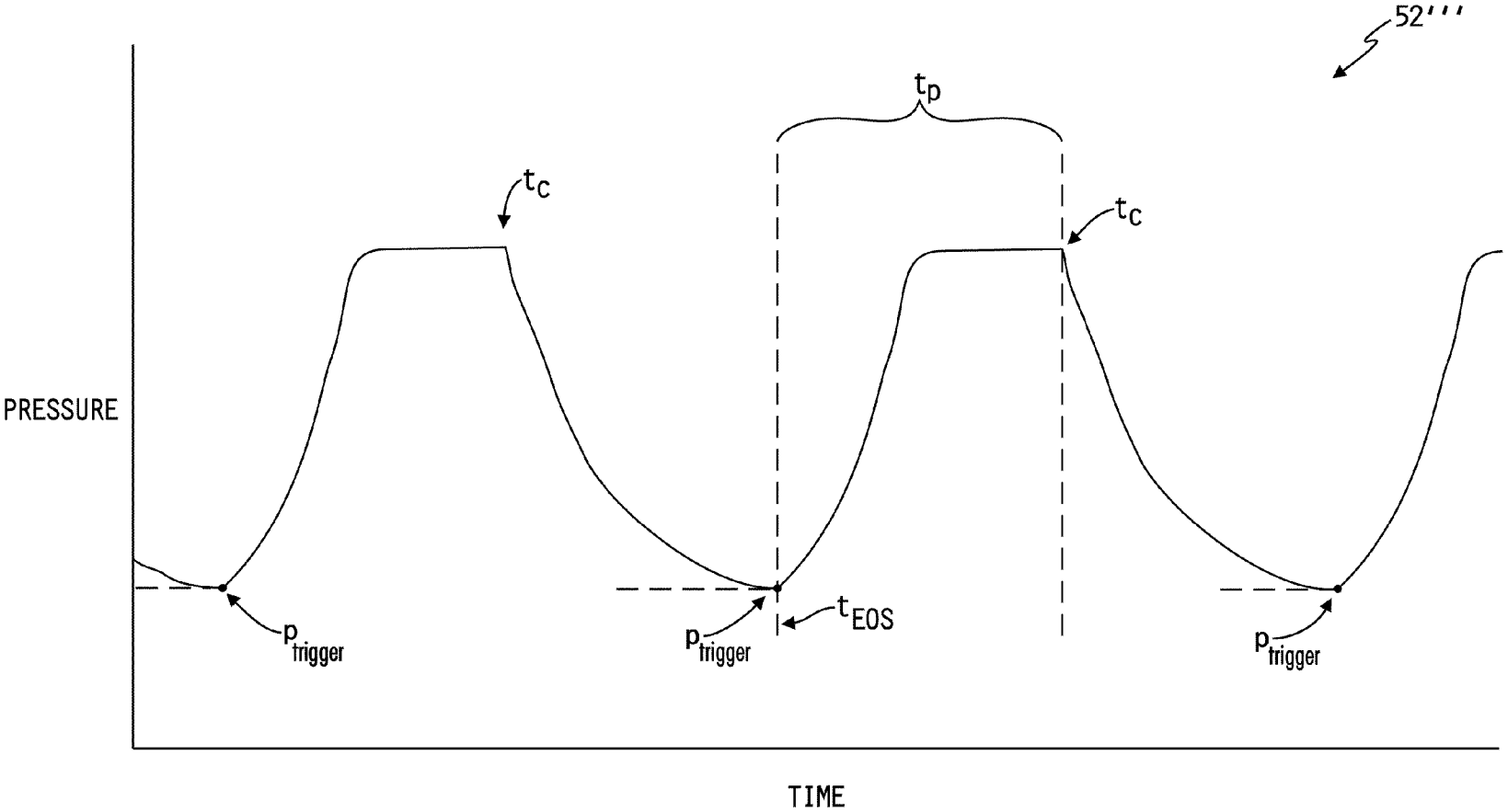
FIG. 10 is a graph of a pressure sensed by the mechanical controller during operation of the AOD pump when the control valve remain open for only a portion of the operating cycle.

As the respective diaphragm 22, 24 continues to shift after supply valve 32' closes, the pressure downstream of supply valve 32' gradually decreases as shown in pressure curve 52'" after $t_c$ in FIG. 10. Mechanical pressure sensor 38' is preferably an adjustable pressure regulator 43 as shown in FIG. 9. When the pressure downstream of pressure sensor 38' reaches a predetermined point, as shown at $P_{trigger}$ in FIG. 10, pressure regulator 43 opens and relieves the upstream pressure at port 41 of pressure regulator 39. Because the pressure at port 41 is now below a predetermined minimum, the pressure at second port 35 is less than the pressure provided at first port 33 and supply valve 32' opens again.

Pressure regulator 43 can be adjusted to select $p_{trigger}$ that corresponds to the respective diaphragm 22, 24 approaching or reaching its end-of-stroke position at $t_{EOS}$. Pressure regulator 43 can be adjusted so that pump 10" is operating at peak efficiency or at a desired pump speed. According to alternative embodiments, pressure regulator 43 is not adjustable. Additionally, needle valve 37 can be adjusted to change $t_p$ (the amount of time supply valve 32' is open). The greater the restriction provided by needle valve 37, the longer supply valve 32' remains open. According to alternative embodiments, the restriction is not adjustable.

Figure 11:
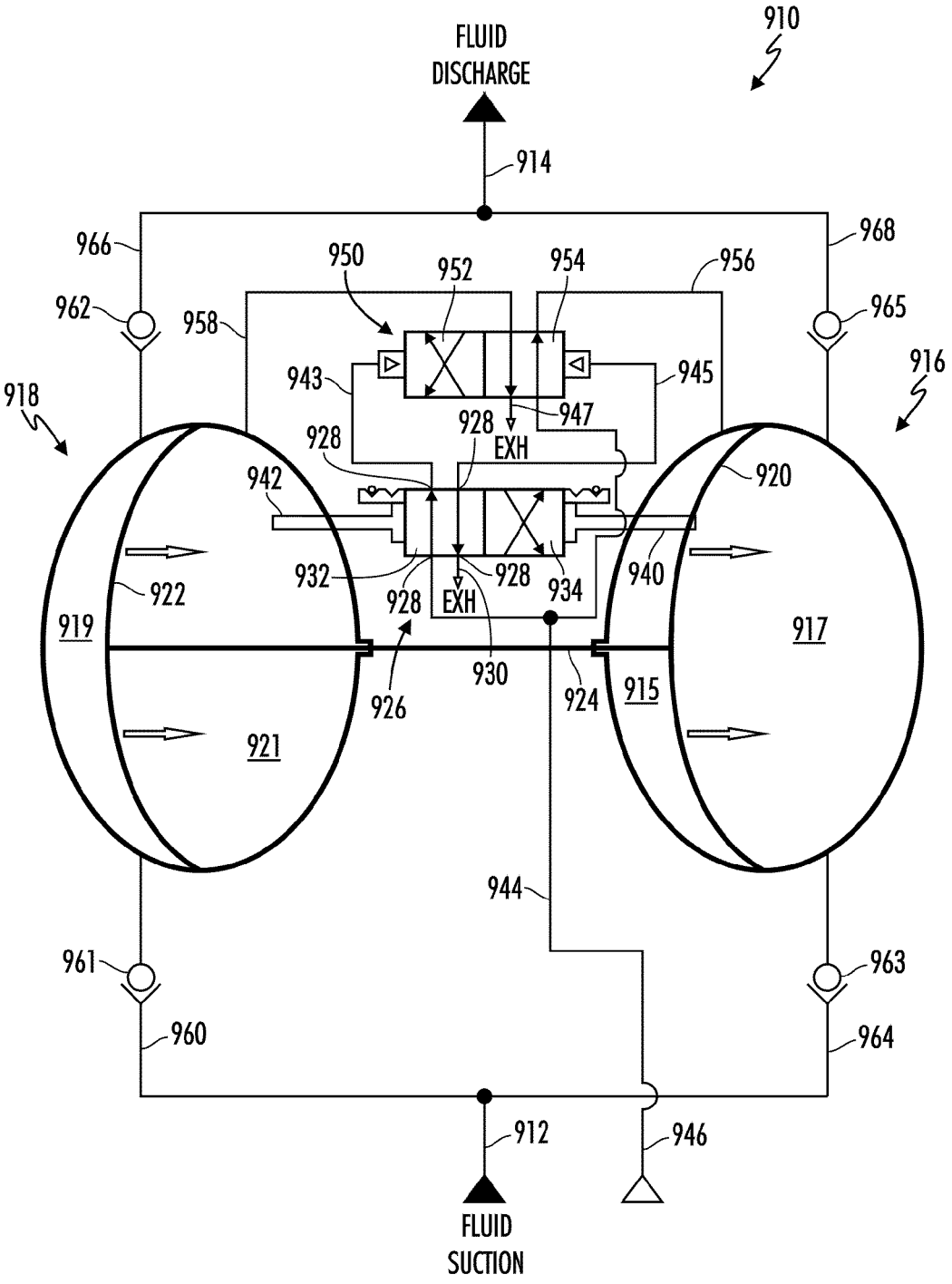
FIG. 11 is a schematic illustrating one embodiment of another alternative embodiment AOD pump.
Figure 12:
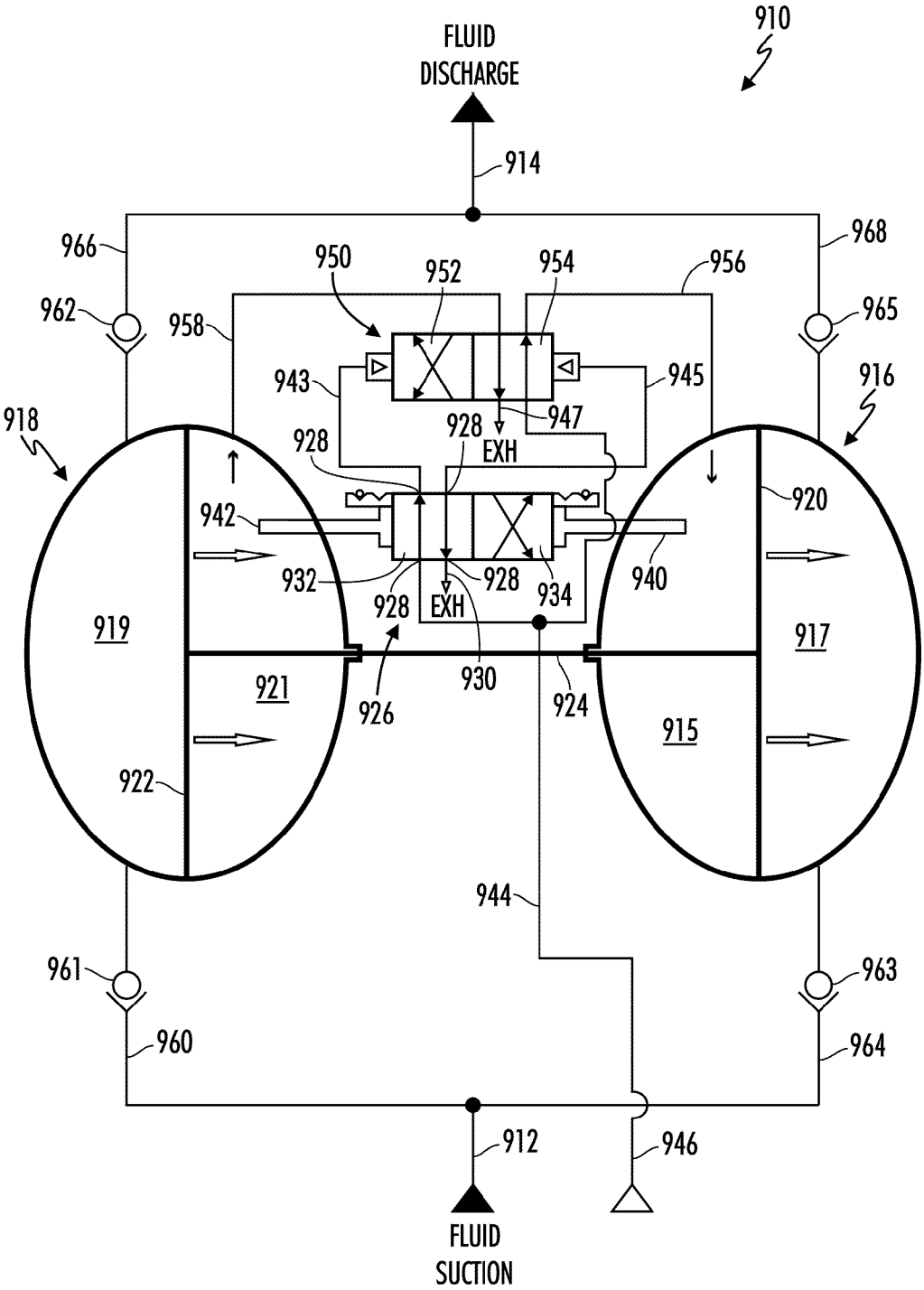
FIG. 12 is a schematic illustrating the AOD pump shown in FIG. 11.

A pump schematic for an AOD pump is shown in FIGS. 11 and 12. AOD pump 910 includes a pair typically, but could be one or more diaphragm chambers 916 and 918, a pilot valve 926, a directional valve 950, and piping configured to allow the pump to operate. In operation, AOD pump 910 develops fluid suction in line 912 to receive fluid and discharges fluid from line 914. In FIG. 11, diaphragms 920 and 922 are in the end-of-stroke left configuration, which is defined as the left-most position of the diaphragms, and are beginning to move towards the right side of diaphragm chambers 916 and 918 to an end-of-stroke right position, shown in FIG. 13. In FIG. 12, diaphragm 920 and 922 are moving rightward towards the end-of-stroke right position.

Diaphragm 922 of diaphragm chamber 918 and diaphragm 920 of diaphragm chamber 916 are connected by rod 924, which rigidly connects the diaphragms together. In the end-of-stroke left condition, as shown in FIG. 11, diaphragm 920 has just contacted control rod 940 which moves porting configuration 934 into the active position of pilot valve 926. Porting configuration 934 is locked in this end-of-stroke left condition until diaphragm 922 contacts control rod 942 and moves and locks porting configuration 932 in the active position of pilot valve 926 (the end-of-stroke right condition) as shown in FIG. 13.

In the end-of-stroke left configuration, as shown in FIG. 11, pilot valve 926, which is a two-position, four port valve has porting configuration 934 in the active position. In FIG. 11, diaphragm 920 contacts control rod 940 which actuates pilot valve 926 to change porting configurations. Pilot valve 926 includes four ports 928, which are connected to lines 943, 944, 945 and exhaust port 930. In this configuration, air supplied from line 944 is supplied to line 945 and air in line 943 is exhausted to exhaust port 930. The air supplied to line 945 is used to position porting configuration 954 of directional valve 950 in the active position. Directional valve 950 is a four-port, two-position valve. In this configuration, air from line 958 from right side 921 of diaphragm chamber 918 is exhausted to the atmosphere through exhaust port 947. Air from air supply line 944 is supplied to line 956, which inputs air into left side 915 of diaphragm chamber 916. The air input into left side 915 of diaphragm chamber 916 increases in pressure until diaphragm 920 begin moving rightward as shown in FIG. 12. Simultaneously, diaphragm 922 is pulled to the right side 921 of diaphragm chamber 918 by rod 924 and air is forced out of right side 921 of diaphragm chamber 918 through line 958 and exhausted to the atmosphere through port 947 of directional valve 950.

As diaphragms 920 and 922 begin moving toward the right side of diaphragm chambers 916 and 918 from the end-of-stroke left positions, fluid suction or a vacuum is applied to line 912 through line 960 and left side 919 of diaphragm chamber 918 begins filling with fluid. Line 964 has a check valve or one way valve 962 that prevents fluid in line 964 from being pulled back into left side 919 of diaphragm chamber 918 as diaphragm 922 moves rightward. At the same time, diaphragm 920 is moving toward the right side of diaphragm chamber 916 and forcing fluid out of right side 917 of diaphragm chamber 916 through line 968 to fluid discharge line 914. Check valve 963 in line 964 prevents fluid from flowing back into line 912 when diaphragm 920 moves rightward.

Figure 13:
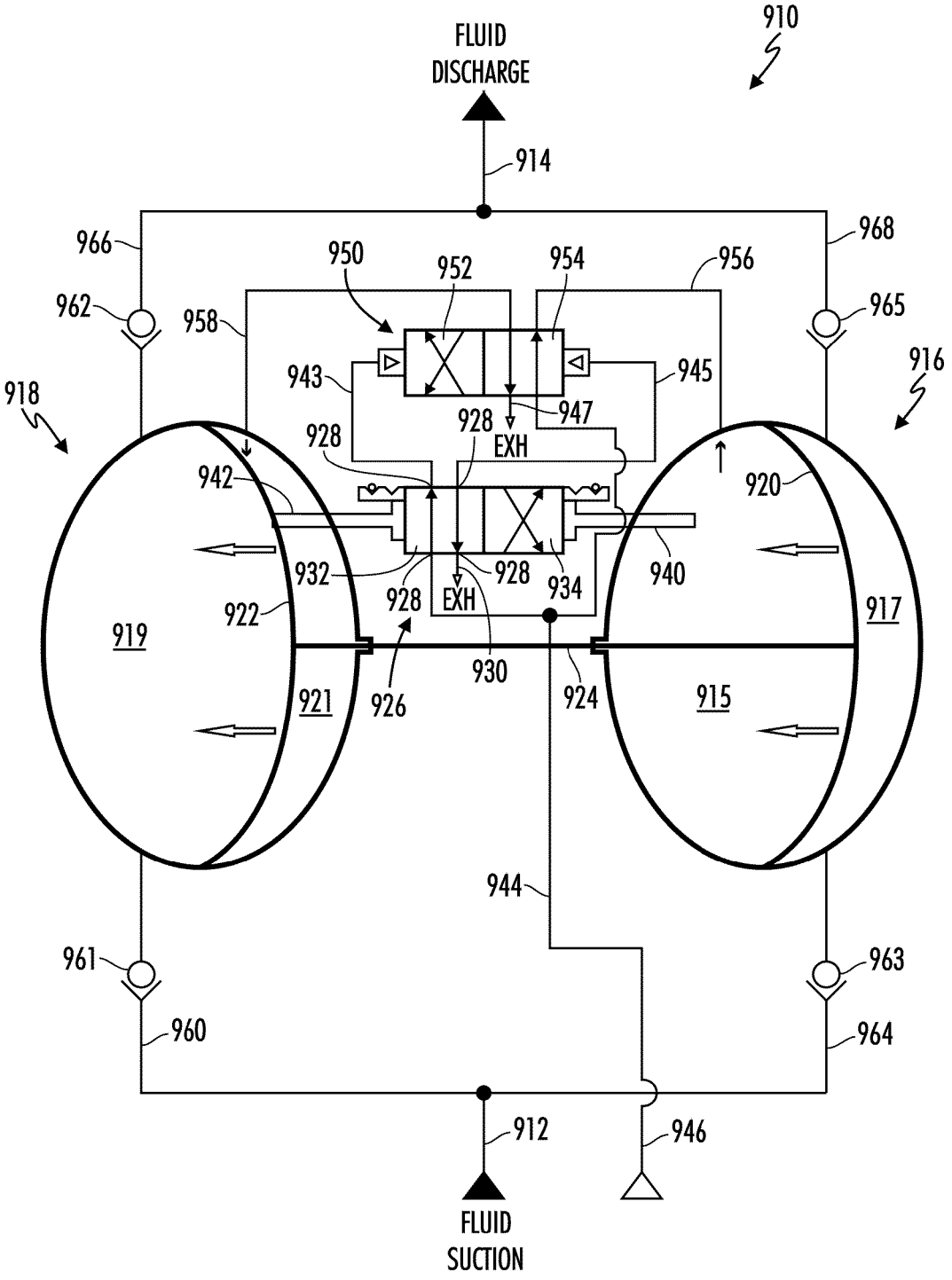
FIG. 13 is a schematic illustrating the AOD pump shown in FIG. 11.

Referring now to FIG. 13, the air supplied by line 956 has forced diaphragm 920 to the rightmost position, which simultaneously positions diaphragm 922 in the right most position due to rod 924 connecting the diaphragms 920 and 922. The diaphragms are now in the end-of-stroke right position. In the end-of-stroke right position diaphragm 922 contacts control rod 942 which actuates pilot valve 926 to change from porting configuration 934 to porting configuration 932. Porting configuration 932 connects air supply line 944 with line 943 and exhausts line 945 through line 930 in the pilot valve, which actuates directional valve 950 to change from porting configuration 954 to porting configuration 952. With valve 950 in this configuration, air from air supply 946 is carried through line 944 to line 958 and used to pressurize right side 921 of diaphragm chamber 918. At the same time, when directional valve 950 has porting configuration 952 in the active position, air from left side chamber 915 of diaphragm chamber 916 is exhausted through line 956 to exhaust port 947 through directional valve 950.

As diaphragms 920 and 922 begin moving leftward from the end-of-stroke right positions in diaphragm chamber 916 and 918, fluid suction is applied to line 912 through line 964 and right side 917 of diaphragm chamber 916 begins filling with fluid. Line 968 has a check valve 965 that prevents fluid in line 968 from being pulled back into right side 917 of diaphragm chamber 916 as diaphragm 920 moves leftward. At the same time, diaphragm 922 is moving toward the left side of diaphragm chamber 918 and forcing fluid out of left side 919 of diaphragm chamber 918 through line 964 to fluid discharge line 914. Check valve 961 in line 960 prevents fluid from flowing back into line 960 when diaphragm 922 moves leftward.

Air is supplied to right side 921 of diaphragm chamber 918 until diaphragm 920 in diaphragm chamber 916 contacts control rod 940 of pilot valve 926. When diaphragm 920 contacts control rod 940 indicating end-of-stroke left, the porting configuration of pilot valve 926 is changed from porting configuration 932 to porting configuration 934 as shown in FIG. 11. When pilot valve 926 has porting configuration 934 in the active position, directional valve 950 is changed from porting condition 952 to porting configuration 954 as shown in FIG. 11. Pump 910 operates continuously with only pressurized air supplied as described above. In alternative embodiments, AOD pump 910 may include alternative valve configurations. Pilot valve 926 could be replaced by position sensors in alternative embodiments.

Figure 14:
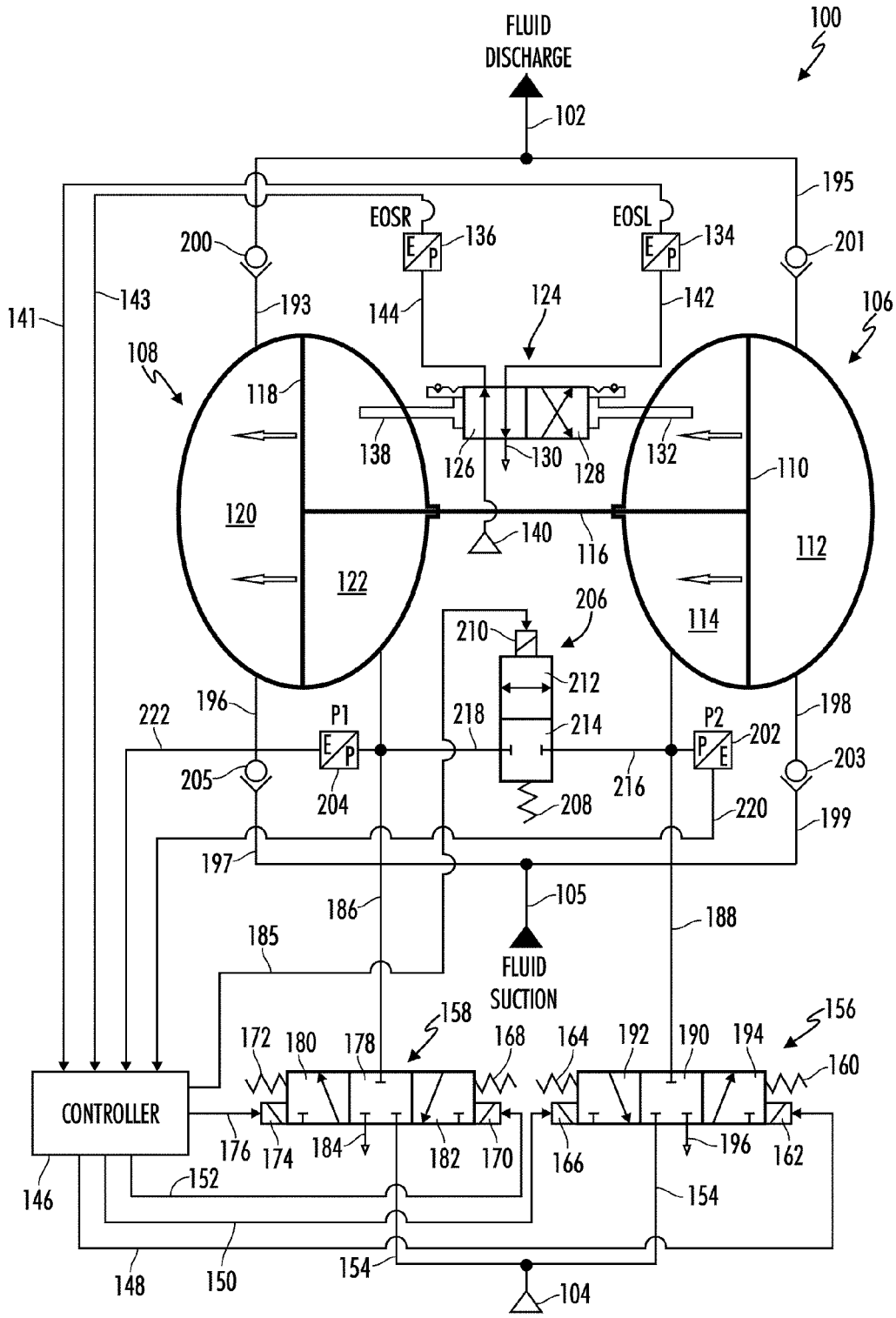
FIG. 14. is a schematic illustrating another embodiment of a AOD pump.

One embodiment of a method and apparatus of the present invention is shown in FIGS. 14-18. AOD pump 100 includes diaphragm chambers 106 and 108, pilot valve 124, controller 146 and valves 158, 156, and 206. AOD pump 100 produces suction at line 105 to receive fluid and outputs fluid at line 102. AOD pump 100 operates in a similar fashion to AOD pump 910 shown in FIGS. 11 and 12 with several exceptions. Directional valve 950 of AOD pump 910 has been replaced with valves 156, 158, and 206. Pilot valve 124 performs a function similar to pilot valve 926 of AOD pump 910. Instead of driving a directional valve, pilot valve 124 keys sensors 134 and 136 which output a signal indicative of the end-of-stroke left or end-of-stroke right conditions similar to pilot valve 926 in AOD pump 910. In FIG. 14, diaphragms 110 and 118 have recently been in the end-of-stroke right position and are moving leftward. Pilot valve 124 is still in the end-of-stroke right position and porting configuration 126 is in the active position. In the end-of-stroke right position, diaphragm 118 has contacted control rod 138 to actuate pilot valve 124 to move porting configuration 126 to the active position. Porting configuration 126 allows compressed air from air supply 140 to pass to line 144 to sensor 136. Sensor 136 outputs an electrical signal through line 143 to controller 146 indicating that pump 100 is in the end-of-stroke right configuration. Also in porting configuration 126, air in line 142 is vented to the atmosphere via exhaust port 130. Controller 146 receives end-of-stroke left and end-of-stroke right signals from sensors 134 and 136 during operation of pump 100.

Controller 146 also receives input from sensors 204 and 202 which indicate the air pressure in the pressurized right side 122 and pressurized left side 114 of diaphragm chambers 108 and 106. Controller 146 outputs signals through lines 148, 150, 152, 176, and 185 to control valves 156, 158, and 206. Valves 156 and 158 are conventional three port, three position, spring-centered valves with solenoid operators to achieve left and right positions for each valve. In alternative embodiments, five port, three position valves could also be used. The three ports of valve 156 include exhaust port 196, line 188, and air supply line 154. The three ports of valve 158 included exhaust port 184, line 186, and air supply line 154.

In the centered or default position, valve 156 has porting configuration 190 in the active position. Springs 160 and 164 maintain porting configuration 190 in the active position until either solenoid 162 or 166 is powered. When power is applied to solenoid 162, the force of springs 160 and 164 is overcome and porting configuration 194 is moved to the active position. Similarly, if solenoid 166 is powered, porting configuration 192 is moved to the active position. Porting configuration 194 connects air supply line 154 with line 188 which connects to left side 114 of diaphragm chamber 106. Porting configuration 192 connects line 188 with exhaust port 196 to exhaust any air present in line 188 to the atmosphere. Porting configuration 190, which is the default configuration, leaves all ports closed.

Similarly, in the centered position, valve 158 has porting configuration 178 in the active position. Springs 168 and 172 maintain porting configuration 178 in the active position until either solenoid 170 or 174 is powered. When power is applied to solenoid 170, the force of springs 172 and 168 is overcome and porting configuration 182 is moved to the active position. Similarly, if solenoid 174 is powered, porting configuration 180 is moved to the active position. Porting configuration 180 connects air supply line 154 with line 186 which connects to right side 122 of diaphragm chamber 108. Porting configuration 182 connects line 186 with exhaust port 184 to exhaust any air present in line 186 to the atmosphere. Porting configuration 178, which is the default configuration, leaves all ports closed.

Valve 206 is a two port, two position solenoid valve with spring return. In the default position, spring 208 maintains porting configuration 214 in the active position. When solenoid 210 is powered, the force of spring 208 is overcome and porting configuration 212 is moved to the active position. Porting configuration 212 connections lines 216 and 218. Porting configuration 214 leaves lines 216 and 218 closed.

Figure 18:
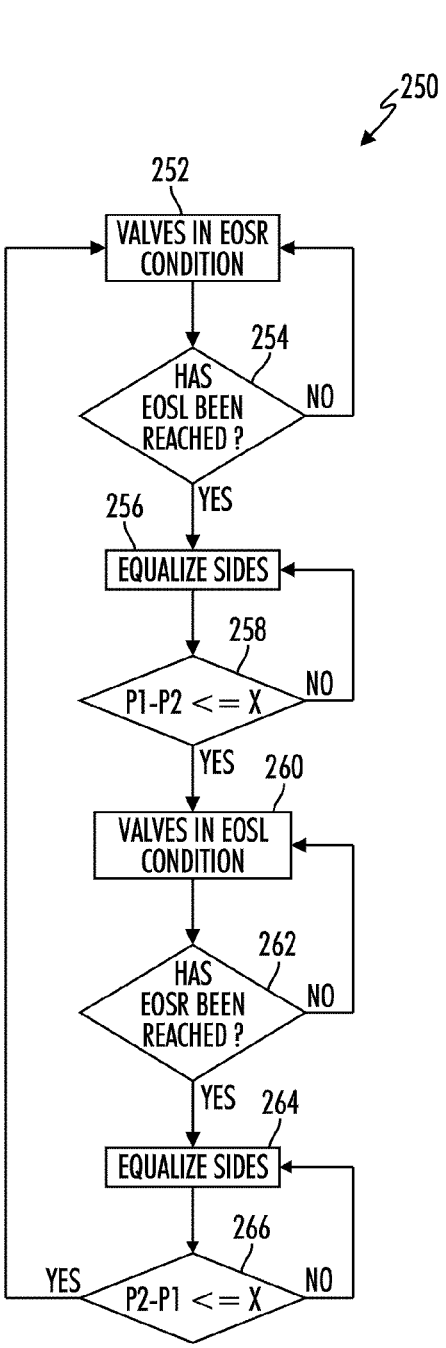
FIG. 18 is a flowchart and a logic table describing a method of operating the AOD pump shown in FIGS. 14-17.

FIG. 18 includes a flowchart 250 and a corresponding table 251 that illustrate a method of operating pump 100. When the diaphragms 110 and 118 are moving leftward and the valves are in the end-of-stroke right (EOSR) position as shown in FIG. 14, solenoids 174 and 166 are energized by controller 146 as shown by step 252. When solenoids 174 and 166 are energized, valve 158 has porting configuration 180 in the active position and valve 156 has porting configuration 192 in the active position. During this step, compressed air from air supply 104 is delivered to right side 122 of diaphragm chamber 108 through line 154, valve 158, and line 186. Increasing air pressure in right side 122 of diaphragm chamber 108 forces diaphragm 118 leftward. As diaphragm 118 moves leftward, connecting rod 116 pulls diaphragm 110 leftward in diaphragm chamber 106. Moving diaphragm 118 leftward forces fluid in left side 120 of diaphragm chamber 108 through line 193 and check valve 200 to fluid discharge line 102. Check valve 205 in line 196 is similar to check valve 961 in FIG. 11 in that it prevents fluid in left side 120 from being pushed back into line 196 during leftward movement of diaphragm 118. At the same time, moving diaphragm 110 leftward applies fluid suction to line 198, which in turn pulls fluid through check valve 203 and line 199 from fluid source 105 filling right side chamber 112 of diaphragm chamber 106. Check valve 201 in line 195 is similar to check valve 965 in FIG. 11 in that it prevents fluid in line 195 from being pulled back into right side 112 of diaphragm chamber 106 during leftward movement of diaphragm 110.

In step 254, diaphragm 110 contacts control rod 132 of pilot valve 124 indicating that the pump has reached end-of-stroke left condition (EOSL). Control rod 132 moves porting configuration 128 into the active position of pilot valve 124. In porting configuration 128, air from line 144 is exhausted to exhaust port 130 and air from air supply 140 is supplied to line 142. Air in line 142 causes sensor 134 to generate an end-of-stroke left signal which is carried through line 141 to controller 146. When an end-of-stroke left condition is detected the method moves forward to step 256.

Figure 15:
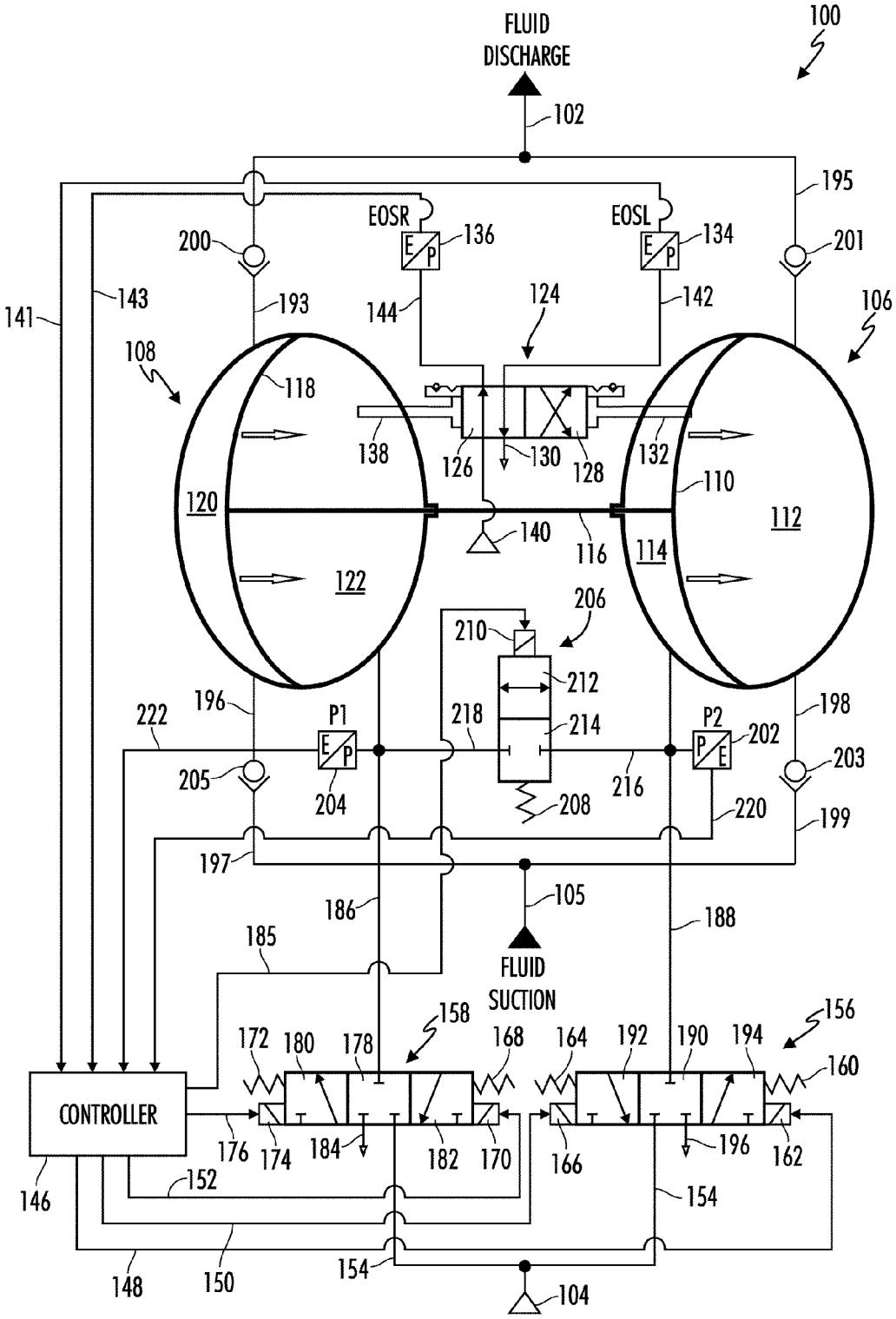
FIG. 15 is a schematic illustrating the AOD pump shown in FIG. 14.

Referring now to FIG. 15, in step 256, solenoids 174 and 166 are deactivated or turned off which causes porting configuration 178 in valve 158 and porting configuration 190 in valve 156 to be moved to the active position in the respective valves. Also, in step 256, solenoid 210 is energized to move porting configuration 212 to the active position of valve 206. Porting configuration 212 connected lines 216 and 218. During step 256, air present in right side 122 of diaphragm chamber 108 is transported through lines 186, 218, valve 206, line 216, and line 188 to left side 114 or diaphragm chamber 106. The air pressure P1 in right side 122 and the air pressure P2 in left side 114 begin to equalize as sensors 204 and 202 monitor the pressure change in right side 122 and left side 114. In step 258, the measured pressure P1 in right side 122 of diaphragm chamber 108 is compared to the measured pressure P2 of left side 114 of diaphragm chamber 106. When the difference between P1 and P2 is less than or equal to a user selectable pressure X, the method continues forward to step 260. In alternative embodiments the function of sensors 202 and 204 can be performed by a single differential pressure sensor.

Figure 16:
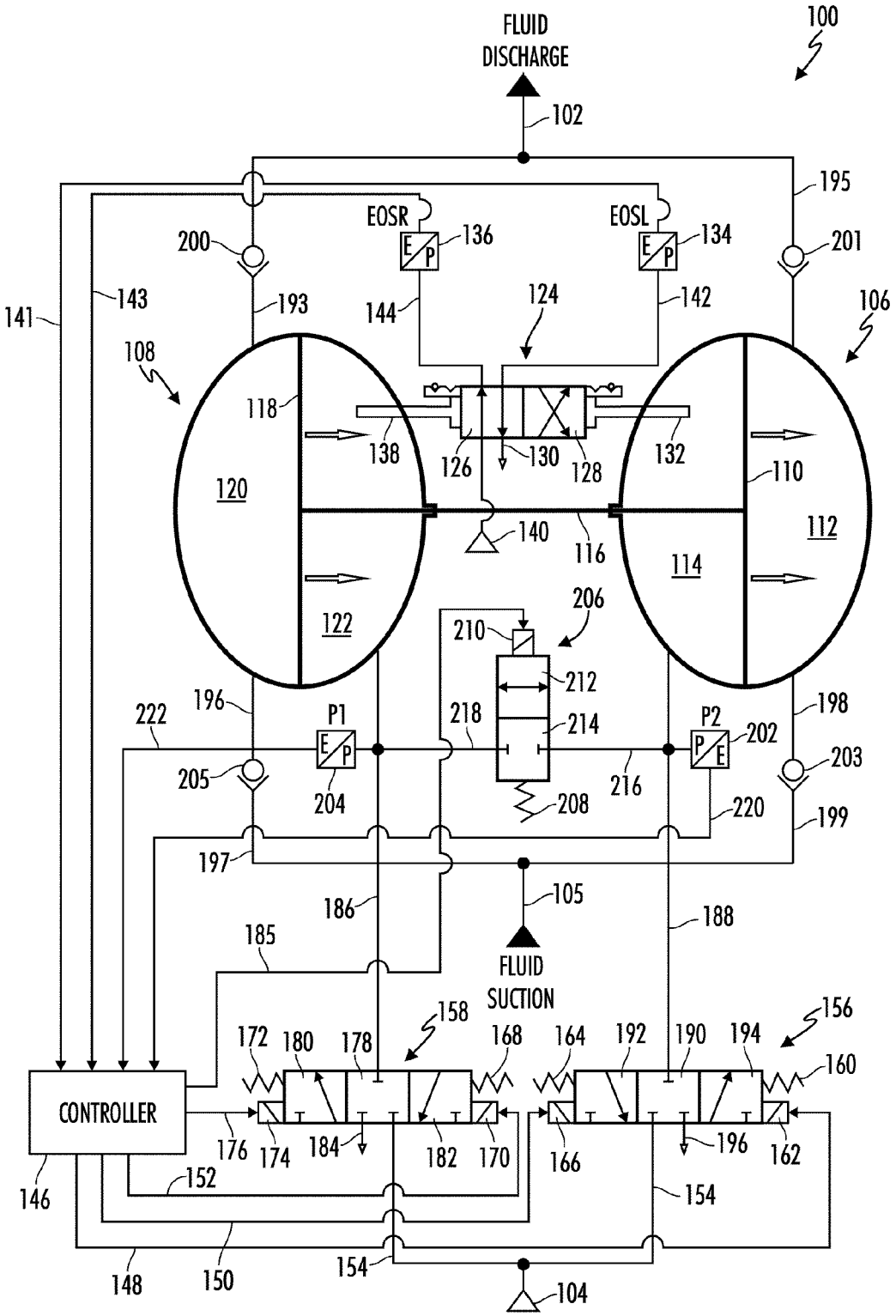
FIG. 16 is a schematic illustrating the AOD pump shown in FIG. 14.

Referring now to FIGS. 16 and 18, solenoids 170 and 162 are energized and all other solenoids are deactivated. Porting configuration 182 is moved to the active position in valve 158 and porting configuration 194 is moved to the active position in valve 156. When solenoid 210 is deactivated in valve 206, spring 208 moves porting configuration 214 into the active position in which lines 216 and 218 are closed. In this condition the valves are in an end-of-stroke left configuration in which compressed air from air supply 104 is transported from supply line 154 through valve 156 to line 188 to left side 114 of diaphragm chamber 106. At the same time any remaining air in right side 122 of diaphragm chamber 108 is exhausted through line 186 and valve 158 to exhaust port 184. As the increase in air pressure moves diaphragm 110 rightward in diaphragm chamber 106, fluid present in right side 112 is forced out of diaphragm chamber 106 through line 195 and check valve 201 to fluid discharge line 102. Check valve 203 in line 198 is similar to check valve 963 in FIG. 11 in that it prevents fluid in right side 112 from being pushed back into line 199 during rightward movement of diaphragm 110. At the same, rod 116 pulls diaphragm 118 rightward which creates a vacuum in left side 120 of diaphragm chamber 108. Fluid is received in left side 120 from fluid supply line 105 and line 197. Check valve 200 in line 193 is similar to check valve 962 in FIG. 11 in that it prevents fluid in line 193 from being pulled back into left side 120 during rightward movement of diaphragm 118.

Figure 17:
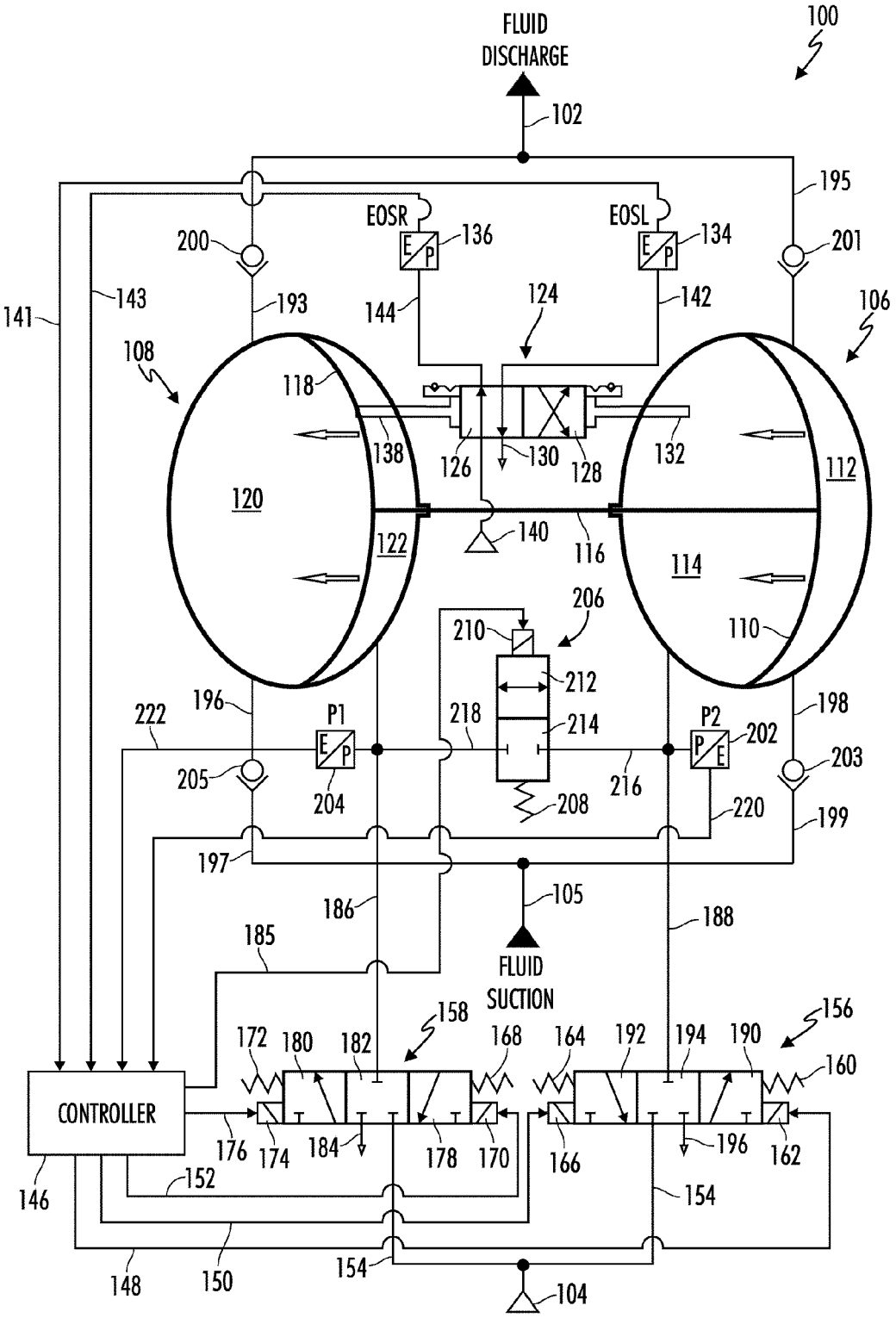
FIG. 17 is a schematic illustrating the AOD pump shown in FIG. 14.

When diaphragms 118 and 110 reach the end-of-stroke right position in step 262, as shown in FIG. 17 the method advances to step 264. In step 264, the pressure in right side 122 and left side 114 of the respective chambers is equalized and all solenoids except solenoid 210 are deactivated. Solenoid 210 is energized to move porting configuration 212 to the active position of valve 206. Compressed air from left side 114 of diaphragm chamber 106 is transported through lines 188 and 216, valve 206, and lines 218 and 186 to right side 122 of diaphragm chamber 108 until the difference in pressures P1 and P2 is less than or equal to the user specified pressure X as shown in step 266. When the pressure differential is less than or equal to pressure X, the method returns to step 252 and repeats.

Figure 19:
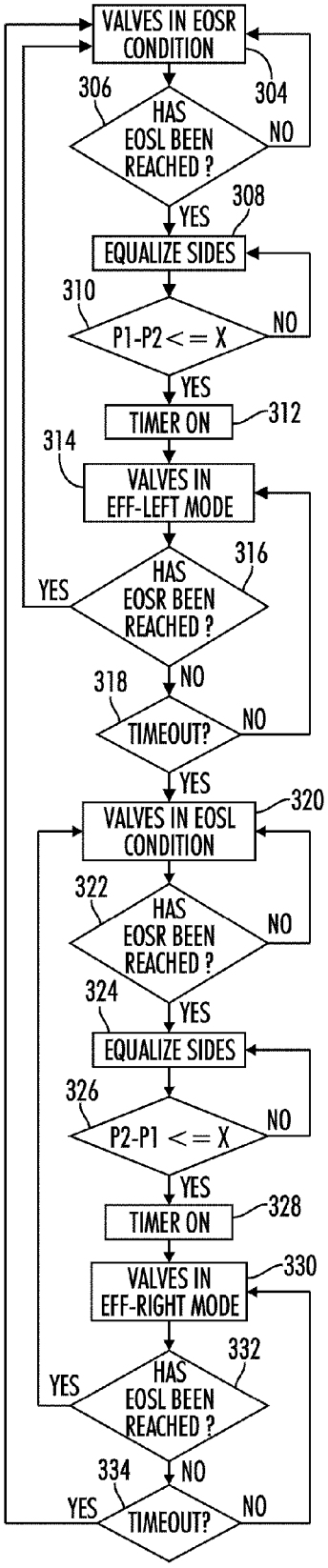
FIG. 19 is a flowchart and a logic table describing a method of operating the AOD pump shown in FIGS. 20-24.
Figure 20:
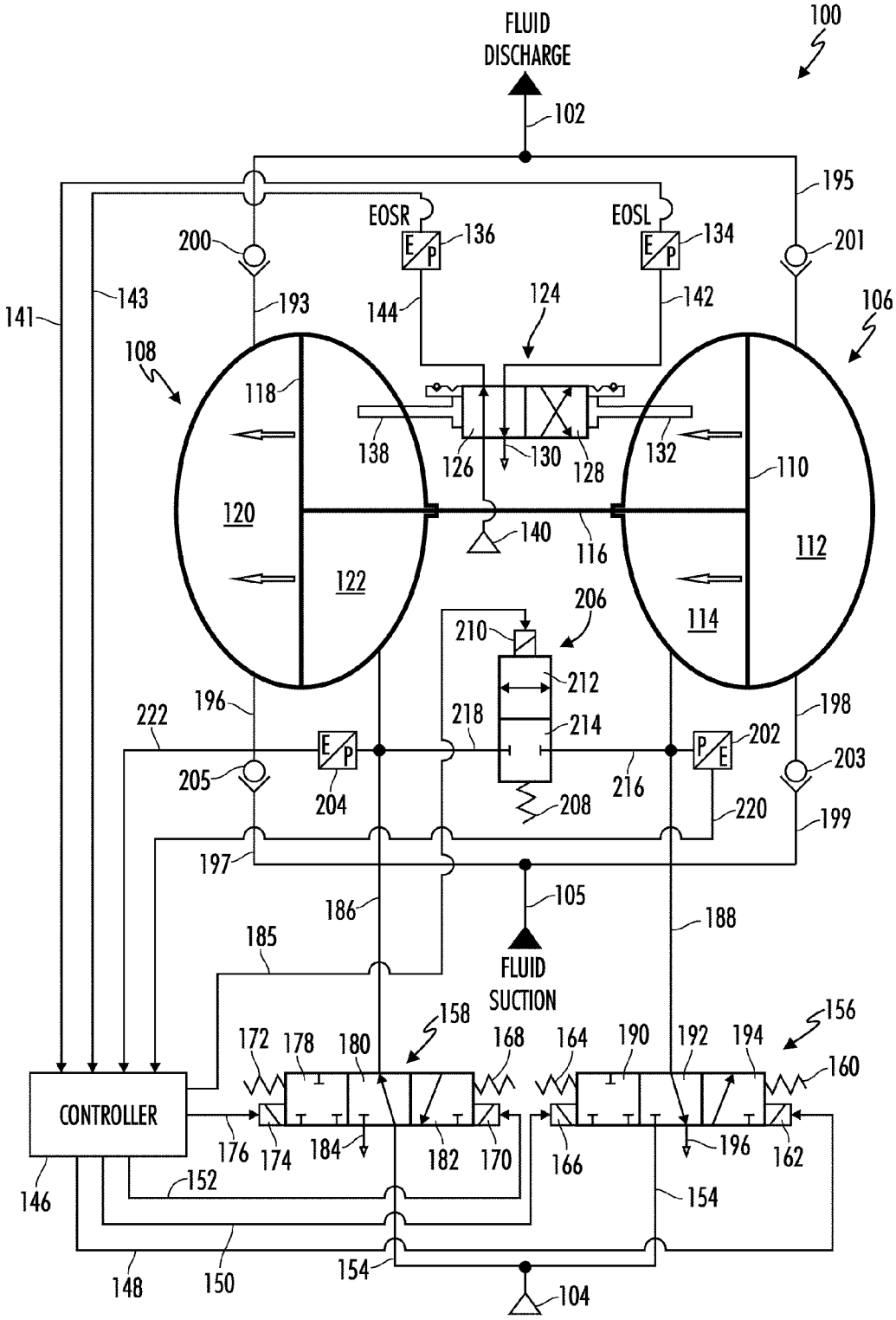
FIG. 20. is a schematic illustrating another embodiment of a AOD pump.

Another method of operating AOD pump 100 is shown in FIGS. 19-24. FIG. 19 includes a flowchart 300 and a corresponding table 302 illustrating solenoid status during the steps of the method. In step 304, the valves are locked in the end-of-stroke right condition and the diaphragms 118 and 110 are moving leftward as shown in FIG. 20. As shown in table 302, solenoids 174 and 166 are energized to position porting configurations 180 and 192 in the active positions in valves 158 and 156. Compressed air is being supplied to right side 122 of diaphragm chamber 108 and air in left side chamber 114 of diaphragm chamber 106 is being exhausted through exhaust port 196. Fluid present in left side 120 of diaphragm chamber 108 is pushed through line 193 and check valve 200 to fluid discharge line 102. Check valve 205 in line 197 prevents fluid from flow from left side 120 back into line 196 during leftward movement of diaphragm 118. At the same time, fluid is pulled from fluid suction line 105, line 199, check valve 203, and line 198 into right side 112 of diaphragm chamber 106 during leftward movement of diaphragm 110. Check valve 201 prevent fluid in line 195 from being pulled back into right side 112 during leftward movement of diaphragm 110.

Figure 21:
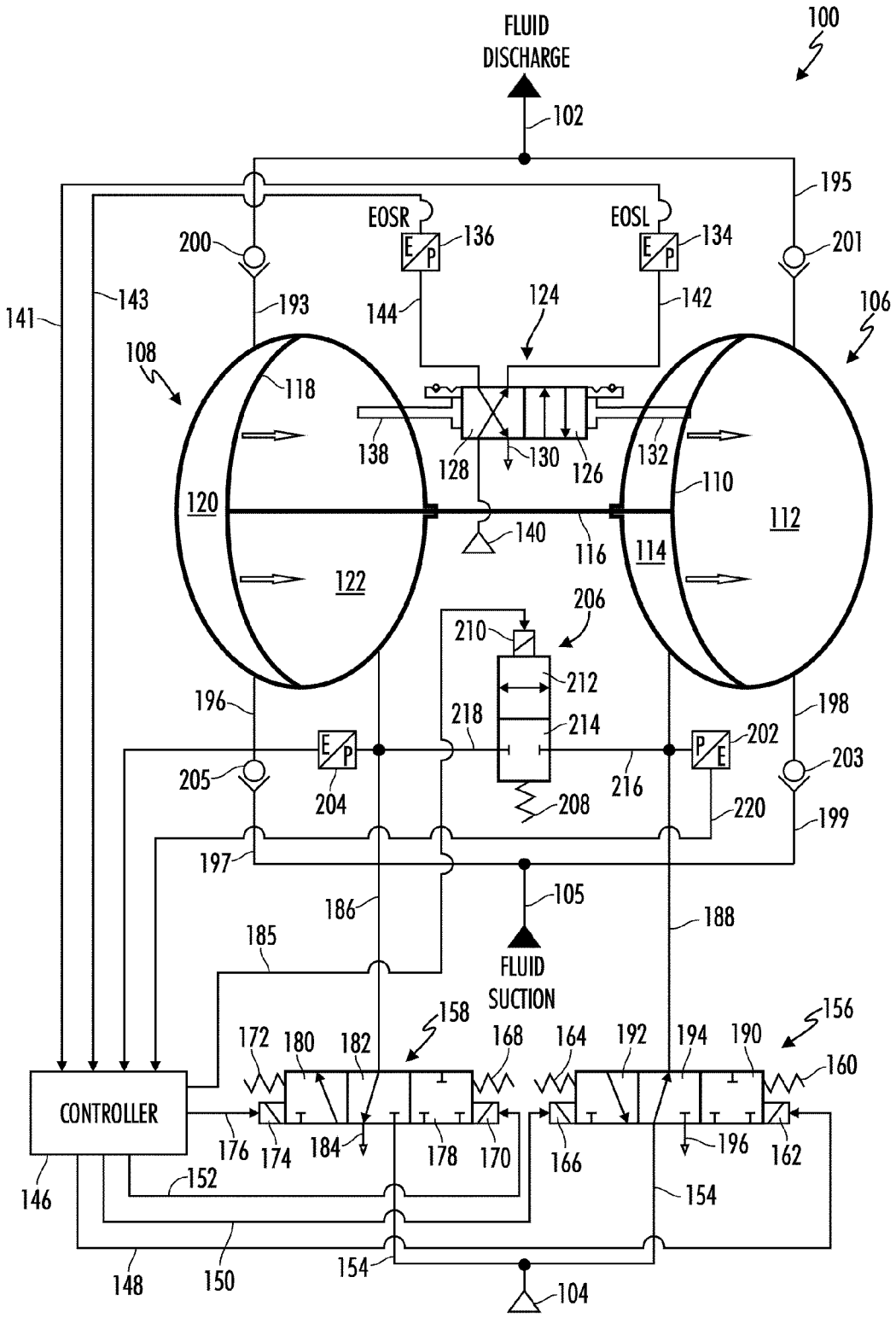
FIG. 21 is a schematic illustrating the AOD pump shown in FIG. 20.

When diaphragm 110 contacts control rod 132 porting configuration 128 is moved and locked into the active position in pilot valve 124 as shown in FIG. 21. Compressed air is supplied to sensor 134 which then sends an electrical signal to controller 146 that diaphragm 118 and 110 have reached the end-of-stroke left position. In step 306, when the diaphragms have reached the end-of-stroke left position the method advances to step 308.

In step 308, the air pressure in the right side 122 of diaphragm chamber 108 and left side 114 of diaphragm chamber 106 is equalized. As shown in table 302, solenoid 210 is energized and all other solenoids are deactivated. When solenoid 210 is energized, porting configuration 212 is moved to the active position in valve 206 to allow air in right side 122 to flow through lines 186 and 218, valve 206, and lines 216 and 188 to left side 114 of diaphragm chamber 106. In step 310, sensors 204 and 202 sense the air pressure P1 in right side 122 of diaphragm chamber 108 and the air pressure P2 in left side 114 of diaphragm chamber 106 and send corresponding signals to controller 146. Controller 146 then compares the difference in pressures P1 and P2 to a predetermined user selectable pressure X. When the difference between P1 and P2 is less than or equal to X, the method advances to step 312.

Figure 22:
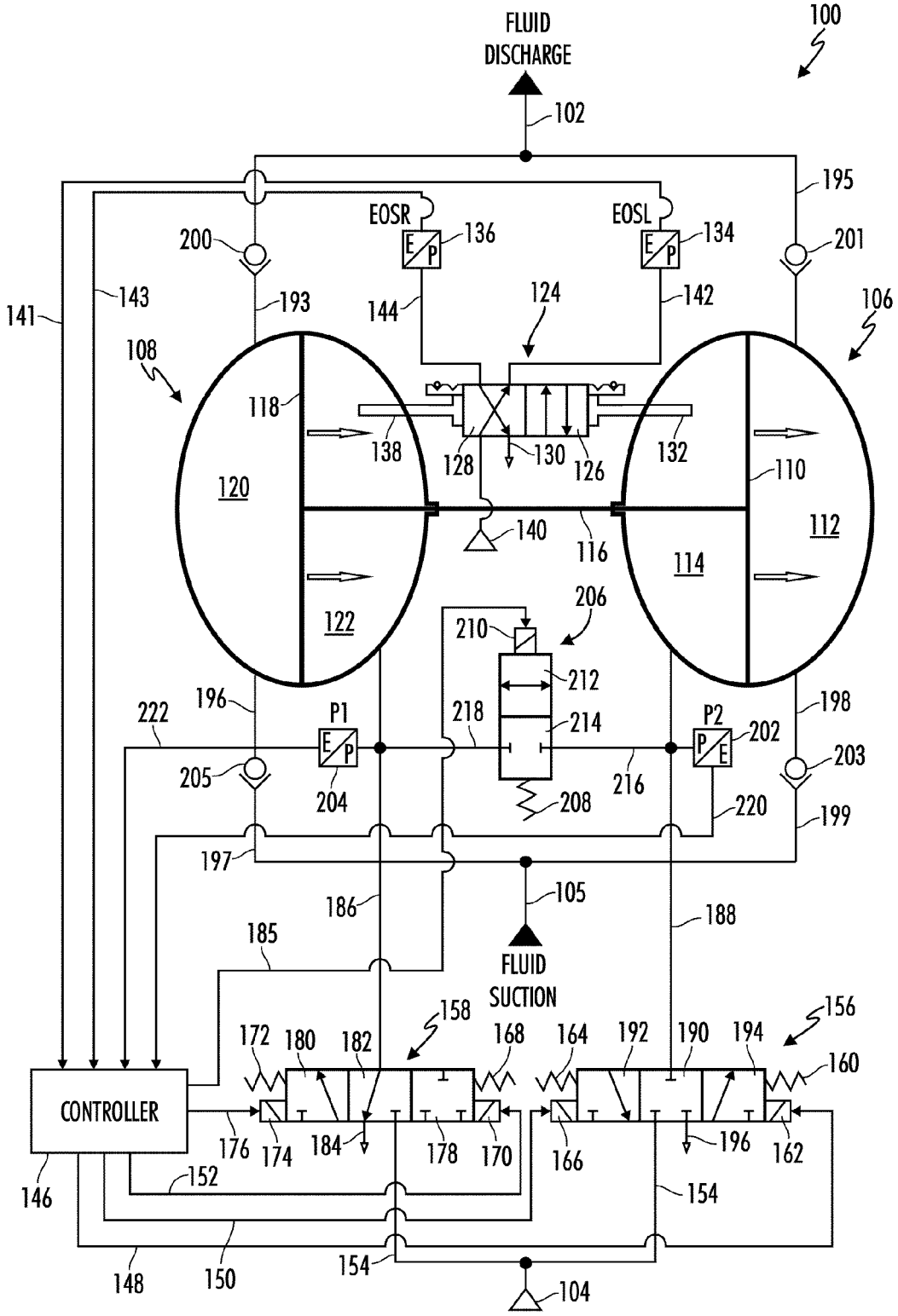
FIG. 22 is a schematic illustrating the AOD pump shown in FIG. 20.

In step 312, controller 146 starts a timer (not shown) and advances to step 314. In step 314, the valves are configured in the efficiency-left mode (EFF-LEFT) where solenoid 170 is energized and all other solenoids are deactivated as shown in FIG. 22 and table 302. Energizing solenoid 170 moves porting configuration 182 to the active position of valve 158. In this configuration, air in left side 114 of diaphragm chamber 106 expands and moves diaphragms 110 and 118 rightward as air in right side 122 of diaphragm chamber 108 is exhausted to the atmosphere through exhaust port 184 in valve 158. In step 316, if diaphragms 118 and 110 reach the end-of-stroke right condition, the method advances to 304 and begins again. If end-of-stroke right is not reached, the method advances to step 318. In step 318, the amount of time recorded by the timer started in step 312 is compared to a user selectable timeout period, for example 1.5 seconds. If the timer has timed out, reached 1.5 seconds for this example, the method advances to step 320. If the timer has not yet reached the timeout period, 1.5 seconds for this example, the method returns to step 314 to allow the air in left side 114 of diaphragm chamber 106 to continue to expand.

In step 320, valves 156 and 158 are placed in the end-of-stroke left configuration by energizing solenoids 170 and 162 to move porting configurations 182 and 194 into the active positions in valves 158 and 156 as shown in FIG. 922 and table 302. In this condition, compressed air from air supply 104 is supplied to left side 114 of diaphragm chamber 106 to move diaphragms 110 and 118 rightward. As diaphragm 118 moves rightward, fluid is pulled into left side 120 through line 196, check valve 205, line 197, and fluid suction line 105. Check valve 200 in line 193 prevents fluid in line 102 from being pulled back into left side 120 when diaphragm 118 moves rightward. At the same time, diaphragm 110 moves rightward pushing fluid present in right side 112 of diaphragm chamber 106 through line 195 and check valve 201 to fluid discharge line 102. Check valve 203 in line 199 prevents fluid in right side 112 from being pushed back into line 199 during rightward movement of diaphragm 110.

Figure 23:
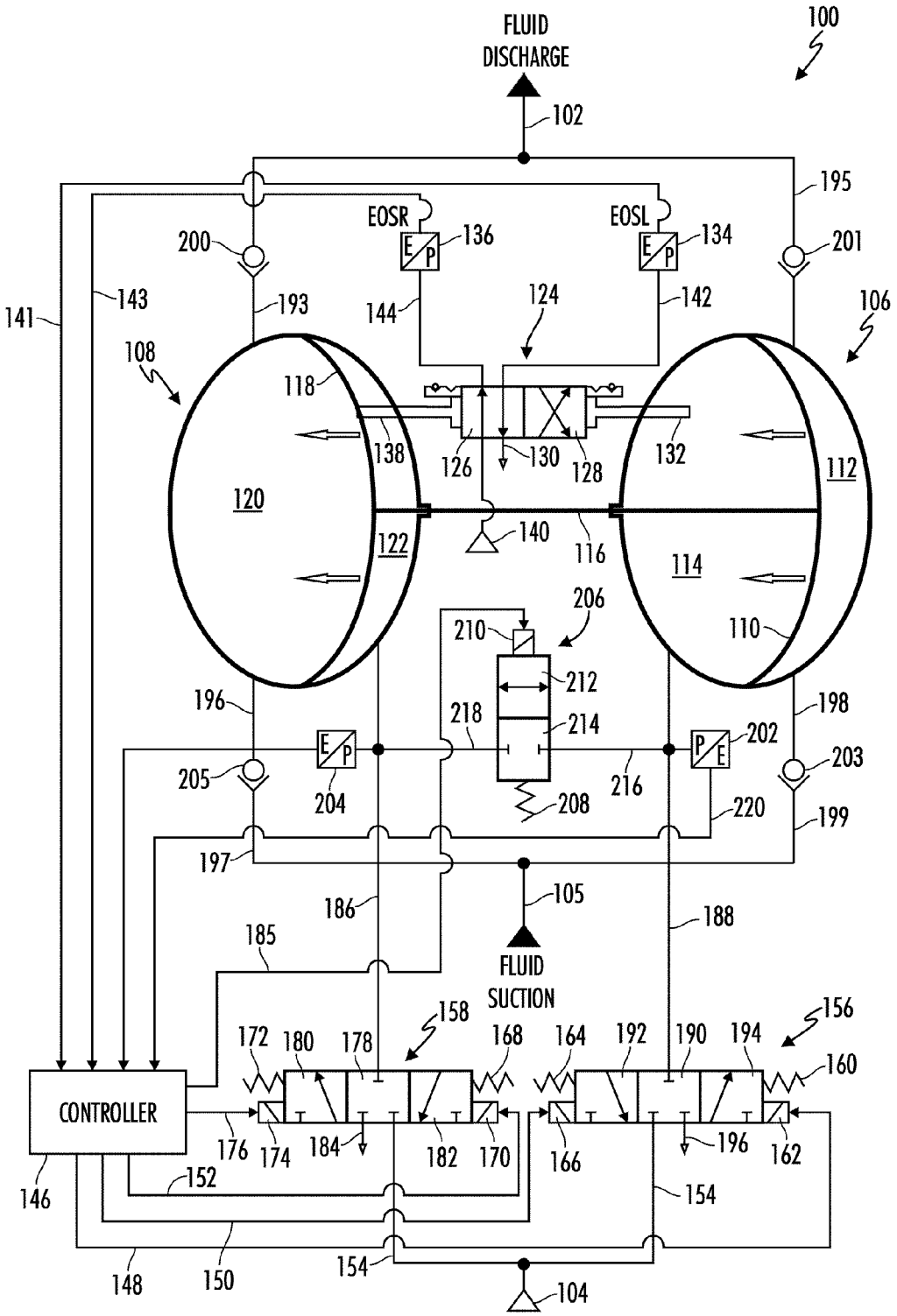
FIG. 23 is a schematic illustrating the AOD pump shown in FIG. 20.

In step 322, when an end-of-stroke right condition is detected the method advances to step 324. In step 324 the air pressure in left side 114 of diaphragm chamber 106 and right side 122 in diaphragm chamber 108 is equalized. In step 324, only solenoid 210 is energized and all other solenoids are deactivated as shown in FIG. 23. Energizing solenoid 210 moves porting configuration 212 to the active position of valve 206 to allow air in left side chamber 114 to flow through lines 188 and 216, valve 206, and lines 218 and 186 to right side chamber 122.

Figure 24:
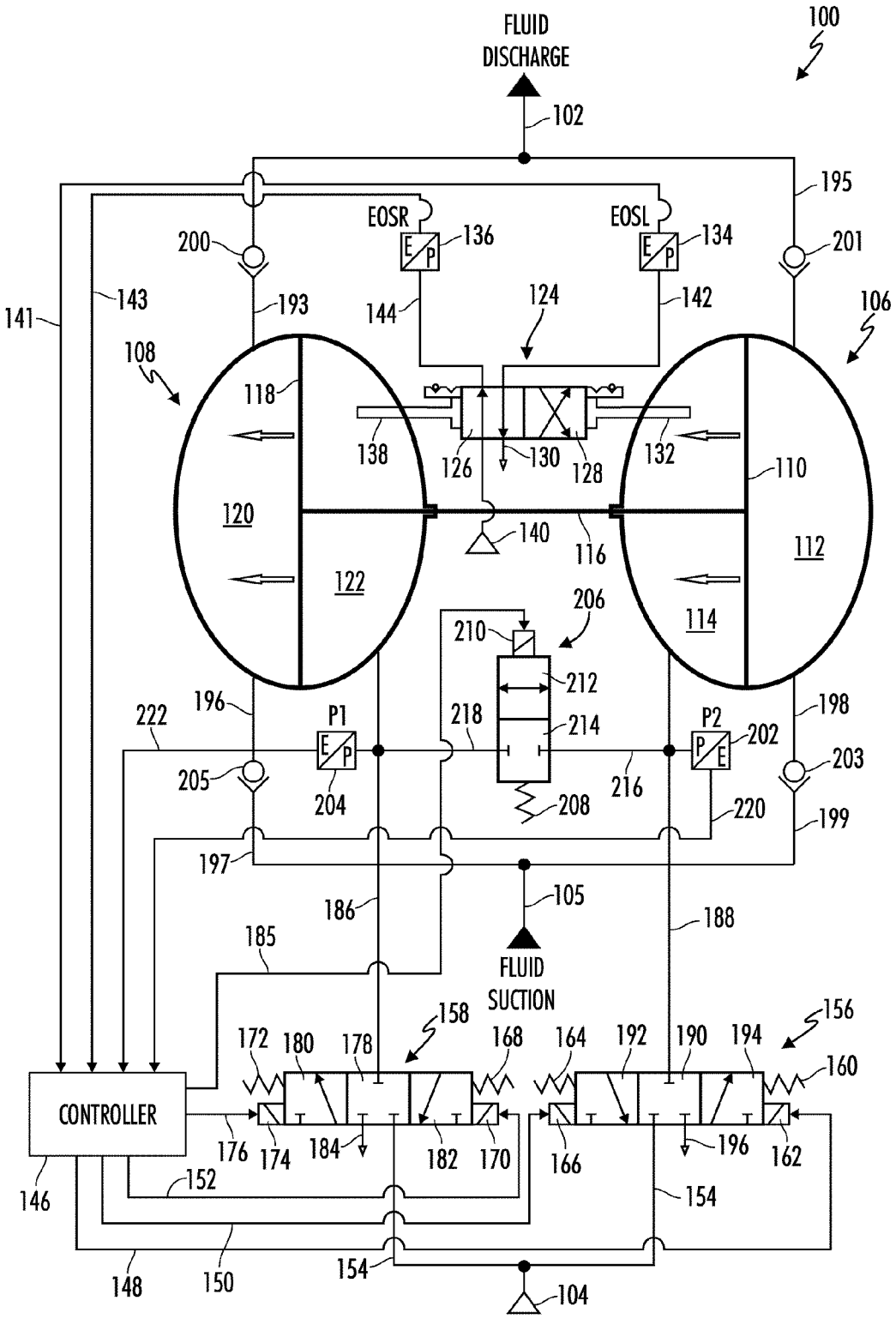
FIG. 24 is a schematic illustrating the AOD pump shown in FIG. 20.

In step 326, controller 146 compares the difference between pressures P2 in left side 114 and P1 in right side 122 to a user selectable pressure X. If the difference between P2 and P1 is less than or equal to X, the method advances to step 328 which activates a timer, similar to step 312. The method then advances to step 330. In step 330, the valves are positioned in the efficiency-right mode (EFF-RIGHT) as shown in FIG. 24 and table 302. In step 330, only solenoid 166 is energized and all other solenoids are deactivated. Solenoid 166 moves porting configuration 192 to the active position of valve 156 to vent air in left side 114 to the atmosphere through exhaust port 196. In this mode, air in right side 122 of diaphragm chamber 108 expands to move diaphragms 118 and 110 leftward. In step 332, if an end-of-stroke left signal is detected the method advances to step 320. If an end-of-stroke left signal is not detected the method advances to step 334, which is similar to step 318.

In step 334, which is similar to step 318, a user selectable timeout is compared to the timer started in step 328. If the timer has reached the timeout period the method advances to step 304 and begins again. If the timer has not reached the timeout period, the method returns to the step 330 to allow the air in right side 122 to continue to expand until either the end-of-stroke left condition has been reached the timer reaches the timeout period.

Figure 25:
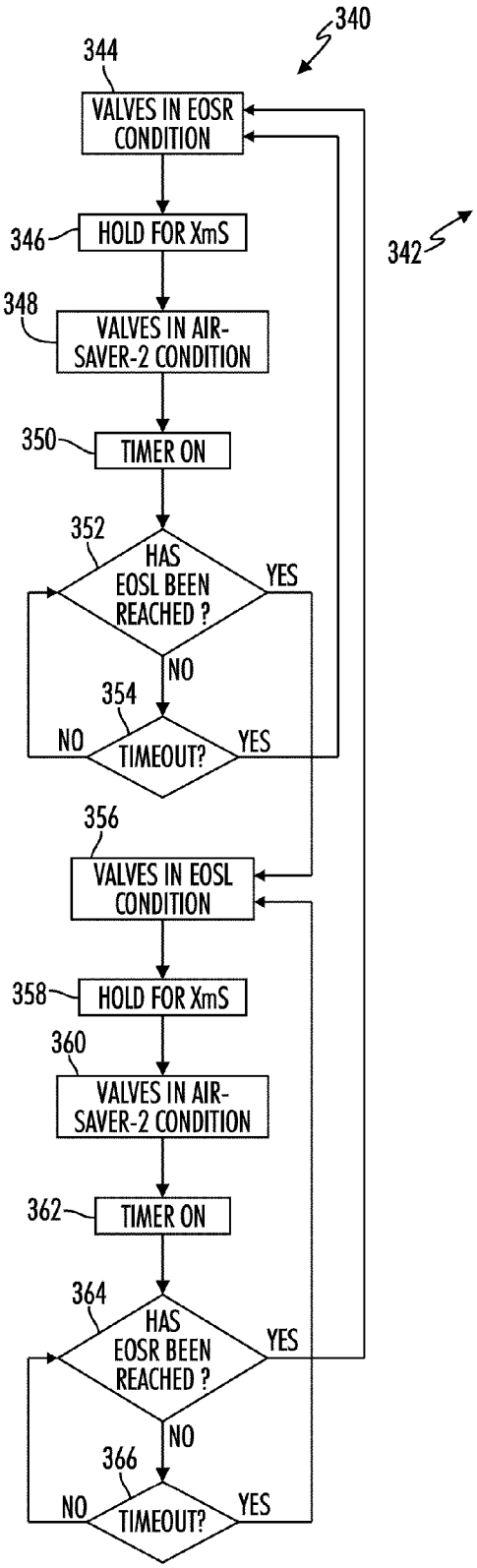
FIG. 25 is a flowchart and a logic table describing a method of operating the AOD pump shown in FIGS. 26-28.
Figure 26:
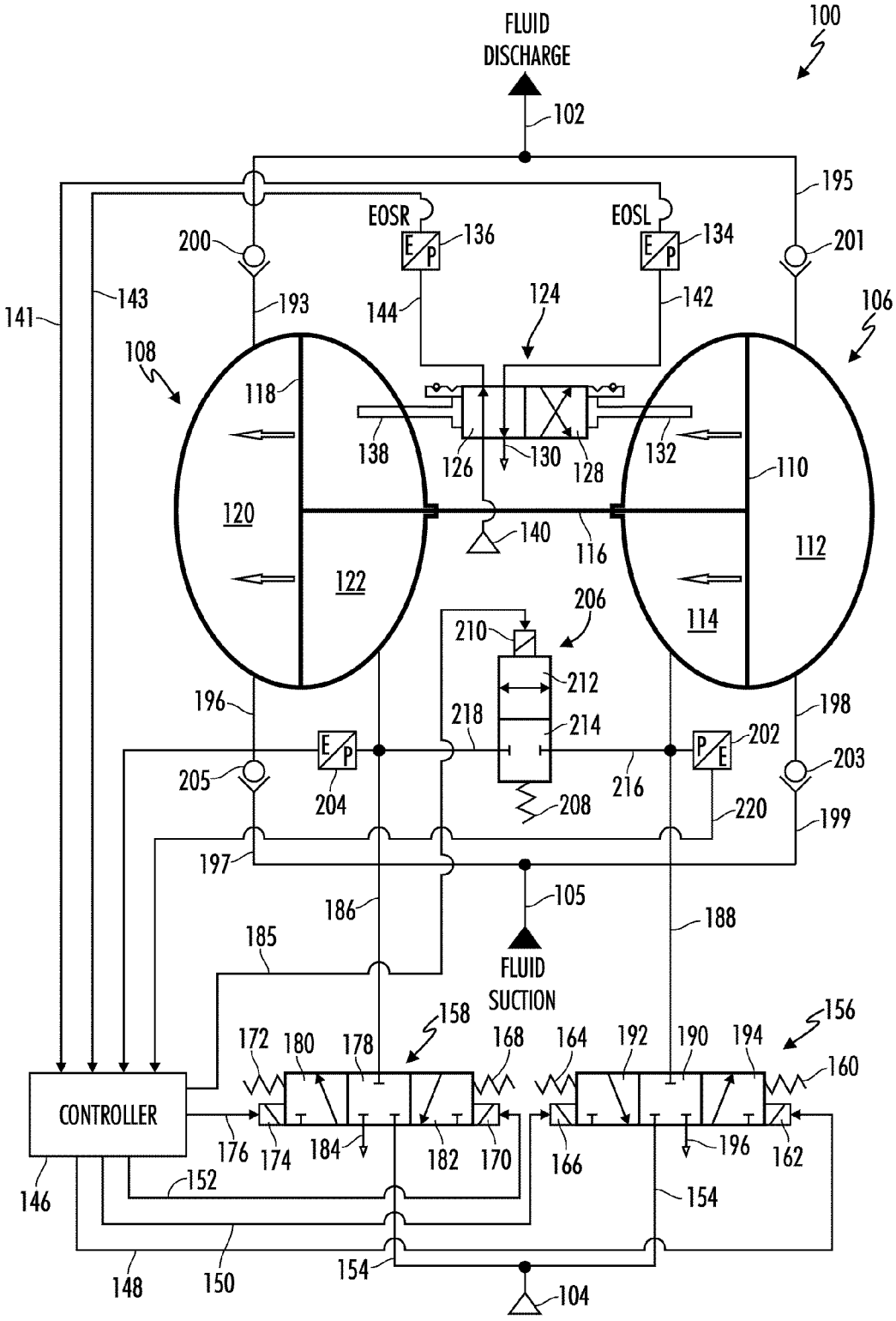
FIG. 26. is a schematic illustrating another embodiment of a AOD pump.
Figure 27:
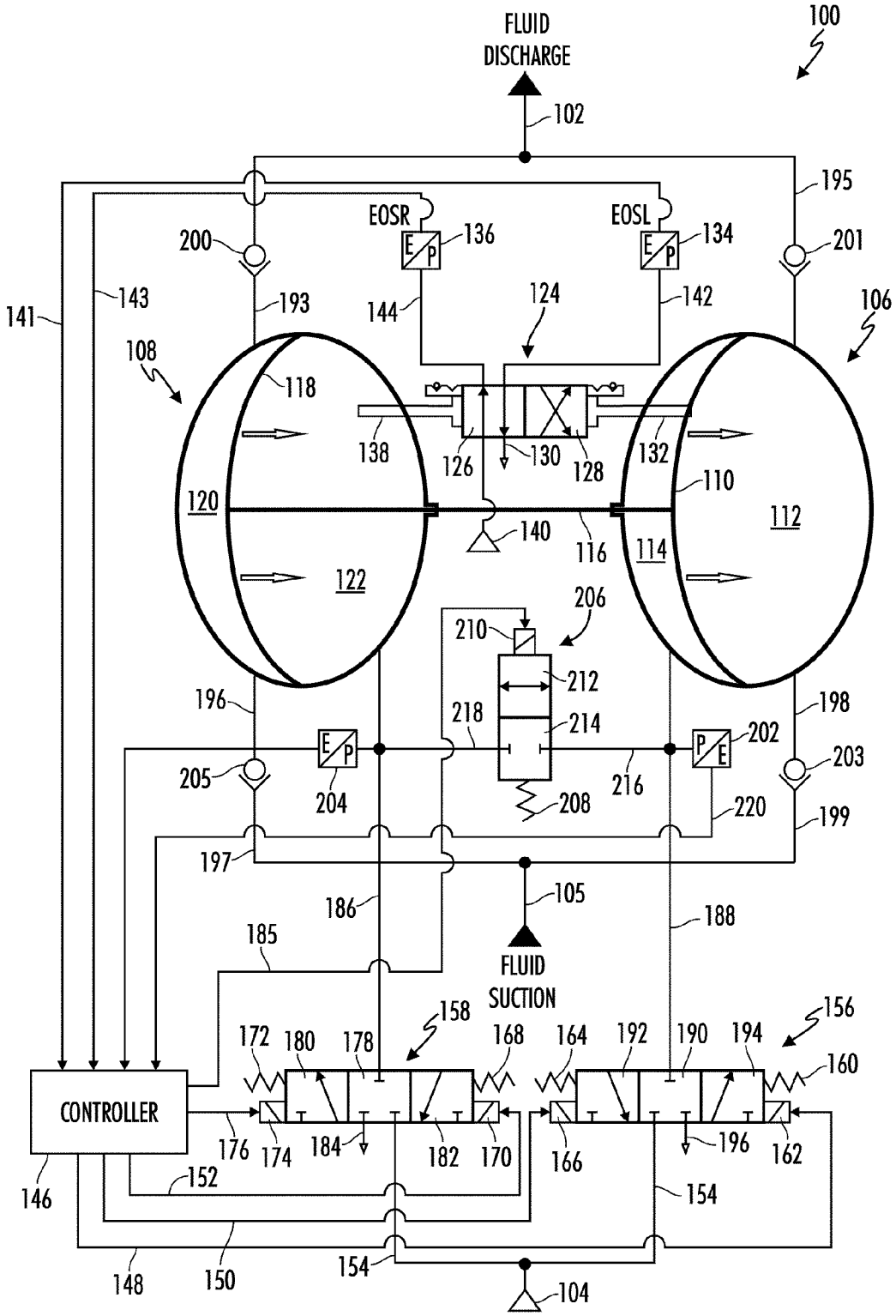
FIG. 27 is a schematic illustrating the AOD pump shown in FIG. 26.
Figure 28:
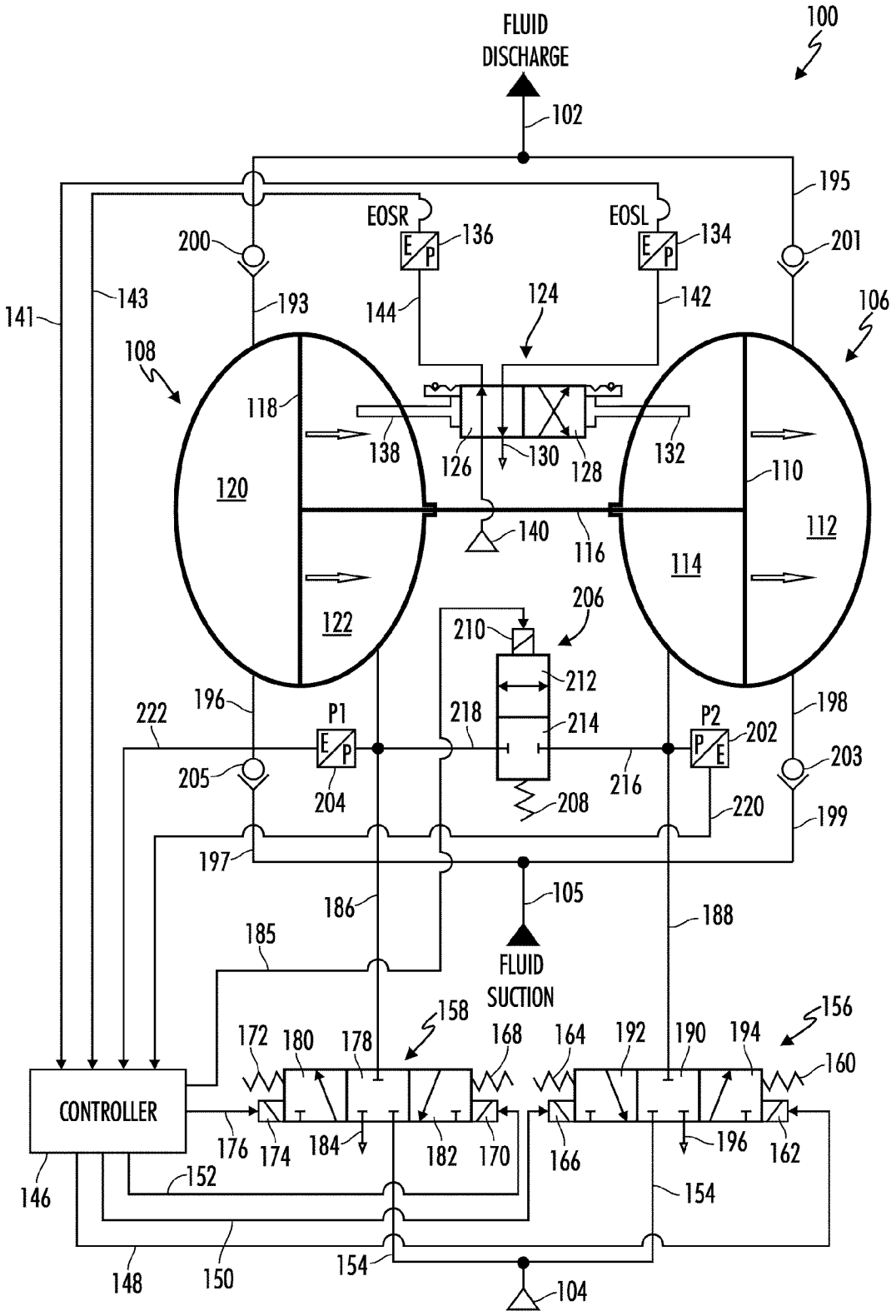
FIG. 28 is a schematic illustrating the AOD pump shown in FIG. 26.

Another method of operating AOD pump 100 is shown in FIGS. 20-25. FIG. 25 includes a flowchart 340 and a corresponding table 342 illustrating the status of the solenoids during the steps of the method. In step 344, valves 156 and 158 are locked in the end-of-stroke right condition and the diaphragms 118 and 110 are moving leftward as shown in FIG. 20. Solenoids 174 and 166 are energized to position porting configurations 180 and 192 in the active positions in valves 158 and 156. Compressed air is being supplied to right side 122 of diaphragm chamber 108 and air in left side chamber 114 of diaphragm chamber 106 is being exhausted through exhaust port 196. Fluid present in left side 120 of diaphragm chamber 108 is pushed through line 193 and check valve 200 to fluid discharge line 102. Check valve 205 in line 197 prevents fluid from flow from left side 120 back into line 196 during leftward movement of diaphragm 118. At the same time, fluid is pulled from fluid suction line 105, line 199, check valve 203, and line 198 into right side 112 of diaphragm 106 during leftward movement of diaphragm 110. Check valve 201 prevent fluid in line 195 from being pulled back into right side 112 during leftward movement of diaphragm 110.

In step 346, the solenoids are energized for a user defined time period X milliseconds (mS). In step 348, the valves are placed in the Air-Saver 2 condition in which only solenoid 166 is energized and all other solenoids are deactivated as shown in FIG. 20. The Air-Saver 2 condition is similar to the efficiency-right mode described above. In step 348, air in right side 122 of diaphragm chamber 108 is expanding to force diaphragms 118 and 110 leftward. In step 350 a timer in controller 146 is activated and the method proceeds to step 352. If an end-of-stroke left signal is received by controller 146 from sensor 134 the method proceeds to step 356. If an end-of-stroke left signal is not received by controller 146 the method advances to step 354.

In step 354, a user selectable timeout period is compared to the time elapsed as measured by the timer started in step 350. If the elapsed time period has reached the timeout period the method returns to step 344. If the timeout period has not expired the method returns to step 352. As discussed above, when an end-of-stroke left signal is received by controller 146 in step 352 the method advances to step 356. In step 356, the valves are in the end-of-stroke left condition as shown in FIG. 21. Solenoids 170 and 162 are energized to position porting configurations 182 and 194 in the active positions in valves 158 and 156. Compressed air is supplied to left side 114 of diaphragm chamber 106 to force diaphragms 110 and 118 rightward. As diaphragm 118 moves rightward, fluid is pulled into left side 120 through line 196, check valve 205, line 197, and fluid suction line 105. Check valve 200 in line 193 prevent fluid in line 193 from being pulled back into left side 120 when diaphragm 118 moves rightward. At the same time, diaphragm 110 moves rightward pushing fluid present in right side 112 of diaphragm chamber 106 through line 195 and check valve 201 to fluid discharge line 102. Check valve 203 in line 199 prevents fluid in right side 112 from being pushed back into line 199 during rightward movement of diaphragm 110.

In step 358, the solenoids are energized for a user defined time period X milliseconds (mS). In step 360, the valves are placed in the Air Saver 2 condition in which only solenoid 170 is energized to move porting configuration 182 into the active position of valve 158 as shown in FIG. 922. In the Air Saver 2 condition compressed air present in left side 114 of diaphragm chamber 106 expands to force diaphragms 110 and 118 rightward. In step 362, a timer in controller 146 is initiated. In step 364, if an end-of-stroke right signal is received by controller 146 from sensor 136 the method returns to step 344 to start the cycle over again. If an end-of-stroke right signal is not received by controller 146, the method advances to step 366. In step 366, the time elapsed since the timer was activated in step 362 is compared to a user selectable timeout period. If the elapsed time recorded by the time exceeds the timeout period the method proceeds back to step 356. If the timeout period has not expired the method returns to step 364.

Figure 29:
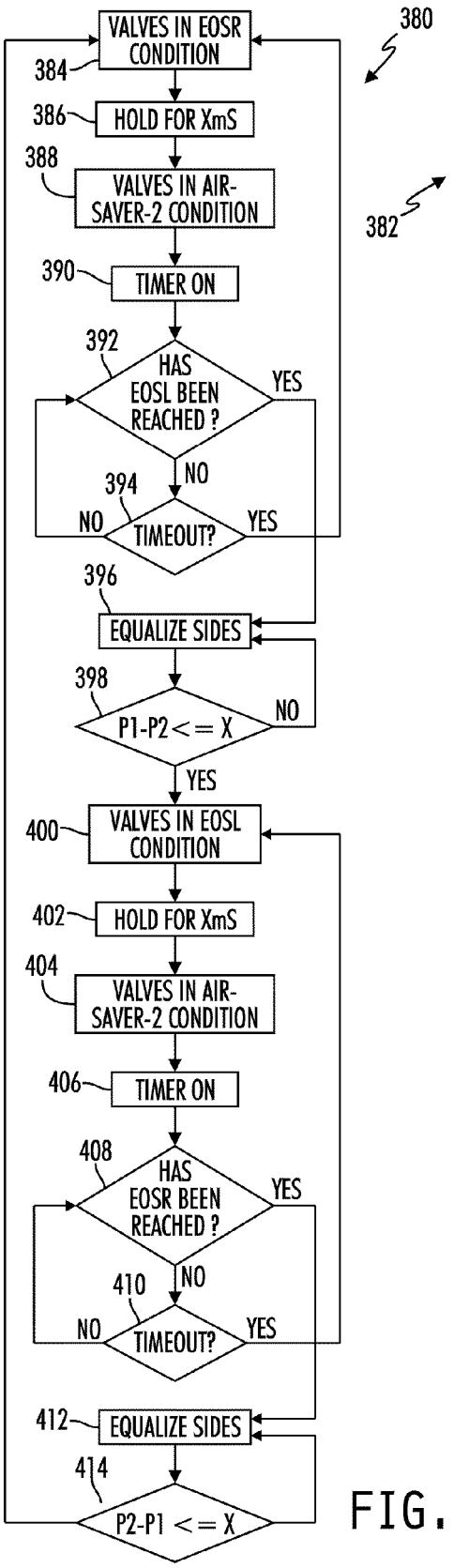
FIG. 29 is a flowchart and a logic table describing a method of operating the AOD pump shown in FIGS. 30-33.
Figure 30:
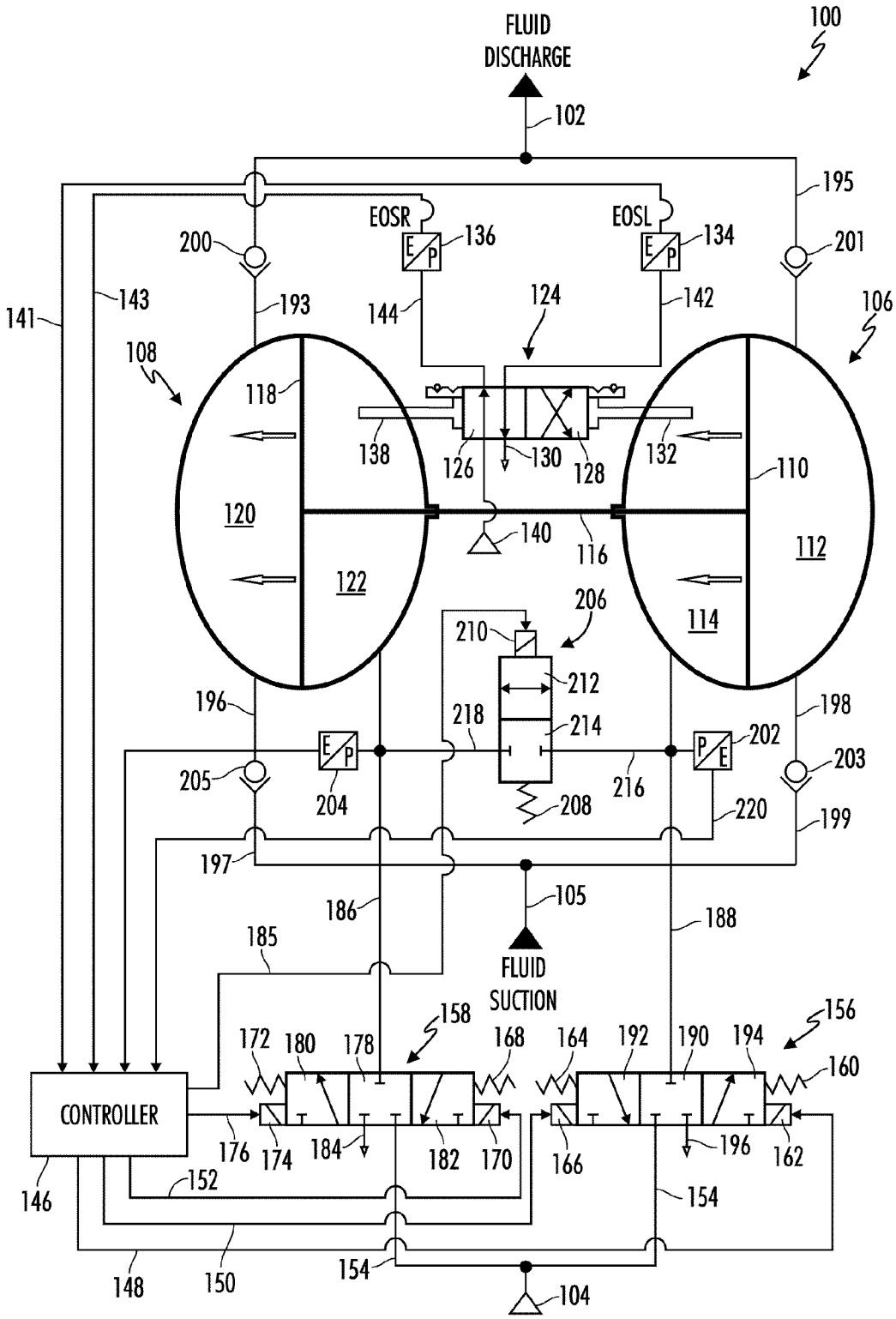
FIG. 30. is a schematic illustrating another embodiment of a AOD pump.

Another method of operating AOD pump 100 is shown in FIGS. 29-33. FIG. 29 includes a flowchart 380 and a corresponding table 382 illustrating the status of the solenoids during the steps of the method. In step 384, the valves are locked in the end-of-stroke right condition and the diaphragms 118 and 110 are moving leftward as shown in FIG. 30. Solenoids 174 and 166 are energized to position porting configurations 180 and 192 in the active positions in valves 158 and 156. Compressed air is being supplied to right side 122 of diaphragm chamber 108 and air in left side 114 of diaphragm chamber 106 is being exhausted through exhaust port 196. Fluid present in left side 120 of diaphragm chamber 108 is pushed through line 193 and check valve 200 to fluid discharge line 102. Check valve 205 in line 197 prevents fluid from flow from left side 120 back into line 196 during leftward movement of diaphragm 118. At the same time, fluid is pulled from fluid suction line 105, line 199, check valve 203, and line 198 into right side 112 of diaphragm chamber 106 during leftward movement of diaphragm 110. Check valve 201 prevent fluid in line 195 from being pulled back into right side 112 during leftward movement of diaphragm 110.

In step 386 the solenoids are energized for a user defined time period X milliseconds (mS). In step 388 the valves are placed in the Air-Saver 2 condition in which only solenoid 166 is energized and all other solenoids are deactivated as shown in Table 382. Step 388 is similar to step 348 in that air in right side 122 of diaphragm chamber 108 is expanding to force diaphragms 118 and 110 leftward. In step 390 a timer in controller 146 is activated and the method proceeds to step 392. In step 392, if an end-of-stroke left signal is received by controller 146 from sensor 134 the method proceeds to step 396. If an end-of-stroke left signal is not received by controller 146 the method advances to step 394.

Figure 31:
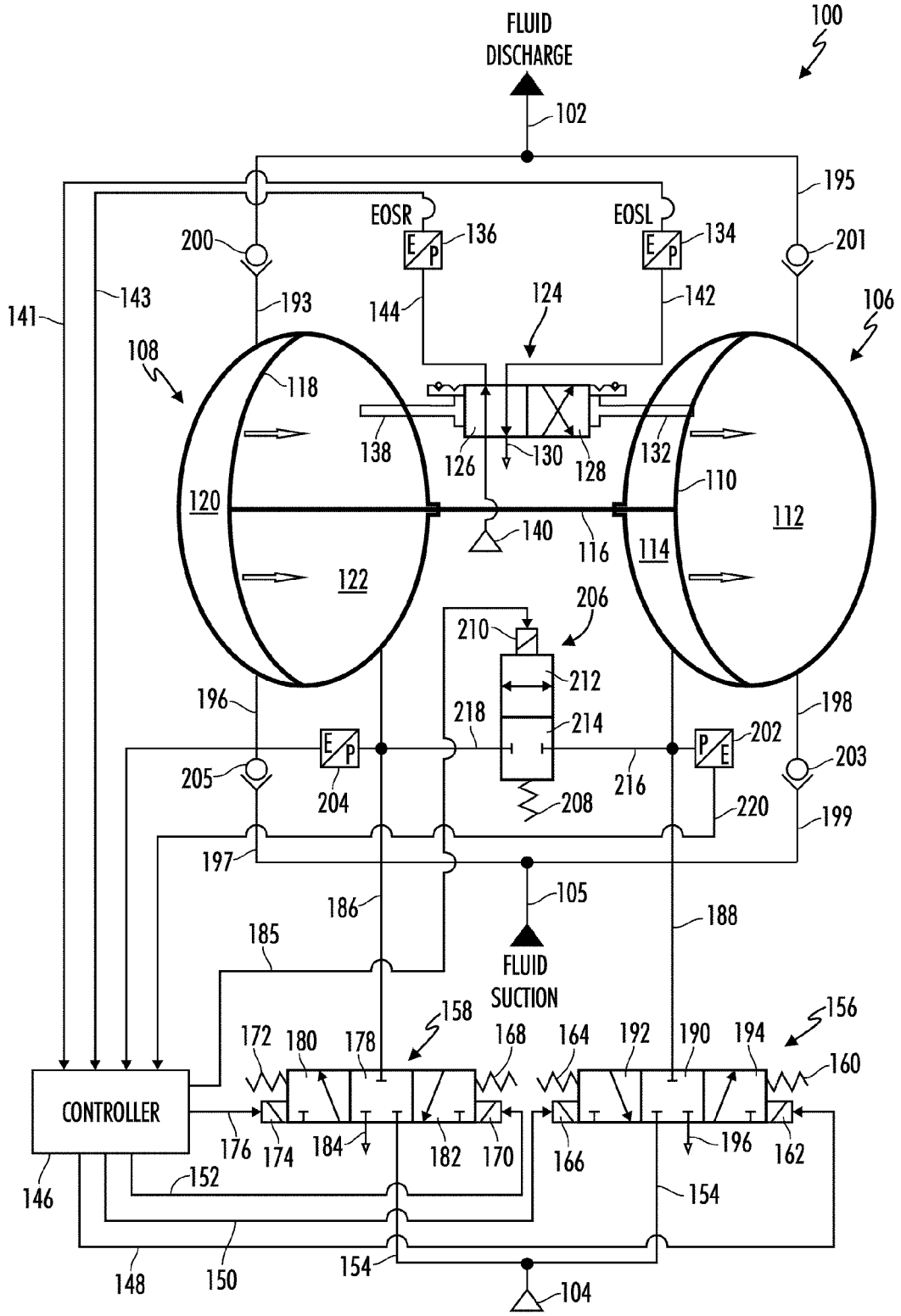
FIG. 31 is a schematic illustrating the AOD pump shown in FIG. 30.

In step 394, a user selectable timeout period is compared to the time elapsed as measured by the timer started in step 390. If the elapsed time period has reached the timeout period the method returns to step 384. If the timeout period has not expired the method returns to step 392. As discussed above, when an end-of-stroke left signal is received by controller 146 in step 392 the method advances to step 396. In step 396, as shown in FIG. 31, the air pressure in right side 122 of diaphragm chamber 108 is equalized with the air pressure in left side 114 of diaphragm chamber 106. Solenoid 210 of valve 206 is energized to allow air in right side 122 to flow through lines 186 and 218, valve 206, and lines 216 and 188 to left side 114 of diaphragm chamber 106. In step 398, the air pressure P1 of right side 122 is measured by sensor 204 and monitored by controller 146. The air pressure P2 of left side 114 is measured by sensor 202 which sends a corresponding signal to controller 146. Controller 146 then compares the difference between P1 and P2 with a predetermined user defined air pressure X. If the difference between P1 and P2 is less than or equal to X the method advances to step 400. If the difference between P1 and P2 is greater than X the method returns to step 396.

In step 400, the valves are in the end-of-stroke left condition with solenoids 170 and 162 energized to move porting configurations 182 and 194 into the active positions of valves 158 and 156 as shown in FIG. 31. Compressed air is being supplied to left side 114 of diaphragm chamber 106 and air in right side 122 of diaphragm chamber 108 is being exhausted through exhaust port 184. Fluid present in right side 112 of diaphragm chamber 106 is pushed through line 195 and check valve 201 to fluid discharge line 102. Check valve 203 in line 199 prevents fluid flow from right side 112 back into line 199 during rightward movement of diaphragm 110. At the same time, fluid is pulled from fluid suction line 105, line 197, check valve 205, and line 196 into left side 120 of diaphragm chamber 108 during rightward movement of diaphragm 118. Check valve 200 prevents fluid in line 193 from being pulled back into left side 120 during rightward movement of diaphragm 118.

Figure 32:
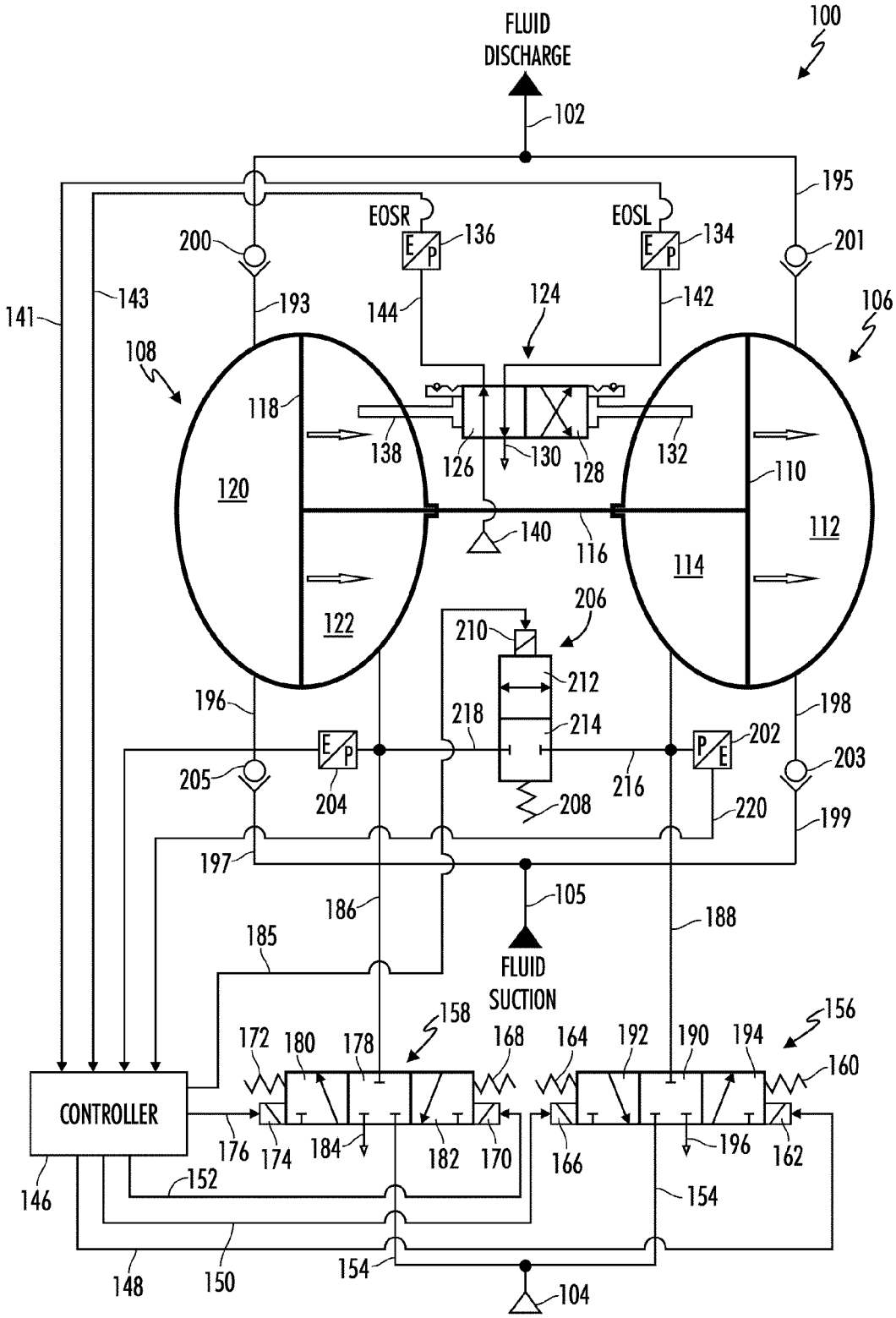
FIG. 32 is a schematic illustrating the AOD pump shown in FIG. 30.
Figure 33:
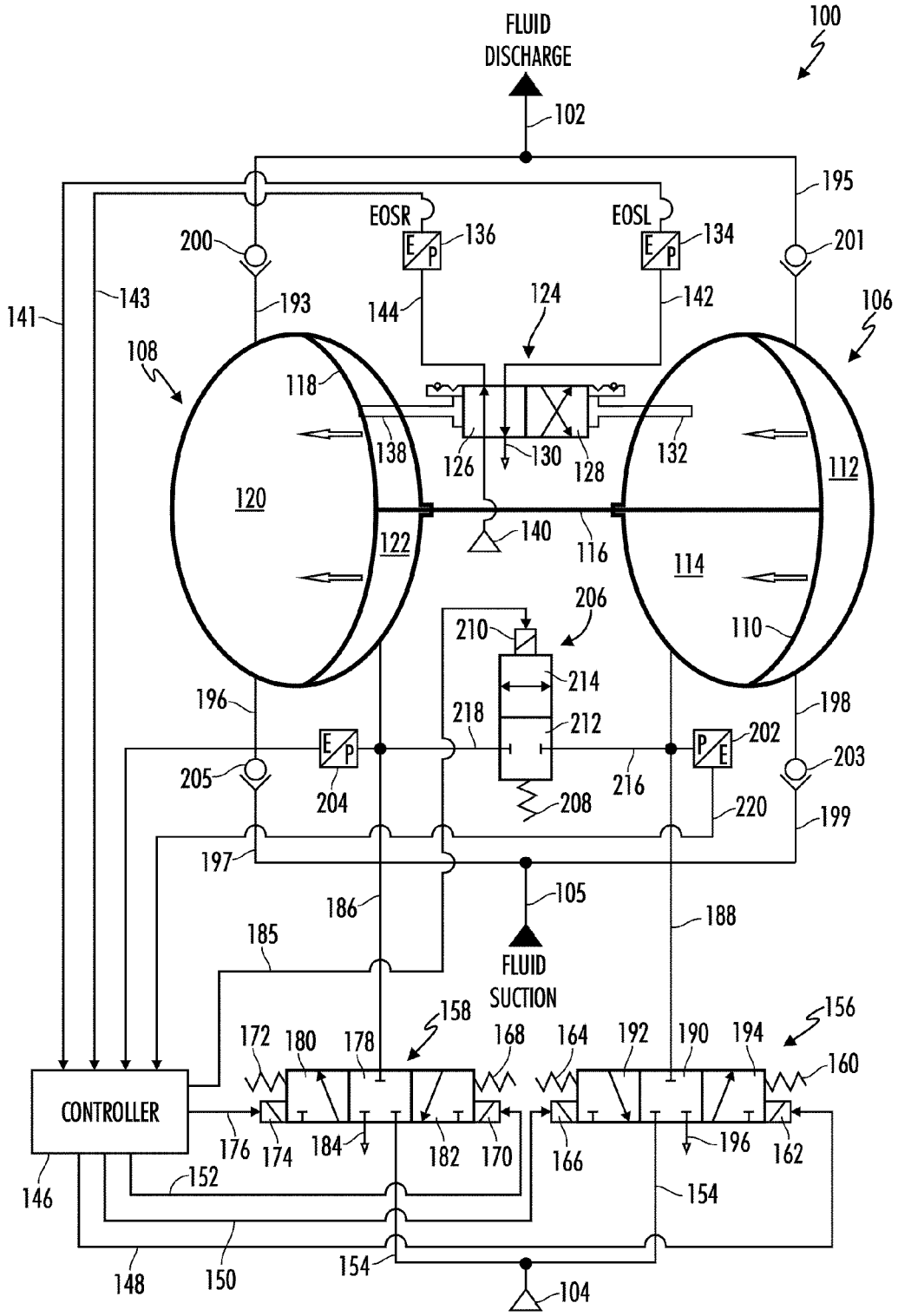
FIG. 33 is a schematic illustrating the AOD pump shown in FIG. 30.

In step 402, solenoids 170 and 162 remain energized for a user defined time period X milliseconds (mS). In step 404 the valves are placed in the Air-Saver 2 condition in which only solenoid 170 is energized and all other solenoids are deactivated as shown in table 382. In step 404, air in left side 114 of diaphragm chamber 106 expands to force diaphragms 118 and 110 rightward as shown in FIG. 32. In step 406 a timer in controller 146 is activated and the method proceeds to step 408. In step 408, if an end-of-stroke right signal, such as the condition shown in FIG. 33, is received by controller 146 from sensor 136 the method proceeds to step 412. If an end-of-stroke right signal is not received by controller 146 the method advances to step 410.

In step 410, a user selectable timeout period is compared to the time elapsed as measured by the timer started in step 406. If the elapsed time period has reached the timeout period the method returns to step 400. If the timeout period has not expired the method returns to step 408. As discussed above, when an end-of-stroke right signal is received by controller 146 in step 408 the method advances to step 412. In step 412, the air pressure in right side 122 of diaphragm chamber 108 is equalized with the air pressure in left side 114 of diaphragm chamber 106. Solenoid 210 of valve 206 is energized to allow air in left side 114 to flow through lines 188 and 216, valve 206, and lines 218 and 186 to right side 122 of diaphragm chamber 108. In step 414, the air pressure P1 of right side 122 is measured by sensor 204 and monitored by controller 146. The air pressure P2 of left side 114 is measured by sensor 202 which sends a corresponding signal to controller 146. Controller 146 then compares the difference between P2 and P1 with a predetermined user defined air pressure X. If the difference between P2 and P1 is less than or equal to X the method returns to step 384. If the difference between P2 and P1 is greater than X the method returns to step 412.

It should be understood that one having ordinary skill in the art would recognize that the methods of operating AOD pump 100 described above could be implemented in conventional AOD pumps to reduce compressed air consumption and operating efficiency.

Figure 34:
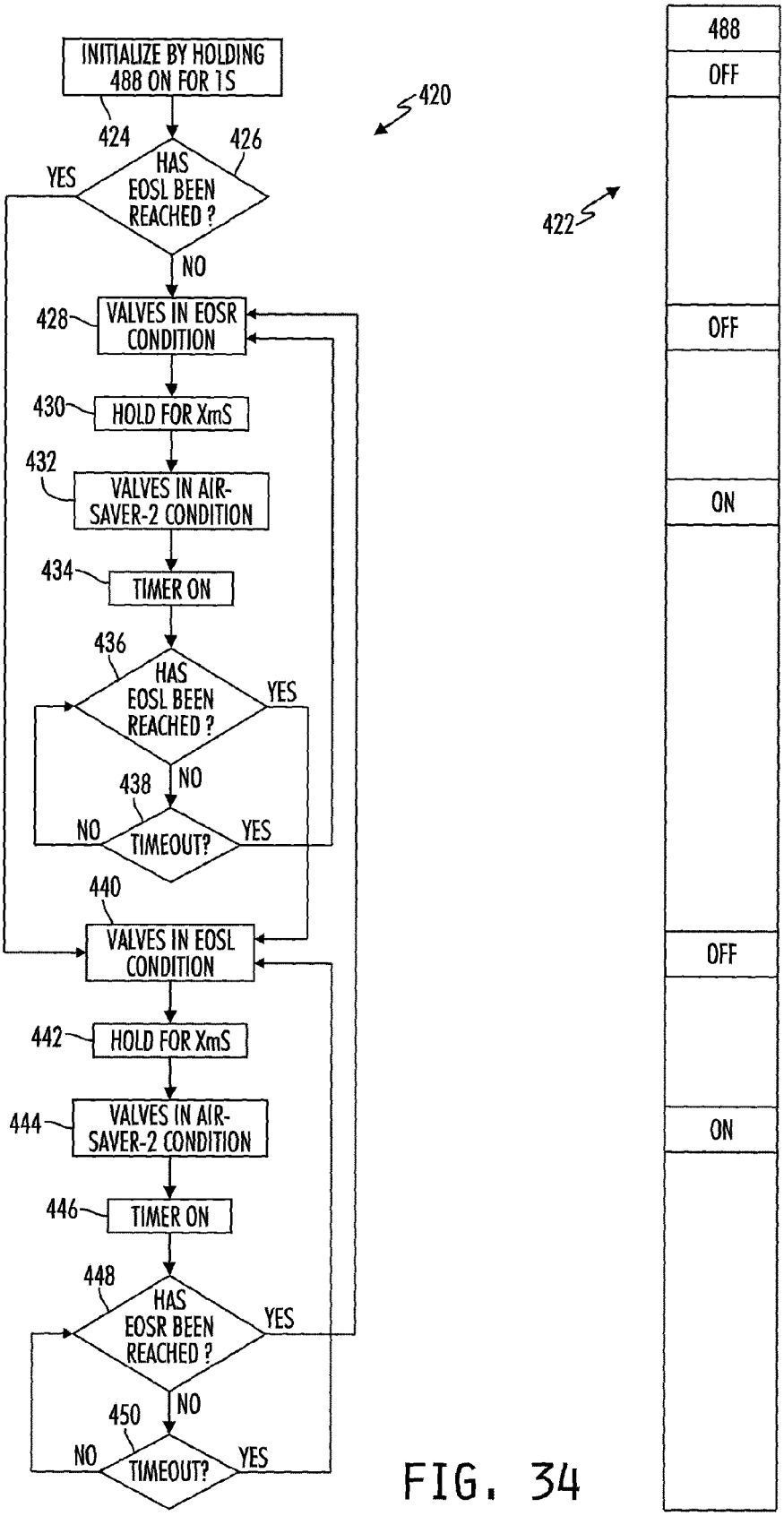
FIG. 34 is a flowchart and a logic table describing a method of operating the AOD pump shown in FIGS. 35-38.
Figure 35:
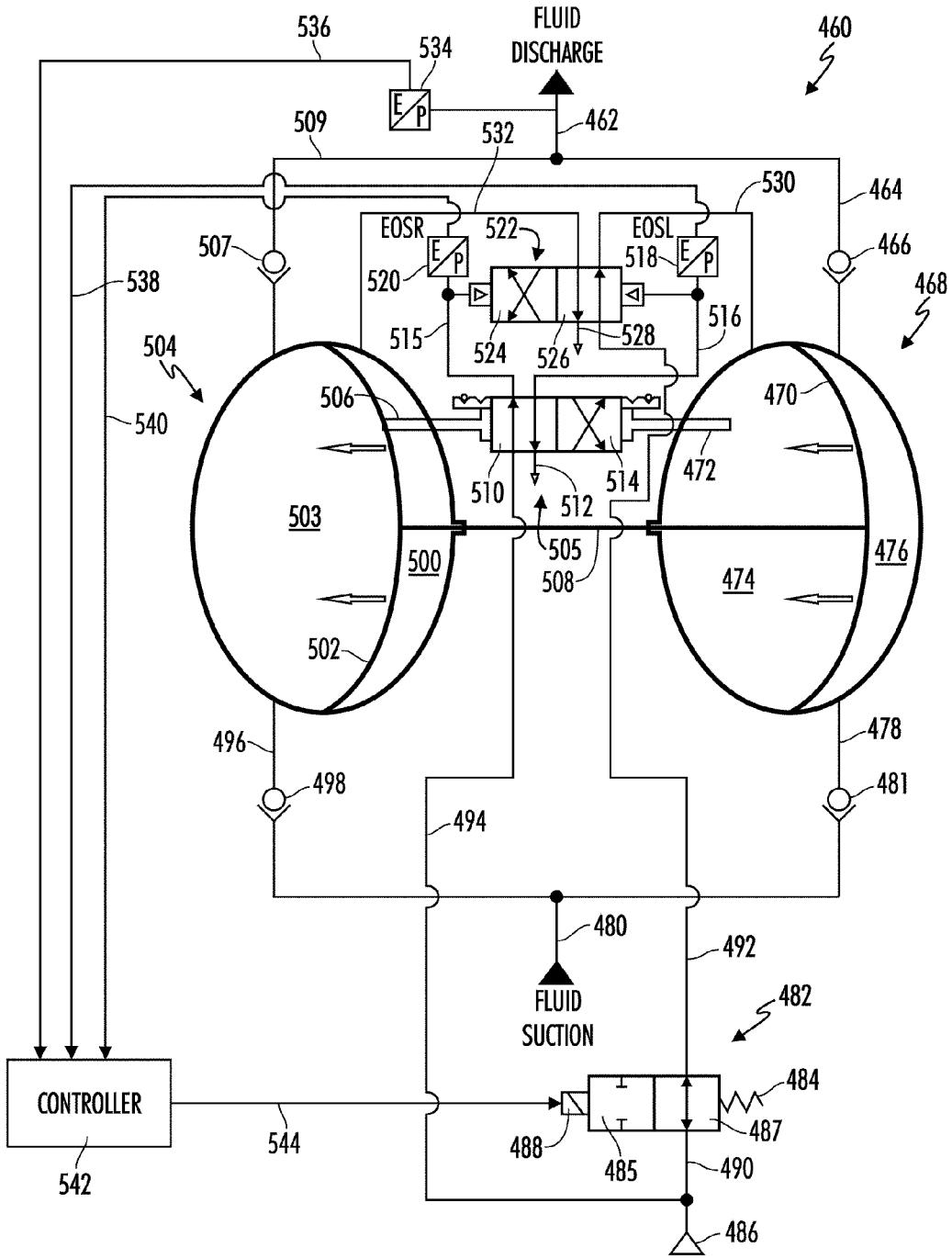
FIG. 35. is a schematic illustrating another embodiment of a AOD pump.
Figure 36:
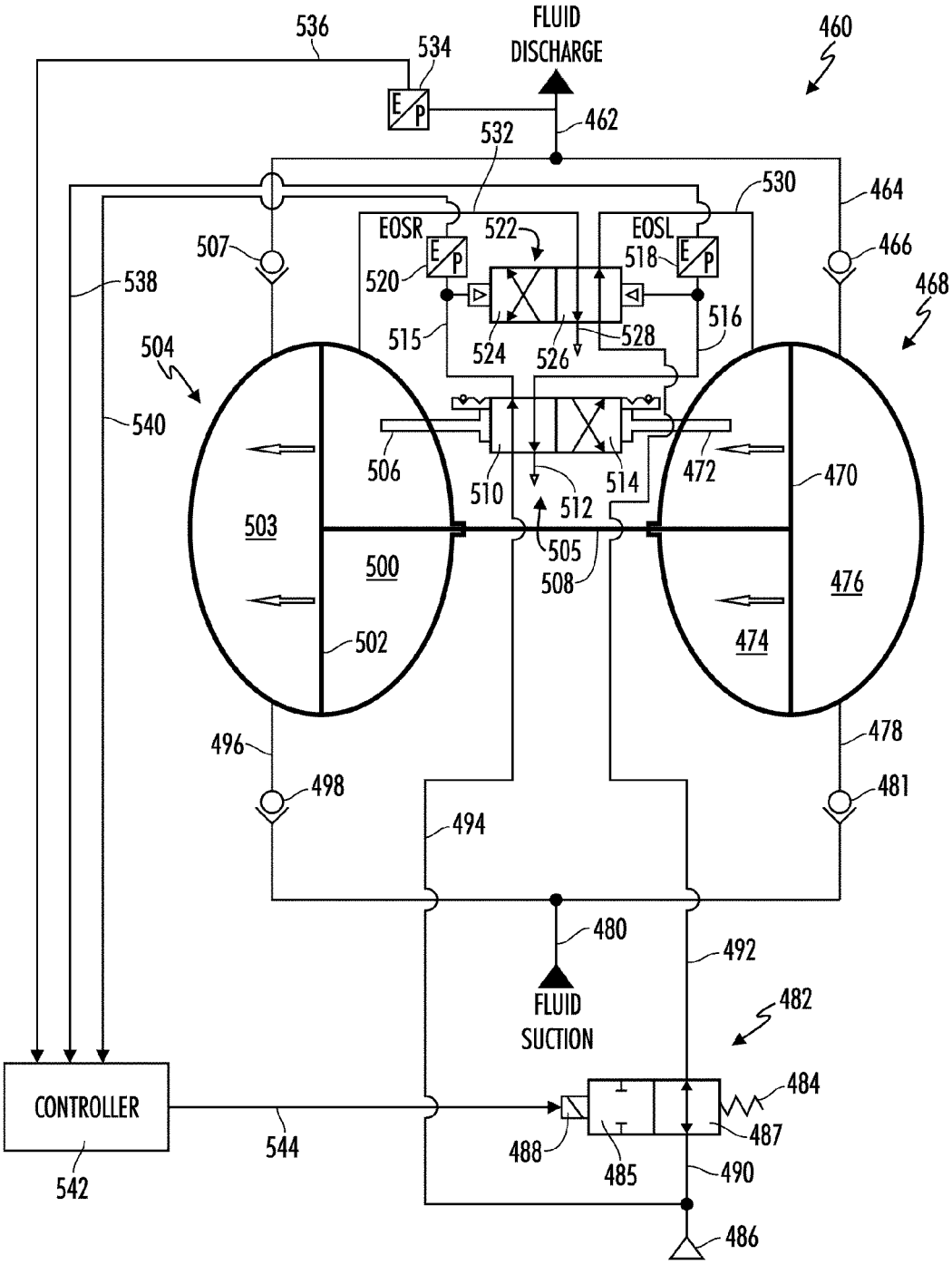
FIG. 36 is a schematic illustrating the AOD pump shown in FIG. 35.

Another method and apparatus of the present invention is shown in FIGS. 34-38. As shown in FIG. 35, AOD pump 460 includes diaphragm chambers 468 and 504, pilot valve 505, directional valve 522, controller 542, control valve 482, and pressure sensors 534, 520, and 518. AOD pump 460 receives fluid at fluid suction line 480 and outputs pressurized fluid at fluid discharge line 462. Diaphragm chamber 504 includes left side 503, right side 500, and diaphragm 502. Diaphragm chamber 468 includes diaphragm 470, left side 474, and right side 476. Diaphragms 502 and 470 are coupled together by rod 508.

In this embodiment, pilot valve 505 is a four-port, two position valve. Pilot valve 505 includes control rods 506 and 472 and porting configurations 510 and 514. Porting configuration 510 connects line 494 with line 515 and line 516 with exhaust port 512. Porting configuration 514 connects line 494 with line 516 and line 515 with exhaust port 512. Directional valve 522 is also a four-port, two position valve and includes porting configurations 524 and 526. Porting configuration 524 connects line 530 with exhaust port 528 and line 492 with line 532. Porting configuration 526 connects line 532 with exhaust port 528 and line 492 with line 530. Pilot valve 505 and directional valve 522 are substantially similar to pilot valve 926 and directional valve 950 shown in FIG. 11.

Control valve 482 is a two-port, two position normally open solenoid valve with spring return. Control valve 482 includes porting configurations 487 and 485. Spring 484 positions porting configuration 487 in the active position of valve 482. Porting configuration 487 connects line 490 with line 492. Porting configuration 485 closes lines 490 and 492. Solenoid 488 can be energized to overcome the force exerted by spring 484 and move porting configuration 485 into the active position in valve 482.

Controller 542 receive electrical signals from pressure sensors 534, 520, and 518 through lines 536, 540, and 538, respectively. Pressure sensor 534 senses the pressure in line 462. Pressure sensor 520 senses an end-of-stroke right condition by sensing the air pressure in line 515 and sends a corresponding signal to controller 542. Pressure sensor 518 senses an end-of-stroke left condition by sensing the air pressure in line 516 and sends a corresponding signal to controller 542. Controller 542 controls solenoid 488 using line 544.

A method of operating AOD pump 460 is shown in FIG. 34. FIG. 34 includes a flowchart 420 and a corresponding table 422 illustrating the status of the solenoid 488 during the steps of the method. In FIG. 35, diaphragms 502 and 470 have just reached the end-of-stroke right condition. Porting configuration 510 is locked into the active position in pilot valve 505. Compressed air from line 494 is supplied to line 515 which moves and locks porting configuration 524 into the active position in directional valve 522. Air in line 516 is exhausted to the atmosphere through exhaust port 512. Pressure sensor 520 senses the air pressure increase in line 515 and sends an end-of-stroke right signal to controller 542. When porting configuration 524 is in the active position in valve 522, air from left side 474 of diaphragm chamber 468 is vented to the atmosphere through exhaust port 528 and compressed air from line 492 is supplied to right side 500 of diaphragm chamber 504 through valve 522.

In step 424, the method of operating AOD pump 460 is initialized by maintaining solenoid 488 in a deactivated state for a user selectable time period, for example, 1 second, to start pump 460. During the user selectable time period, the pump operates without the airsaver feature in mechanical mode as described in FIG. 11. After the user selectable time period, 1 second in this example, expires the method advances to step 426. In step 426, if the end-of-stroke left signal is received by controller 542, the method advances to 440, which is described below. If an end-of-stroke left signal is not received, the method advances to step 428.

In step 428, valves 505 and 522 are still locked in the end-of-stroke right configuration and solenoid 488 remains deactivated and the method advances to step 430. In step 430, solenoid 488 remains de-energized for a user selectable time period X milliseconds (mS) allowing spring 484 to hold porting configuration 487 in the active position of valve 482. In step 432, which places the valves in the Air Saver 2 condition, solenoid 488 is energized to move porting configuration 485 into the active position in valve 482. Porting configuration 485 closes lines 490 and 492. The Air Saver 2 condition allows air previously pushed into right side 500 diaphragm chamber 504 to expand and air to exhaust from left side 474 of chamber 468 to move diaphragms 502 and 470 leftward. In step 434, controller 542 activates a timer and the method advances to step 436.

In step 436, if end-of-stroke left is reached, the method advances to step 440. If end-of-stroke left is not reached, the method advances to step 438. In step 438, a user selectable timeout period is compared to the time elapsed as measured by the timer started in step 434. If the elapsed time period has reached the timeout period the method returns to step 428. If the timeout period has not expired the method returns to step 436. As discussed above, when an end-of-stroke left signal is received by controller 542 in step 436 the method advances to step 440.

Figure 37:
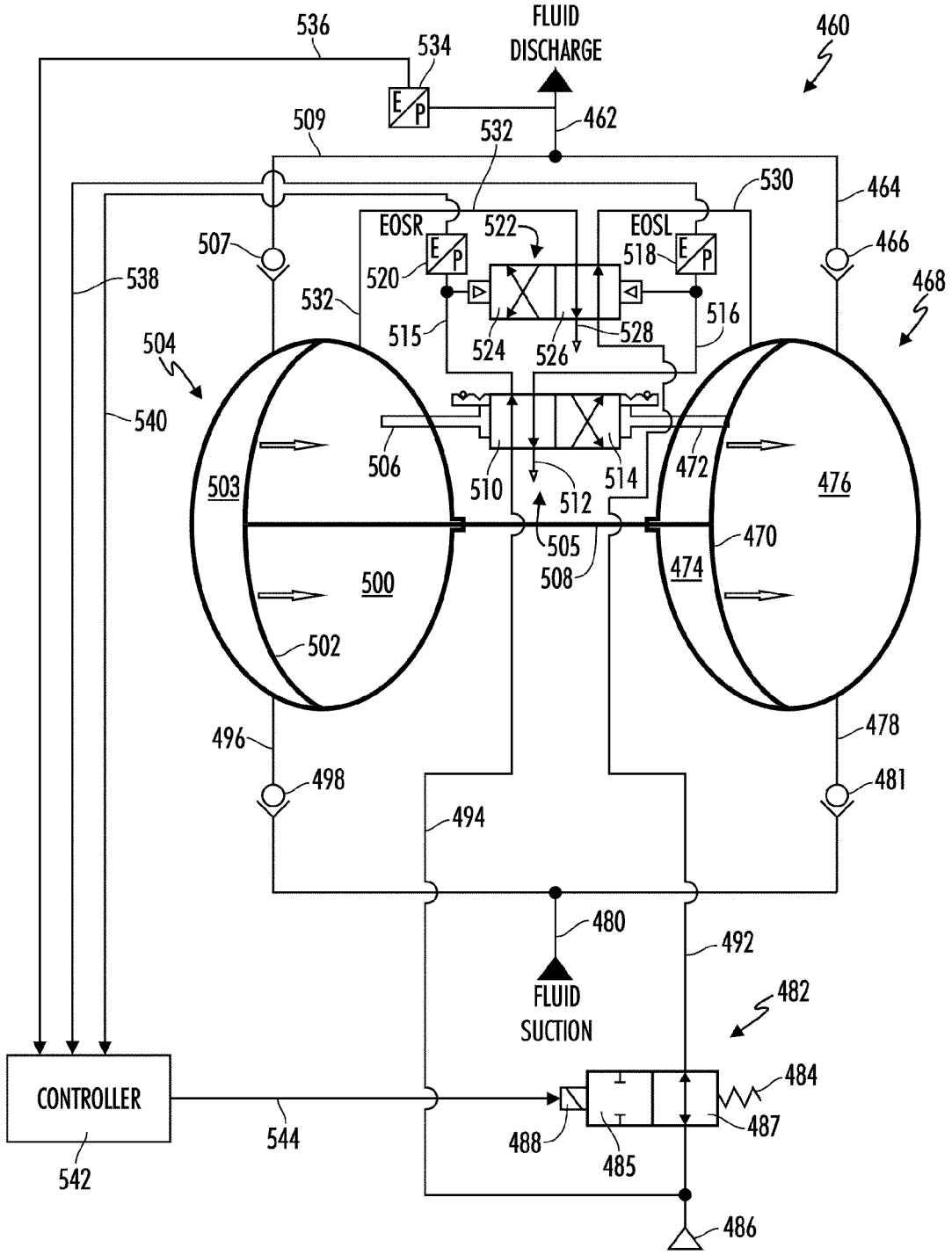
FIG. 37 is a schematic illustrating the AOD pump shown in FIG. 35.
Figure 38:
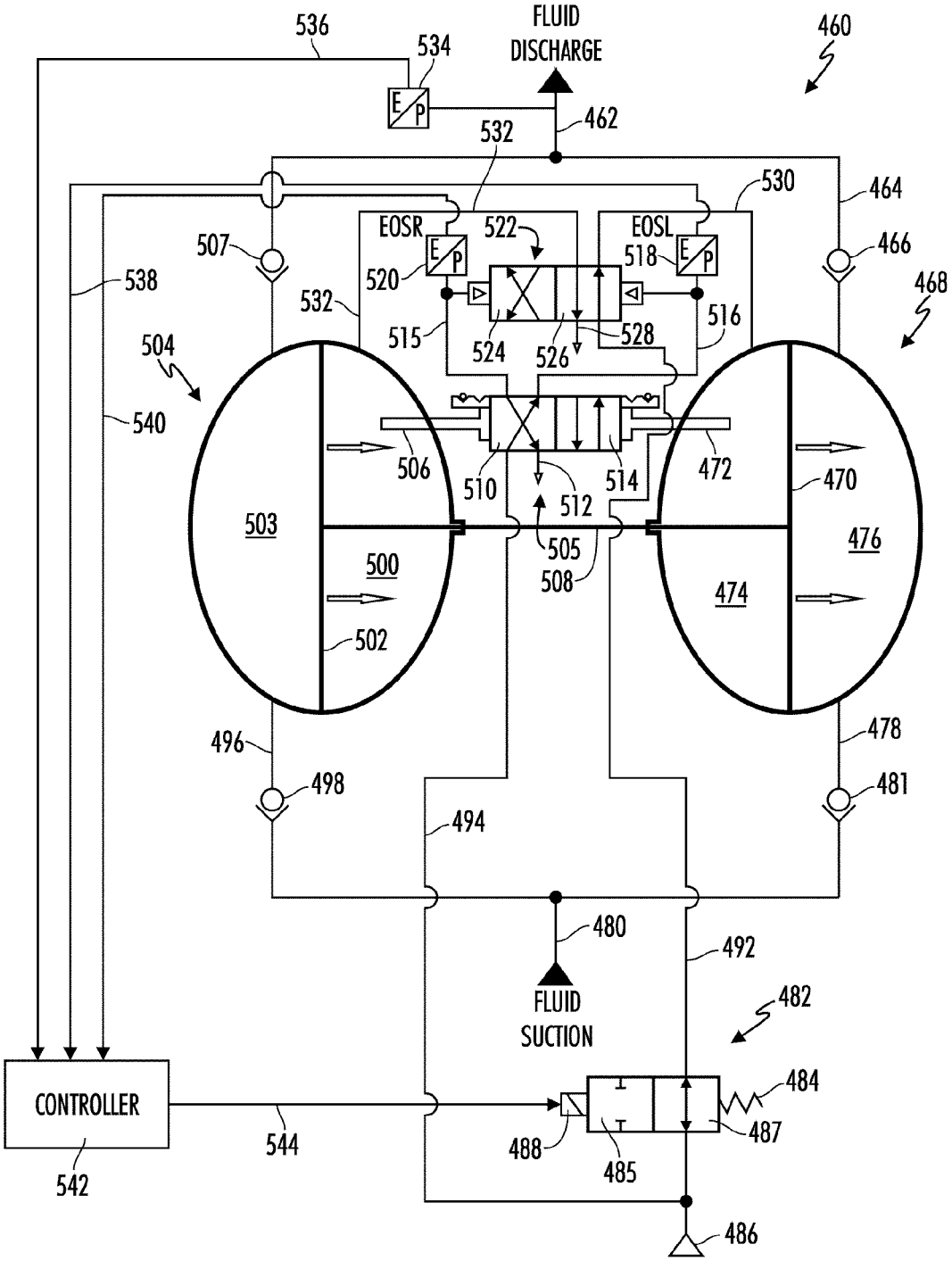
FIG. 38 is a schematic illustrating the AOD pump shown in FIG. 35.

In step 440, valves 505 and 522 are locked in the end-of-stroke left condition and solenoid 488 is de-energized to place porting configuration 487 in the active position in valve 482. As shown in FIG. 37, compressed air is being supplied to left side 474 of diaphragm chamber 468 and air in right side 500 of diaphragm chamber 504 is being exhausted through exhaust port 528. Fluid present in right side 476 of diaphragm chamber 468 is pushed through line 464 and check valve 466 to fluid discharge line 462. Check valve 481 in line 478 prevents fluid from flowing from right side 476 back into line 478 during rightward movement of diaphragm 470. At the same time, fluid is pulled from fluid suction line 480, line 496, and check valve 498 into left side 503 of diaphragm chamber 504 during rightward movement of diaphragm 502. Check valve 507 prevents fluid in line 509 from being pulled back into left side 503 during rightward movement of diaphragm 502.

In step 442, solenoid 488 remains de-energized for a user defined time period X milliseconds (mS), allowing spring 484 to hold porting configuration 487 in the active position of valve 482. In step 444 solenoid 488 is energized and moves porting configuration 485 into the active position in valve 482. Porting configuration 485 closes lines 490 and 492 which places valve 482 into the airsaver 2 condition. Air previously pushed into left side 474 of diaphragm chamber 468 expands and air exhausts from right side 500 of diaphragm chamber 504 to force diaphragms 470 and 502 rightward. In step 446 a timer in controller 542 is activated and the method proceeds to step 448. In step 448, if an end-of-stroke right signal is received by controller 542 from sensor 520 the method proceeds to step 428. If an end-of-stroke right signal is not received by controller 542 the method advances to step 450.

In step 450, a user selectable timeout period is compared to the time elapsed as measured by the timer started in step 446. If the elapsed time period has reached the timeout period the method returns to step 440. If the timeout period has not expired the method returns to step 448.

In the embodiment described above, a power failure to controller 542 or solenoid 488 allows the pump to continue to operate assuming compressed air is continuously supplied by air supply 486.

Figure 39:
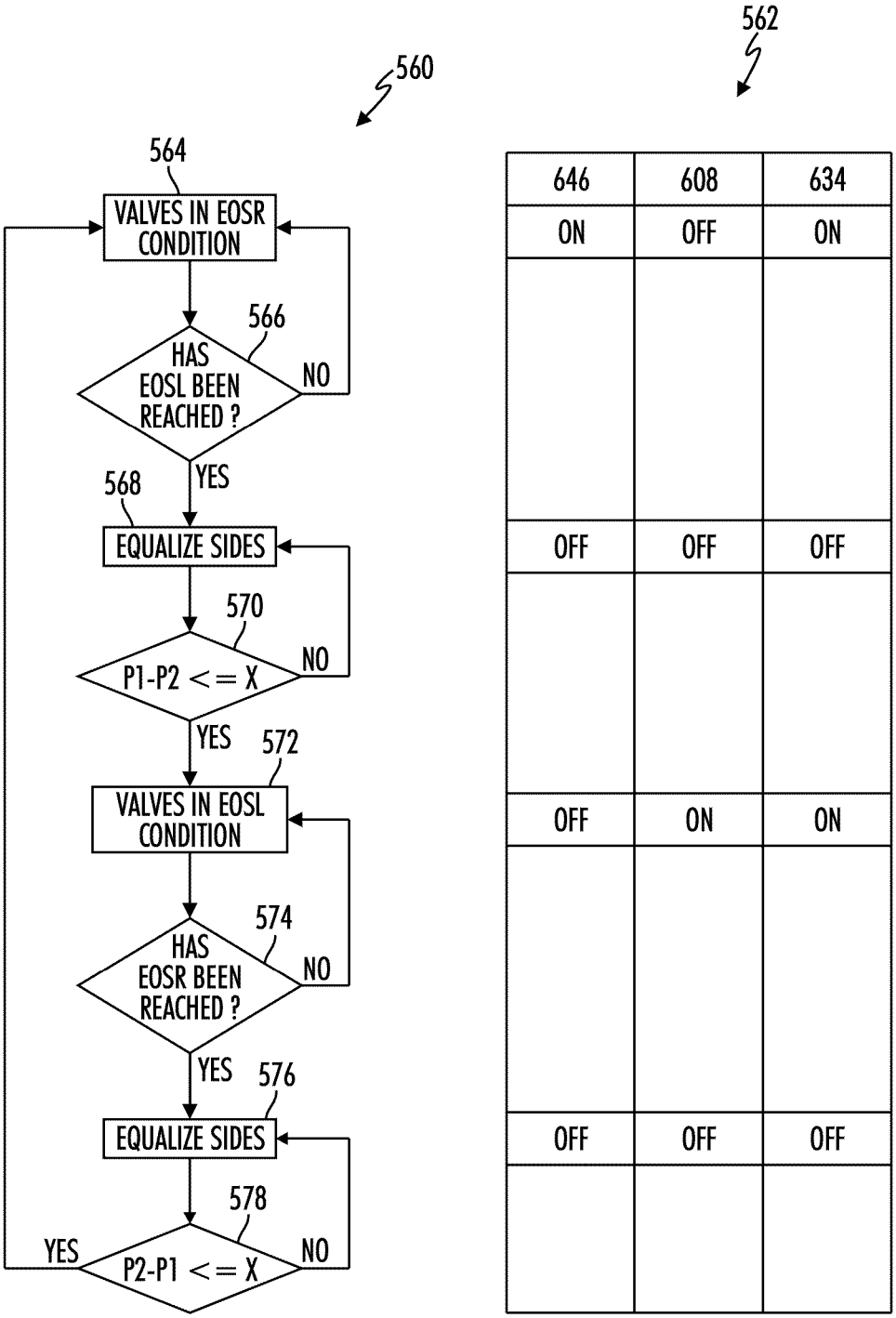
FIG. 39 is a flowchart and a logic table describing a method of operating the AOD pump shown in FIGS. 40-42.
Figure 40:
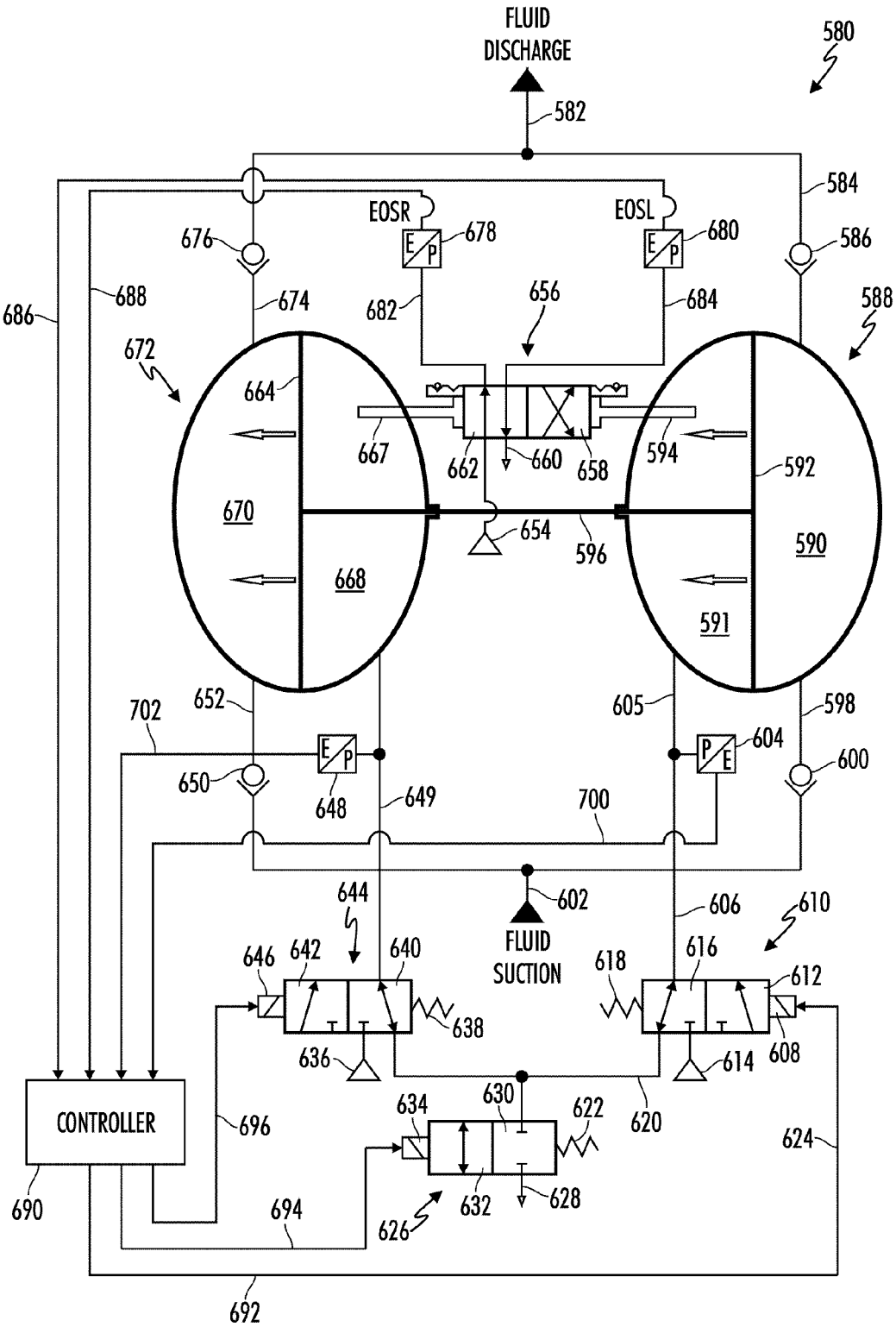
FIG. 40. is a schematic illustrating another embodiment of a AOD pump.

Another method and apparatus of the present invention is shown in FIGS. 39-42. An AOD pump 580 including diaphragm chambers 588 and 672, pilot valve 656, controller 670, and control valves 644, 626, and 610 is shown in FIG. 40. AOD pump 580 receives fluid at fluid suction line 602 and outputs pressurized fluid at fluid discharge 582. Diaphragm chamber 588 includes left side 591, right side 590, and diaphragm 592. Diaphragm chamber 672 includes left side 670, right side 668, and diaphragm 664. Diaphragms 664 and 592 are coupled together by rod 596.

Pilot valve 656 functions similarly to pilot valve 926 shown in FIG. 11. Pilot valve 656 is a four-port, two position valve. Pilot valve 656 includes control rods 667 (change 666 to 667 on FIGS. 40, 41, and 42) and 594 and porting configurations 662 and 658. Porting configuration 662 connects air supply 654 to line 682 and line 684 to exhaust port 660. Porting configuration 658 connects air supply 654 to line 684 and line 682 to exhaust port 660. Pressure sensor 678 is coupled to line 682 and sends an electrical signal to controller 670 indicating an end-of-stroke right condition has been detected when air is supplied to line 682. Similarly, pressure sensor 680 is coupled to line 684 and sends an electrical signal to controller 670 indicating an end-of-stroke left condition has been detected when air is supplied to line 684.

Control valves 644 and 610 are three-port, two position solenoid valves with spring return. Control valve 644 includes porting configurations 640 and 642. Spring 638 maintains porting configuration 640 in the active position in valve 644 when solenoid 646 is de-energized. Solenoid 646 can be energized to move porting configuration 642 into the active position of valve 644. Porting configuration 640 connects line 620 with 649 and closes air supply 636. Porting configuration 642 connects line 649 with air supply 636 and closes line 620. Control valve 610 includes porting configurations 612 and 616. Spring 618 maintains porting configuration 616 in the active position in valve 610 when solenoid 608 is de-energized. Solenoid 608 can be energized to move porting configuration 612 into the active position of valve 610. Porting configuration 616 connects line 620 with 606 and closes air supply 614. Porting configuration 612 connects line 606 with air supply 614 and closes line 620.

Control valve 626 is a two-port, two position solenoid valve with spring return. Control valve 626 includes porting configurations 630 and 632. Spring 622 maintains porting configuration 630 in the active position in valve 626 when solenoid 634 is de-energized. Solenoid 634 can be energized to move porting configuration 632 into the active position of valve 626. Porting configuration 632 connects line 620 with exhaust port 628. Porting configuration 630 closes line 620 and exhaust port 628.

Referring now to flowchart 560 and table 562 in FIG. 39, a method of operating AOD pump 580 is shown. In step 564, the pilot valve 656 is locked in the end-of-stroke right condition and solenoids 646 and 634 are energized. Solenoid 646 moves porting configuration 642 into the active position in valve 644 which allows compressed air from air supply 636 to flow to right side 668 of diaphragm chamber 672 through line 649. Solenoid 634 moves porting configuration 632 into the active position in valve 626. Spring 618 of valve 610 holds porting configuration 616 in the active position to allow air from left side 591 of diaphragm chamber 588 to be vented to the atmosphere through lines 605,620, and exhaust port 628.

Figure 41:
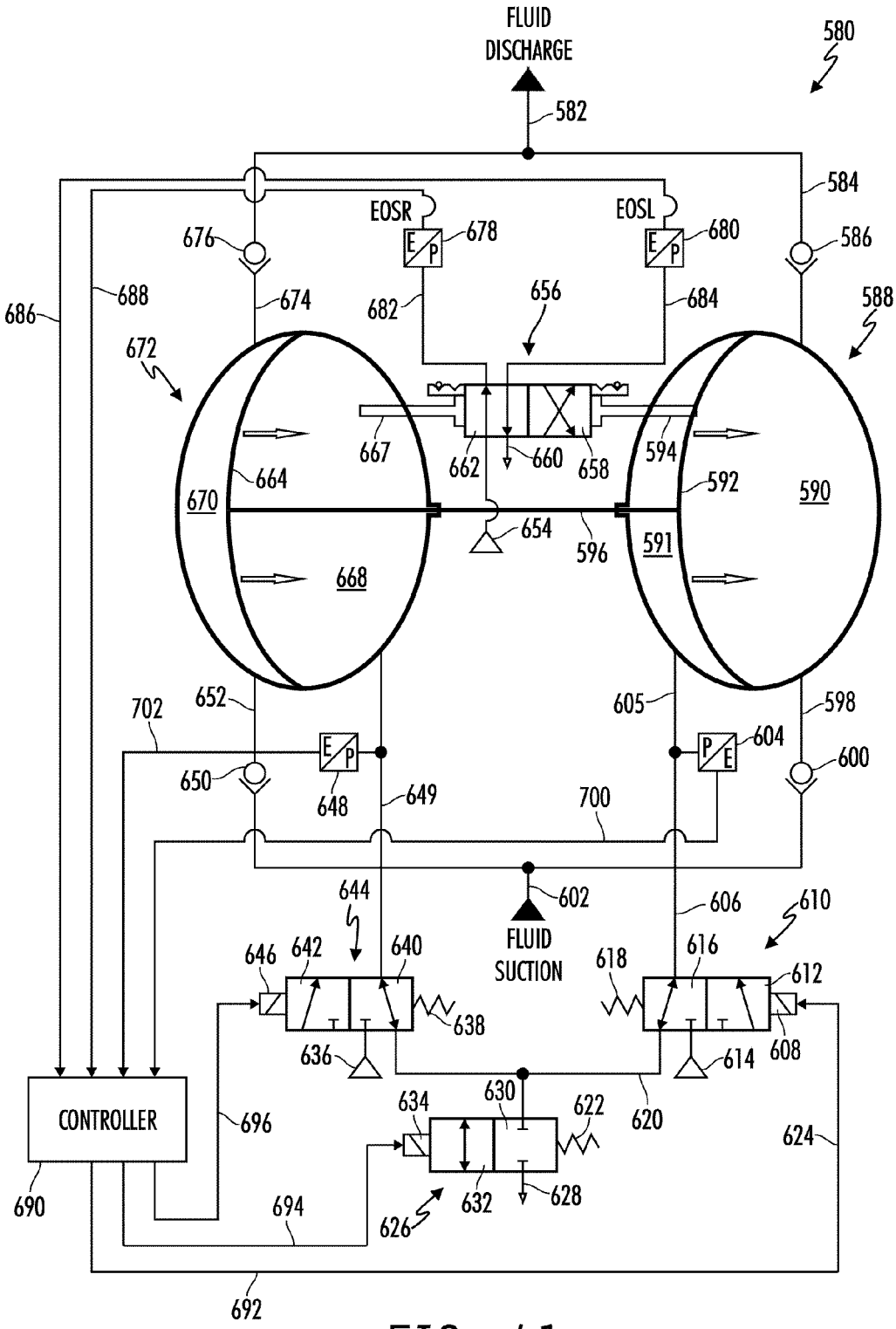
FIG. 41 is a schematic illustrating the AOD pump shown in FIG. 40.

In step 566, if diaphragms 664 and 592 reach end-of-stroke left, as shown in FIG. 41, the method advances to step 568. If diaphragms 664 and 592 have not reached end-of-stroke left the method returns to step 564. In step 568, the pressure in right side 668 of diaphragm chamber 672 is equalized with the pressure in left side 591 of diaphragm chamber 588. All solenoids are deactivated so that air in right side 668 can flow through line 649, valve 644, line 620, valve 616 and line 605 to left side 591 of diaphragm chamber 588. In step 568, porting configuration 640 is in the active position in valve 644, porting configuration 616 is in the active position in valve 610, and porting configuration 630 is in the active position in valve 626.

Sensor 648 measures the pressure P1 in right side 668 and sends a corresponding signal to controller 670. Sensor 604 measures the pressure P2 in left side 591 and sends a corresponding signal to controller 670. Controller 670 compares the difference between P1 and P2 to a user selectable pressure X. If the difference between P1 and P2 is less than or equal to X the method advances to step 572. If the difference between P1 and P2 is greater than X the method returns to step 568.

In step 572, the pilot valve is locked in the end-of-stroke left condition and solenoids 608 and 634 are energized. Solenoid 608 moves porting configuration 612 into the active position in valve 610 which allows compressed air from air supply 614 to flow to left side 591 of diaphragm chamber 588. Solenoid 634 moves porting configuration 632 into the active position in valve 626 to allow air from right side 668 of diaphragm chamber 672 to be vented to the atmosphere through exhaust port 628.

Figure 42:
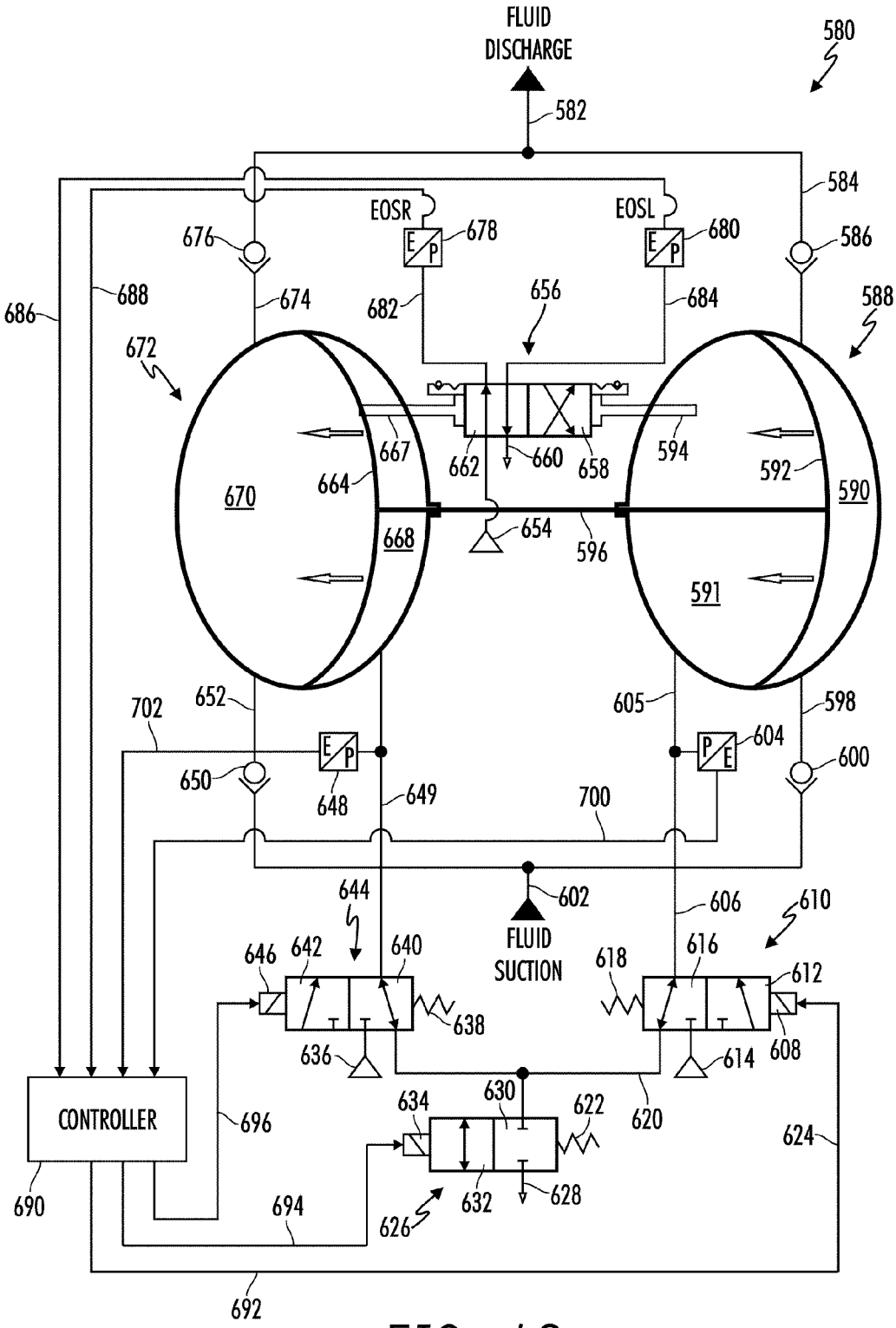
FIG. 42 is a schematic illustrating the AOD pump shown in FIG. 40.

In step 574, if diaphragms 664 and 592 reach end-of-stroke right, as shown in FIG. 42, the method advances to step 576. If diaphragms 664 and 592 have not reached end-of-stroke right the method returns to step 572. In step 576, the pressure in right side 668 of diaphragm chamber 672 is equalized with the pressure in left side 591 of diaphragm chamber 588. All solenoids are deactivated so that air in left side 591 can flow through line 605, valve 610, line 620, valve 644 and line 649 to right side 668 of diaphragm chamber 672. In step 576, porting configuration 640 is in the active position in valve 644, porting configuration 616 is in the active position in valve 610, and porting configuration 630 is in the active position in valve 626.

In step 578, controller 670 compares the difference between P2 and P1 to the user selectable pressure X. If the difference between P2 and P1 is less than or equal to X the method returns to step 564. If the difference between P2 and P1 is greater than X the method returns to step 576.

Figure 43:
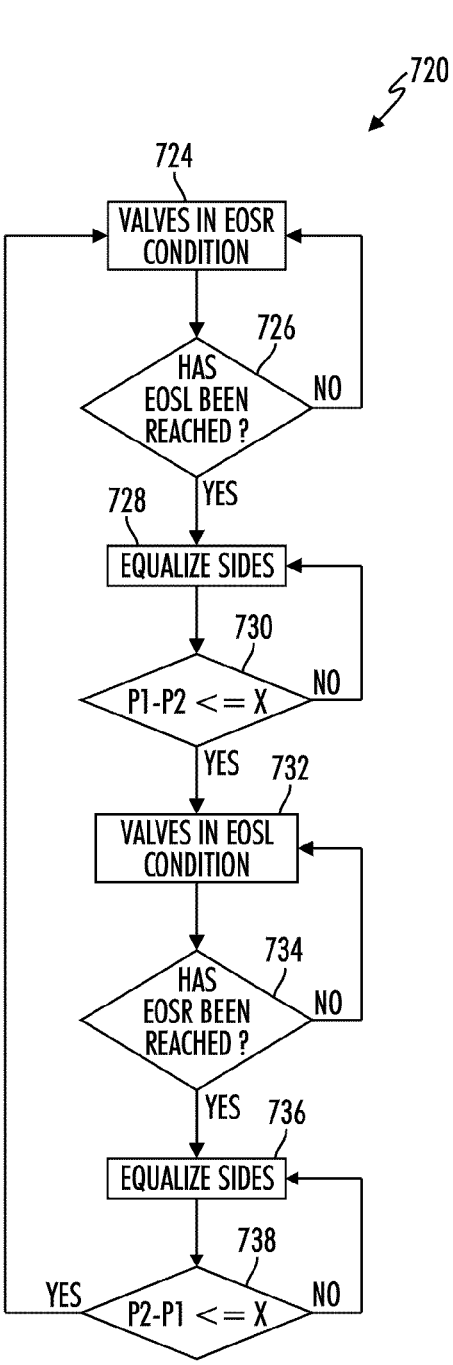
FIG. 43 is a flowchart and a logic table describing a method of operating the AOD pump shown in FIGS. 44-47.
Figure 44:
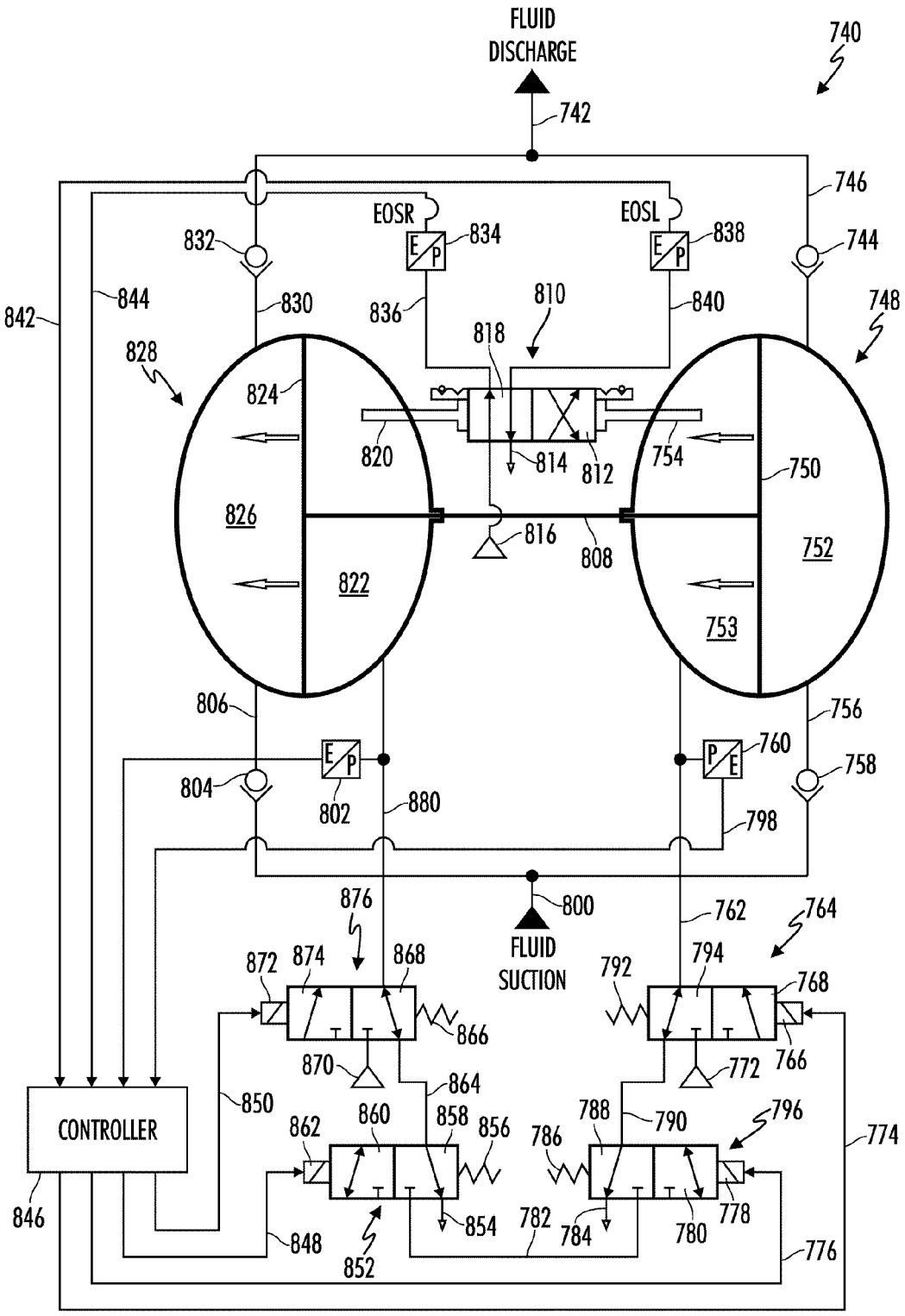
FIG. 44 is a schematic illustrating another embodiment of a AOD pump.

Another method and apparatus of the present invention is shown in FIGS. 43-47. A AOD pump 740 including diaphragm chambers 748 and 828, pilot valve 810, controller 846, and control valves 876, 852, 796, and 764 is shown in FIG. 44. AOD pump 740 receives fluid at fluid suction line 800 and outputs pressurized fluid at fluid discharge line 742. Diaphragm chamber 828 includes left side 826, right side 822, and diaphragm 824. Diaphragm chamber 748 includes left side 753, right side 752, and diaphragm 750. Diaphragms 824 and 750 are coupled together by rod 808.

Pilot valve 810 functions similarly to pilot valve 926 shown in FIG. 11. Pilot valve 810 is a four-port, two position valve. Pilot valve 810 includes control rods 820 and 754 and porting configurations 812 and 818. Porting configuration 818 connects air supply 816 to line 836 and line 840 to exhaust port 814. Porting configuration 812 connects air supply 816 to line 840 and line 836 to exhaust port 814. Pressure sensor 834 is coupled to line 836 and sends an electrical signal to controller 846 indicating an end-of-stroke right condition has been detected when air is supplied to line 836. Similarly, pressure sensor 838 is coupled to line 840 and sends an electrical signal to controller 846 indicating an end-of-stroke left condition has been detected when air is supplied to line 840.

Control valves 876, 852, 796, and 764 are three-port, two position solenoid valves with spring return. Control valve 876 includes porting configurations 874 and 868. Spring 866 maintains porting configuration 868 in the active position in valve 876 when solenoid 872 is de-energized. Solenoid 872 can be energized to move porting configuration 874 into the active position of valve 876. Porting configuration 868 connects line 880 with line 864 and closes air supply 870. Porting configuration 874 connects line 880 with air supply 870 and closes line 864. Control valve 852 includes porting configurations 860 and 858. Spring 856 maintains porting configuration 858 in the active position in valve 852 when solenoid 862 is de-energized. Solenoid 862 can be energized to move porting configuration 860 into the active position of valve 852. Porting configuration 858 connects line 864 with exhaust port 854 and closes line 782. Porting configuration 860 connects line 864 with line 782 and closes exhaust port 854.

Control valve 764 includes porting configurations 794 and 768. Spring 792 maintains porting configuration 794 in the active position in valve 764 when solenoid 766 is de-energized. Solenoid 766 can be energized to move porting configuration 768 into the active position of valve 764. Porting configuration 794 connects line 762 with line 790 and closes air supply 772. Porting configuration 768 connects line 762 with air supply 772 and closes line 790. Control valve 796 includes porting configurations 780 and 788. Spring 786 maintains porting configuration 788 in the active position in valve 796 when solenoid 778 is de-energized. Solenoid 778 can be energized to move porting configuration 780 into the active position of valve 796. Porting configuration 788 connects line 790 with exhaust port 784 and closes line 782. Porting configuration 780 connects line 782 with line 790 and closes exhaust port 784.

As shown in FIG. 44, diaphragms 824 and 750 have recently been in the end-of-stroke right position and are moving leftward. In this condition, fluid present in left side 826 of diaphragm chamber 828 is pushed through line 830 and check valve 832 to fluid discharge line 742. Check valve 804 in line 806 prevents fluid from flowing back into line 806 from left side 826 during leftward movement of diaphragm 824. At the same time, diaphragm 750 is moving leftward which creates a vacuum in right side 752 of diaphragm chamber 748. Fluid is pulled from line 800 through check valve 758 and line 756 into right side 752. Check valve 744 in line 746 prevents fluid in line 746 from being pulled back into right side 752 during leftward movement of diaphragm 750.

Figure 45:
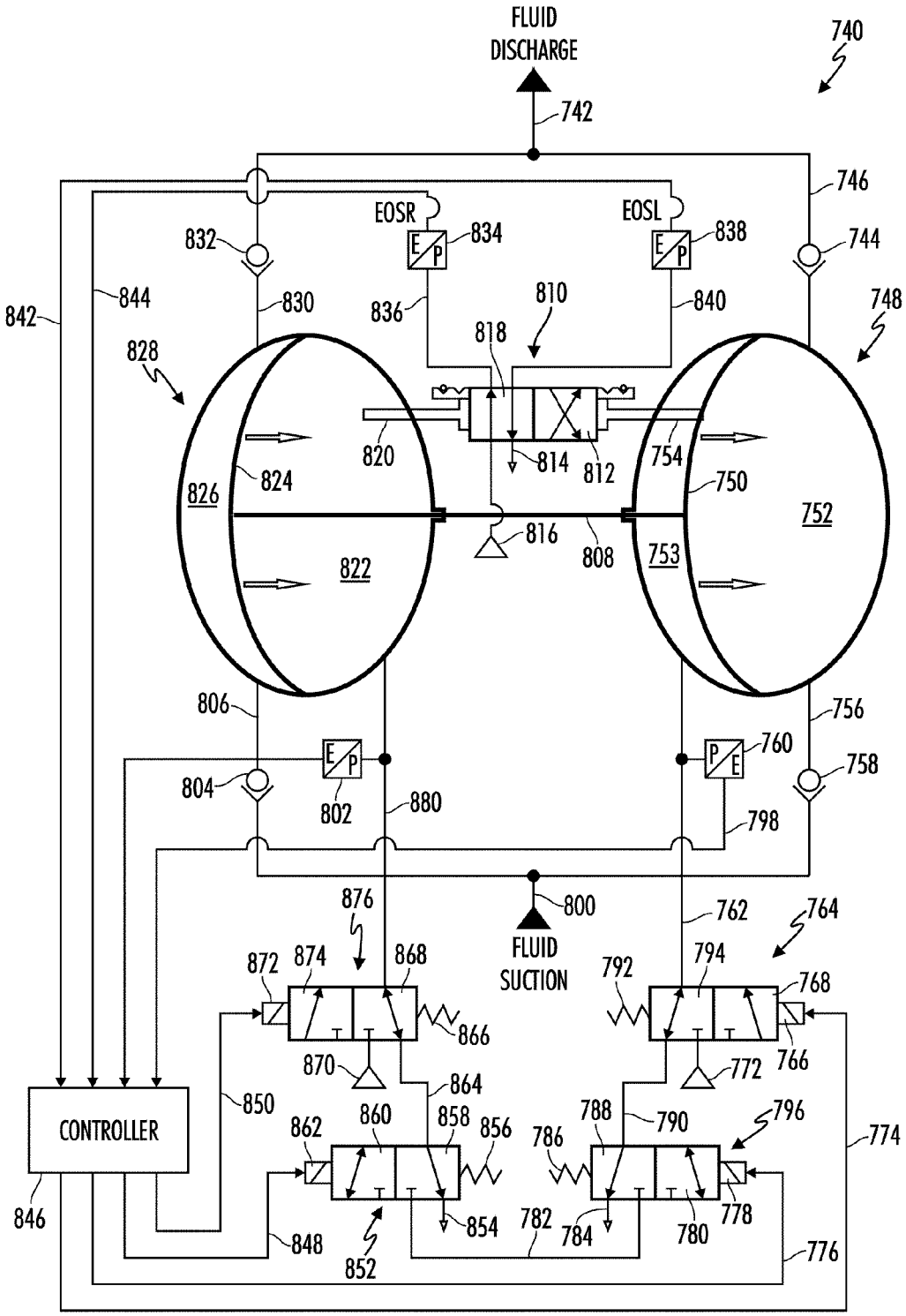
FIG. 45 is a schematic illustrating the AOD pump shown in FIG. 44.

Referring now to FIG. 45, diaphragms 824 and 750 have reached the end-of-stroke left position and are beginning to move rightward. In this condition, fluid present in right side 752 of diaphragm chamber 748 is pushed through line 746 and check valve 744 to fluid discharge line 742. Check valve 758 in line 756 prevents fluid from flowing back into line 756 from right side 752 during rightward movement of diaphragm 750. At the same time, diaphragm 824 is moving rightward which creates a vacuum in left side 826 of diaphragm chamber 828. Fluid is pulled from line 800 through check valve 804 and line 806 into left side 826. Check valve 832 in line 830 prevents fluid in line 830 from being pulled back into left side 826 during rightward movement of diaphragm 824.

Referring now to flowchart 720 and table 722 on FIG. 43, a method of operating AOD pump 740 shown. In step 724, pilot valve 810 is locked in the end-of-stroke right condition and solenoid 872 is energized. Solenoid 872 moves porting configuration 874 into the active position in valve 876 which allows compressed air from air supply 870 to flow to right side 822 of diaphragm chamber 828 to move diaphragm 824 leftward. In valve 764, porting configuration 794 is in the active position which allows air in left side 753 to pass through line 762 to line 790. In valve 796, porting configuration 788 is in the active position to allow air in line 790 to be vented to the atmosphere through exhaust port 784 as diaphragm 750 moves leftward.

Figure 46:
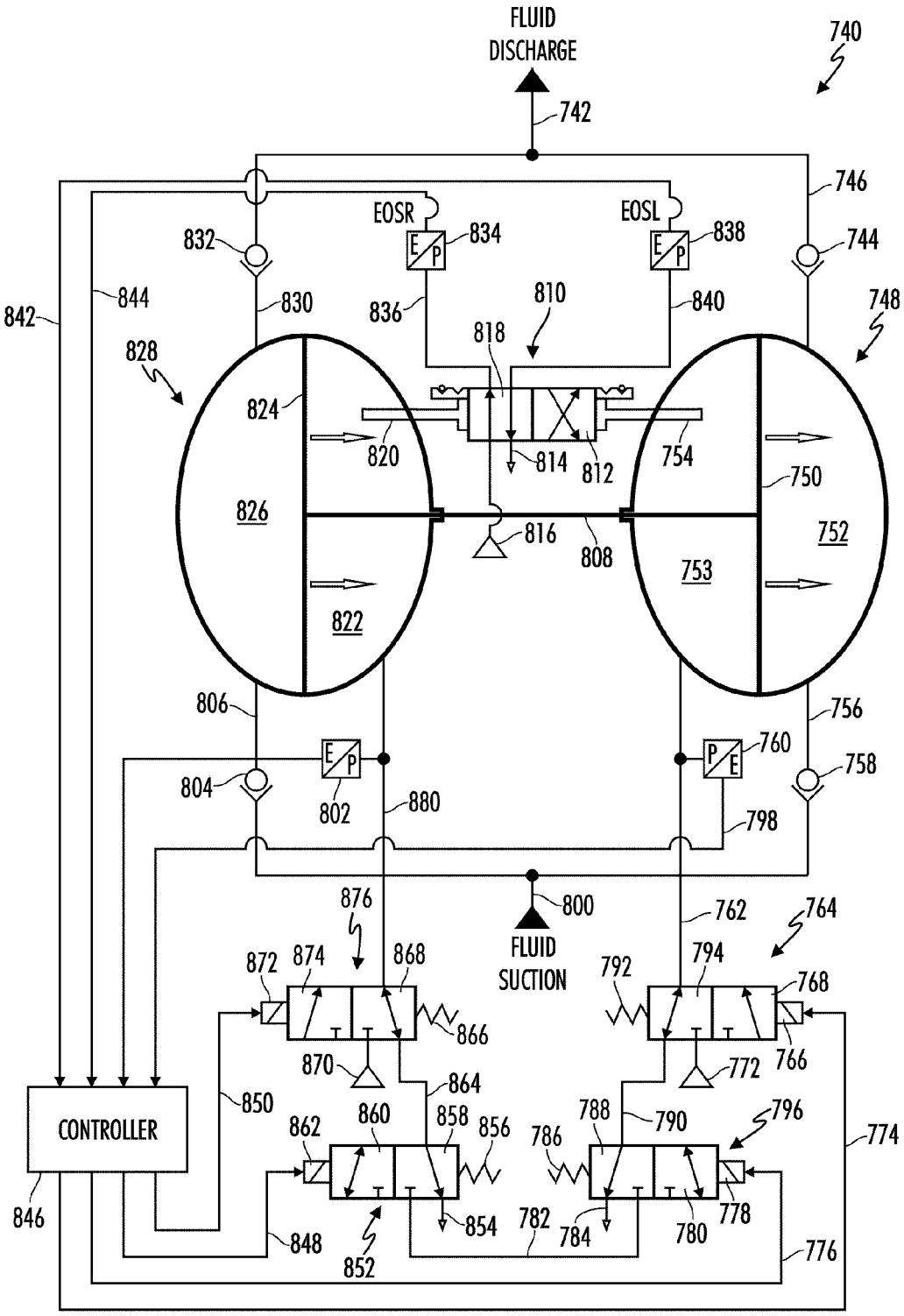
FIG. 46 is a schematic illustrating the AOD pump shown in FIG. 44.

In step 726, if diaphragms 824 and 750 reach end-of-stroke left, as shown in FIG. 45, the method advances to step 728. If diaphragms 824 and 750 have not reached end-of-stroke left the method returns to step 724. In step 728, the pressure in right side 822 of diaphragm chamber 828 is equalized with the pressure in left side 753 of diaphragm chamber 748 to move diaphragms 824 and 750 rightward as shown in FIG. 46. Solenoids 862 and 778 are energized to move porting configurations 860 and 780 into the active positions of valves 852 and 796. In step 728, air in right side 822 flows through line 880, valve 876, line 864, valve 852, line 782, valve 796, line 790, valve 764, and line 762 to left side 753 of diaphragm chamber 748. In step 728, porting configuration 868 is in the active position in valve 876 and porting configuration 794 is in the active position in valve 764.

Sensor 802 measures the pressure P1 in right side 822 and sends a corresponding signal to controller 846. Sensor 760 measures the pressure P2 in left side 753 and sends a corresponding signal to controller 846. Controller 846 compares the difference between P1 and P2 to a user selectable pressure X. If the difference between P1 and P2 is less than or equal to X the method advances to step 732. If the difference between P1 and P2 is greater than X the method returns to step 728.

In step 732, pilot valve is locked in the end-of-stroke left condition and solenoid 766 is energized. Solenoid 766 moves porting configuration 768 into the active position in valve 764 which allows compressed air from air supply 772 to flow to left side 753 of diaphragm chamber 748. Porting configuration 868 is in the active position in valve 876 to allow air from right side 822 of diaphragm chamber 828 through line 880 and valve 876 to line 864. Porting configuration 858 is in the active position in valve 852 to allow air in line 864 to be vented to the atmosphere through exhaust port 854.

Figure 47:
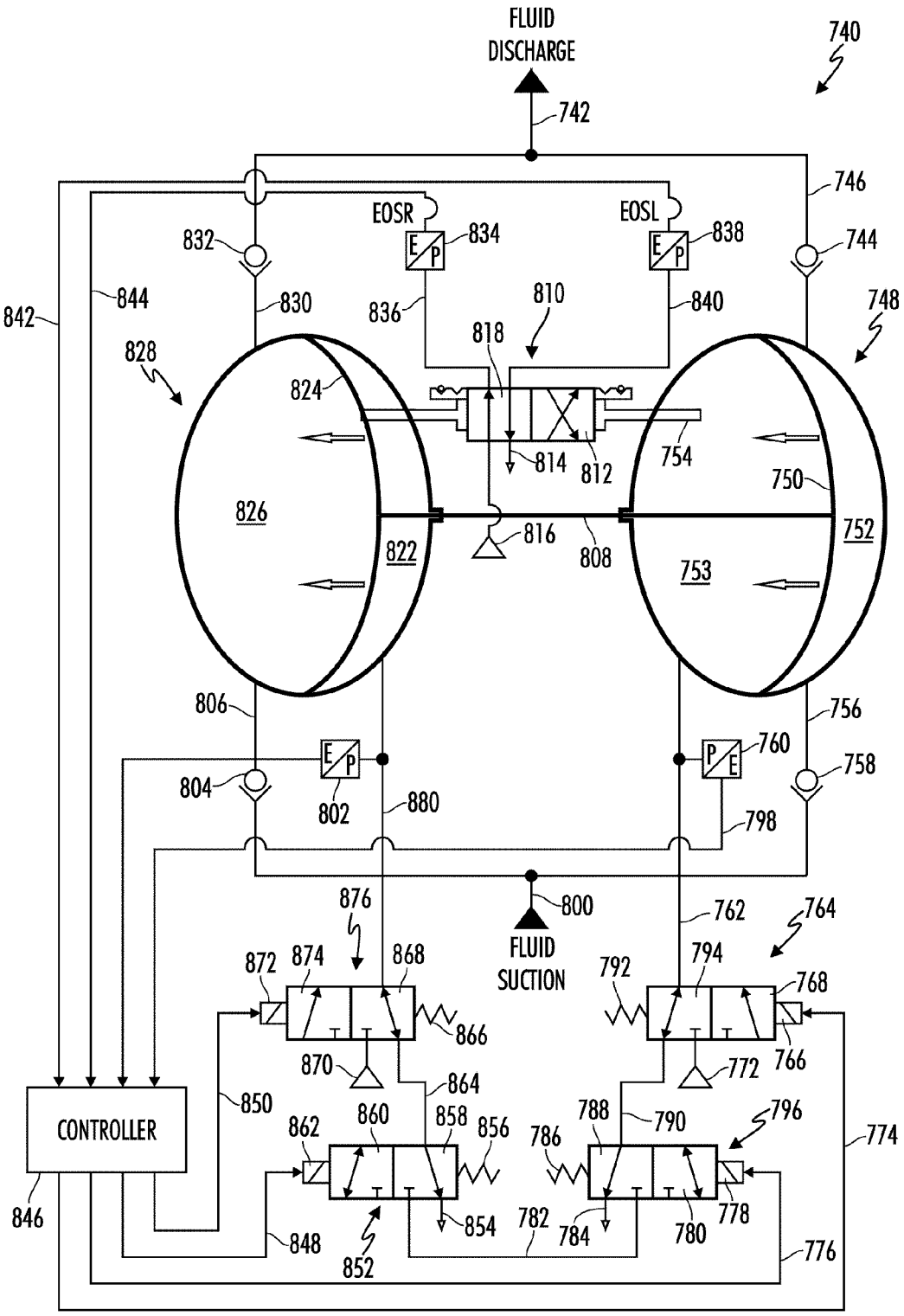
FIG. 47 is a schematic illustrating the AOD pump shown in FIG. 44.

In step 734, if diaphragms 824 and 750 reach end-of-stroke right, as shown in FIG. 47, the method advances to step 736. If diaphragms 824 and 750 have not reached end-of-stroke right the method returns to step 732. In step 736, the pressure in right side 822 of diaphragm chamber 828 is equalized with the pressure in left side 753 of diaphragm chamber 748. As shown in table 722 on FIG. 43, solenoids 862 and 778 are energized to allow air in left side 753 to flow through line 762, valve 764, line 790, valve 796, line 782, valve 852, line 864, valve 876, and line 880 to right side 822 of diaphragm chamber 828. In step 736, porting configuration 868 is in the active position in valve 876 and porting configuration 794 is in the active position in valve 764.

In step 738, controller 846 compares the difference between P2 and P1 to the user selectable pressure X. If the difference between P2 and P1 is less than or equal to X the method returns to step 724. If the difference between P2 and P1 is greater than X the method returns to step 736.

Although the invention has been described in detail with reference to certain preferred embodiments, variations and modifications exist within the spirit and scope of the invention as described and defined in the following claims.

The invention claimed is:

1. A pump including:

a housing defining a pair of chambers;

a first pump member separating one of the chambers into a pumping side and a pumped side, the first pump member being movable between a first position and a second position, thereby forcing fluid from the pumped side of the one chamber;

a second pump member separating another of the chambers into a pumping side and a pumped side, the second pump member being movable between a first position and a second position, thereby forcing fluid from the pumped side of the other chamber;

an air piloted supply valve in flow communication with a supply of pressurized fluid, the supply valve being movable between an opened position wherein pressurized fluid flows to the pumping side of one of the chambers, and a closed position wherein pressurized fluid is inhibited from flowing to either of the chambers, the supply valve having a first port in flow communication with the supply of pressurized fluid and a second port; and a mechanical controller including a pressure regulator having an input in flow communication with the supply of pressurized fluid and an output in flow communication with the second port of the supply valve;

wherein after the supply valve has been in the opened position for a period of time, the output of the pressure regulator provides pressurized fluid to the second port of a sufficient pressure to move the supply valve to the closed position.

2. The pump of claim 1 wherein the mechanical controller further comprises a restriction between the input of the pressure regulator and a port of the pressure regulator.

3. The pump of claim 2 wherein in response to the supply valve moving into the opened position, the restriction causes a pressure drop at the port of the pressure regulator, which thereby provides pressurized fluid to the second port of a pressure that is insufficient to move the supply valve to the closed position.

4. The pump of claim 1 wherein the one of the first and the second pump members moves from the first position toward the second position in response to the supply valve moving into the opened position, and the one of the first and the second pump members continues to move toward the second position for a period of time after the supply valve moves to the closed position.

5. The pump of claim 2 wherein the mechanical controller further includes a mechanical pressure sensor in flow communication with an output of the supply valve, the mechanical pressure sensor being configured to detect a predetermined pressure at the output of the supply valve and respond to detection of the predetermined pressure by relieving pressure at the port of the pressure regulator, which thereby reduces pressure at the second port of the supply valve below the sufficient pressure to move the supply valve to the closed position.

6. The pump of claim 2 wherein the restriction is an adjustable needle valve.

7. The pump of claim 6 wherein adjustment of the needle valve changes the period of time the supply valve remains in the opened position.

8. The pump of claim 5 wherein the mechanical pressure sensor is a pressure regulator that is adjustable to set the predetermined pressure.

9. The pump of claim 5 wherein the predetermined pressure corresponds to the pump member being adjacent an end-of-stroke position.

10. An air operated diaphragm pump including:

first and second diaphragm chambers, each diaphragm chamber including a diaphragm, the diaphragms coupled together;

a first valve moveable between first and second positions, the first position configured to supply a gas to the first diaphragm chamber, the second position configured to supply gas to the second diaphragm chamber;

a second valve moveable between an open position and a closed position, the open position configured to connect a gas supply to the first valve, the closed position configured to prevent the gas supply from reaching the first valve; and a pressure regulator in flow communication with the gas supply and the second valve, the pressure regulator being configured to cause the second valve to move from the open position to the closed position after a period of time by providing gas to the second valve of a sufficient pressure.

11. The pump of claim 10 wherein the pressure regulator includes an input in flow communication with the gas supply and a control port for opening and closing the pressure regulator, the pump further comprising a restriction between the input of the pressure regulator and the control port.

12. The pump of claim 11 wherein in response to the second valve moving into the open position, the restriction causes a pressure drop at the control port, which thereby provides gas to the second valve of a pressure that is insufficient to move the second valve to the closed position.

13. The pump of claim 10 wherein the diaphragms of the first and second diaphragm chambers move between a first position and a second position to thereby pump fluid through the pump, the diaphragms move toward the second position in response to the second valve moving into the open position, and the diaphragms continue to move toward the second position for a period of time after the second valve moves into the closed position.

14. The pump of claim 10 further including a mechanical pressure sensor in flow communication with an output of the second valve, the mechanical pressure sensor being configured to detect a predetermined pressure at the output of the second valve and respond to detection of the predetermined pressure by causing the pressure regulator to provide gas to the second valve of a pressure that is below the sufficient pressure.

15. The pump of claim 12 wherein the restriction is an adjustable needle valve, and wherein adjustment of the needle valve adjust the period of time the second valve remains in the open position.

16. The pump of claim 10 further comprising a mechanical pressure sensor configured to cause the pressure regulator to move the second valve to the open position in response to a pressure downstream of the second valve falling to a predetermined pressure.

17. The pump of claim 16 wherein the predetermined pressure indicates an end-of-stroke position for one of the diaphragms.

18. A mechanical controller for an air operated diaphragm pump comprising:

a pressure regulator coupled to an input valve configured to provide pressurized gas to the pump from a gas supply, the pressure regulator having an input configured to receive pressurized gas from the gas supply, an output configured to provide pressurized gas to a control port of the input valve, and a control port;

a needle valve having an input configured to receive pressurized gas from the gas supply and an output configured to provide pressurized gas to the control port of the pressure regulator; and a mechanical pressure sensor coupled between an output of the input valve and the control port of the pressure regulator;

wherein the pressure regulator maintains the input valve in an open position wherein the input valve supplies pressurized gas to the pump until the pressure at the control port of the pressure regulator causes the pressure regulator to open, thereby providing pressurized gas to the control port of the input valve and moving the input valve to a closed position; and wherein the pressure regulator moves the input valve to the open position when a pressure at the output of the input valve decreases to a predetermined pressure, thereby causing the mechanical pressure sensor to relieve pressure at the control port of the pressure regulator and reduce the pressure of gas at the control port of the input valve.

19. The mechanical controller of claim 18, wherein adjustment of the needle valve causes a change in the amount of time the input valve is in the open position.

20. The mechanical controller of claim 18, wherein the pressure regulator moves the input valve to the closed position before a pump member in the pump reaches an end-of-stroke position.

21. A pump including:

a housing defining a chamber;

a pump member separating the chamber into a pumping side and a pumped side, the pump member being movable between a first position and a second position, thereby forcing fluid from the pumped side of the chamber;

an air piloted supply valve in flow communication with a supply of pressurized fluid, the supply valve being movable between an opened position wherein pressurized fluid flows to the pumping side of the chamber, and a closed position wherein pressurized fluid is inhibited from flowing to the chamber, the supply valve having a first port in flow communication with the supply of pressurized fluid and a second port; and a mechanical controller including a pressure regulator having an input in flow communication with the supply of pressurized fluid, an output in flow communication with the second port of the supply valve and a restriction between the input of the pressure regulator and a port of the pressure regulator;

wherein after the supply valve has been in the opened position for a period of time, the output of the pressure regulator provides pressurized fluid to the second port of a sufficient pressure to move the supply valve to the closed position.

22. The pump of claim 21 wherein in response to the supply valve moving into the opened position, the restriction causes a pressure drop at the port of the pressure regulator, which thereby provides pressurized fluid to the second port of a pressure that is insufficient to move the supply valve to the closed position.

23. The pump of claim 21 wherein the pump member moves from the first position toward the second position in response to the supply valve moving into the opened position, and the pump member continues to move toward the second position for a period of time after the supply valve moves to the closed position.

24. The pump of claim 21 wherein the mechanical controller further includes a mechanical pressure sensor in flow communication with an output of the supply valve, the mechanical pressure sensor being configured to detect a predetermined pressure at the output of the supply valve and respond to detection of the predetermined pressure by relieving pressure at the port of the pressure regulator, which thereby reduces pressure at the second port of the supply valve below the sufficient pressure to move the supply valve to the closed position.

25. The pump of claim 21 wherein the restriction is an adjustable needle valve.

26. The pump of claim 25 wherein adjustment of the needle valve changes the period of time the supply valve remains in the opened position.

27. The pump of claim 24 wherein the mechanical pressure sensor is a pressure regulator that is adjustable to set the predetermined pressure.

28. The pump of claim 24 wherein the predetermined pressure corresponds to the pump member being adjacent an end-of-stroke position.

29. An air operated diaphragm pump including:

first and second diaphragm chambers, each diaphragm chamber including a diaphragm, the diaphragms coupled together;

a first valve moveable between first and second positions, the first position configured to supply a gas to the first diaphragm chamber, the second position configured to supply gas to the second diaphragm chamber;

a second valve moveable between an open position and a closed position, the open position configured to connect a gas supply to the first valve, the closed position configured to close the gas supply;

a pressure regulator in flow communication with the gas supply and the second valve, the pressure regulator being configured to cause the second valve to move from the open position to the closed position after a period of time by providing gas to the second valve of a sufficient pressure and including an input in flow communication with the gas supply and a control port for opening and closing the pressure regulator; and a restriction between the input of the pressure regulator and the control port.

30. The pump of claim 29 wherein in response to the second valve moving into the open position, the restriction causes a pressure drop at the control port, which thereby provides gas to the second valve of a pressure that is insufficient to move the second valve to the closed position.

31. The pump of claim 29 wherein the diaphragms of the first and second diaphragm chambers move between a first position and a second position to thereby pump fluid through the pump, the diaphragms move toward the second position in response to the second valve moving into the open position, and the diaphragms continue to move toward the second position for a period of time after the second valve moves into the closed position.

32. The pump of claim 29 further including a mechanical pressure sensor in flow communication with an output of the second valve, the mechanical pressure sensor being configured to detect a predetermined pressure at the output of the second valve and respond to detection of the predetermined pressure by causing the pressure regulator to provide gas to the second valve of a pressure that is below the sufficient pressure.

33. The pump of claim 29 wherein the restriction is an adjustable needle valve, and wherein adjustment of the needle valve adjust the period of time the second valve remains in the open position.

34. The pump of claim 29 further comprising a mechanical pressure sensor configured to cause the pressure regulator to move the second valve to the open position in response to a pressure downstream of the second valve falling to a predetermined pressure.

35. The pump of claim 34 wherein the predetermined pressure indicates an end-of-stroke position for one of the diaphragms.

* * * * *